US007224339B2

(12) United States Patent
Koyama et al.

(10) Patent No.: US 7,224,339 B2
(45) **Date of Patent: *May 29, 2007**

(54) LIQUID CRYSTAL DISPLAY DEVICE, METHOD OF DRIVING THE SAME, AND METHOD OF DRIVING A PORTABLE INFORMATION DEVICE HAVING THE LIQUID CRYSTAL DISPLAY DEVICE

(75) Inventors: Jun Koyama, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 347 days.

This patent is subject to a terminal disclaimer.

(21) Appl. No.: 09/923,433

(22) Filed: Aug. 8, 2001

(65) Prior Publication Data

US 2002/0021274 A1 Feb. 21, 2002

(30) Foreign Application Priority Data

Aug. 18, 2000 (JP) ..... 2000-249090
Aug. 23, 2000 (JP) ..... 2000-253196

(51) Int. Cl.
*G09G 3/36* (2006.01)

(52) U.S. Cl. ..... 345/98; 345/99

(58) Field of Classification Search ..... 345/87, 345/92, 98, 100, 94, 99
See application file for complete search history.

(56) References Cited

U.S. PATENT DOCUMENTS 4,432,610 A 2/1984 Kobayashi et al.
4,636,788 A 1/1987 Hilbrink
4,752,118 A 6/1988 Johnson
4,752,188 A 6/1988 Gurega
4,773,738 A 9/1988 Hayakawa et al.
4,996,523 A 2/1991 Bell et al.
5,091,722 A 2/1992 Kitajima et al.

(Continued)

FOREIGN PATENT DOCUMENTS

CN 1337669 2/2002

(Continued)

OTHER PUBLICATIONS

Koyama et al., "A 4.0-in Poly Si TFT-LCD with Integrated 6-bit Digital Data Driver Using CGS Technology;" AM-LCD '99, AMP1-3, Jul. 1, 1999, pp. 29-32.

(Continued)

*Primary Examiner*—Kent Chang
(74) *Attorney, Agent, or Firm*—Fish & Richardson P.C.

(57) ABSTRACT

A liquid crystal display device that displays an image by inputting n (n is a natural number) bit digital signals has n memory circuits in each pixel. The n memory circuits store n bit digital signals, which are converted into corresponding analog signals by a D/A converter provided in each pixel so that the analog signals are inputted to a liquid crystal element. Therefore, when a still image is to be displayed, the stored digital signals are repeatedly used once the digital signals are written in the memory circuits. During the still image is displayed, a source signal line driving circuit and other circuits can stop their driving. Power consumption of the liquid crystal display device thus can be reduced.

19 Claims, 38 Drawing Sheets

U.S. PATENT DOCUMENTS

| | | | | |
|---|---|---|---|---|
| 5,125,045 | A | 6/1992 | Murakami et al. | |
| 5,200,846 | A | 4/1993 | Hiroki et al. | |
| 5,225,823 | A | 7/1993 | Kanaly | |
| 5,247,190 | A | 9/1993 | Friend et al. | |
| 5,339,090 | A | 8/1994 | Crossland et al. | |
| 5,349,366 | A | 9/1994 | Yamazaki et al. | |
| 5,376,944 | A | 12/1994 | Mogi et al. | |
| 5,424,752 | A | 6/1995 | Yamazaki et al. | |
| 5,471,225 | A | 11/1995 | Parks | |
| 5,479,283 | A | 12/1995 | Kaneko et al. | |
| 5,483,366 | A | 1/1996 | Atherton | |
| 5,515,187 | A | 5/1996 | Nakamura et al. | |
| 5,600,169 | A | 2/1997 | Burgener et al. | |
| 5,608,549 | A | 3/1997 | Usami | |
| 5,642,129 | A | 6/1997 | Zavracky et al. | |
| 5,673,422 | A | 9/1997 | Kawai et al. | |
| 5,699,078 | A | 12/1997 | Yamazaki et al. | |
| 5,712,652 | A | 1/1998 | Sato et al. | |
| 5,771,031 | A * | 6/1998 | Kinoshita et al. | 345/98 |
| 5,793,344 | A | 8/1998 | Koyama | |
| 5,798,746 | A | 8/1998 | Koyama | |
| 5,818,898 | A | 10/1998 | Tsukamoto et al. | |
| 5,841,482 | A | 11/1998 | Wang et al. | |
| 5,854,628 | A | 12/1998 | Nakagawa | |
| 5,907,313 | A | 5/1999 | Kubota et al. | |
| 5,945,866 | A | 8/1999 | Fonash et al. | |
| 5,945,972 | A * | 8/1999 | Okumura et al. | 345/98 |
| 5,977,940 | A | 11/1999 | Akiyama et al. | |
| 5,990,629 | A | 11/1999 | Yamada et al. | |
| 6,078,364 | A | 6/2000 | Atherton | |
| 6,115,017 | A | 9/2000 | Mikami et al. | |
| 6,115,019 | A | 9/2000 | Perner | |
| 6,165,824 | A | 12/2000 | Takano et al. | |
| 6,246,386 | B1 | 6/2001 | Perner | |
| 6,256,024 | B1 | 7/2001 | Maekawa | |
| 6,259,846 | B1 | 7/2001 | Roach et al. | |
| 6,274,887 | B1 | 8/2001 | Yamazaki et al. | |
| 6,333,737 | B1 | 12/2001 | Nakajima | |
| 6,335,728 | B1 | 1/2002 | Kida et al. | |
| 6,335,778 | B1 | 1/2002 | Kubota et al. | |
| 6,344,672 | B2 | 2/2002 | Huffman | |
| 6,344,843 | B1 | 2/2002 | Koyama et al. | |
| 6,356,028 | B1 | 3/2002 | Legagneux et al. | |
| 6,366,026 | B1 | 4/2002 | Saito et al. | |
| 6,380,876 | B1 * | 4/2002 | Nagao | 341/154 |
| 6,384,818 | B1 | 5/2002 | Yamazaki et al. | |
| 6,392,618 | B1 | 5/2002 | Kimura | |
| 6,433,767 | B1 | 8/2002 | Murade | |
| 6,433,841 | B1 | 8/2002 | Murade et al. | |
| 6,441,829 | B1 | 8/2002 | Blalock et al. | |
| 6,445,368 | B1 * | 9/2002 | Nakajima | 345/76 |
| 6,456,267 | B1 | 9/2002 | Sato et al. | |
| 6,496,130 | B2 * | 12/2002 | Nagao | 341/144 |
| 6,535,192 | B1 * | 3/2003 | Sung et al. | 345/94 |
| 6,542,139 | B1 * | 4/2003 | Kanno | 345/87 |
| 6,545,654 | B2 | 4/2003 | Jacobsen et al. | |
| 6,545,708 | B1 | 4/2003 | Tamayama et al. | |
| 6,549,196 | B1 | 4/2003 | Taguchi et al. | |
| 6,556,176 | B1 | 4/2003 | Okuyama et al. | |
| 6,563,480 | B1 * | 5/2003 | Nakamura | 345/82 |
| 6,564,237 | B2 | 5/2003 | Ohashi et al. | |
| 6,579,736 | B2 | 6/2003 | Yamazaki | |
| 6,580,454 | B1 | 6/2003 | Perner et al. | |
| 6,583,775 | B1 | 6/2003 | Sekiya et al. | |
| 6,611,301 | B2 | 8/2003 | Murade et al. | |
| 6,621,477 | B1 | 9/2003 | Inoue et al. | |
| 6,630,916 | B1 | 10/2003 | Shinoda | |
| 6,636,191 | B2 | 10/2003 | Cok | |
| 6,636,194 | B2 | 10/2003 | Ishii | |
| 6,664,943 | B1 * | 12/2003 | Nakajima et al. | 345/98 |
| 6,670,938 | B1 | 12/2003 | Yoshida | |
| 6,683,596 | B2 | 1/2004 | Ozawa | |
| 6,693,616 | B2 | 2/2004 | Koyama et al. | |
| 6,703,997 | B2 | 3/2004 | Murade | |
| 6,730,966 | B2 | 5/2004 | Koyama | |
| 6,731,264 | B2 | 5/2004 | Koyama et al. | |
| 6,731,272 | B2 | 5/2004 | Huang | |
| 6,738,054 | B1 | 5/2004 | Yamaguchi | |
| 6,747,623 | B2 * | 6/2004 | Koyama | 345/87 |
| 6,750,836 | B1 | 6/2004 | Katayama et al. | |
| 6,753,834 | B2 | 6/2004 | Mikami et al. | |
| 6,765,562 | B2 | 7/2004 | Yamazaki et al. | |
| 6,774,876 | B2 * | 8/2004 | Inukai | 345/76 |
| 6,775,246 | B1 | 8/2004 | Kuribayashi et al. | |
| 6,819,317 | B1 | 11/2004 | Komura et al. | |
| 6,897,932 | B2 | 5/2005 | Murade et al. | |
| 6,940,482 | B2 | 9/2005 | Ishii et al. | |
| 6,958,741 | B2 * | 10/2005 | Tsutsui | 345/90 |
| 6,987,496 | B2 * | 1/2006 | Koyama et al. | 345/76 |
| 6,992,652 | B2 * | 1/2006 | Koyama | 345/98 |
| 2001/0005193 | A1 * | 6/2001 | Yokoyama | 345/92 |
| 2002/0000969 | A1 | 1/2002 | Ozawa | |
| 2002/0003521 | A1 | 1/2002 | Matsueda et al. | |
| 2002/0018131 | A1 | 2/2002 | Kochi | |
| 2002/0021274 | A1 | 2/2002 | Koyama et al. | |
| 2002/0036611 | A1 | 3/2002 | Ishii | |
| 2002/0039087 | A1 | 4/2002 | Inukai | |
| 2002/0041266 | A1 | 4/2002 | Koyama et al. | |
| 2002/0057244 | A1 | 5/2002 | Koyama et al. | |
| 2002/0067327 | A1 | 6/2002 | Ozawa et al. | |
| 2002/0089483 | A1 | 7/2002 | Yamazaki et al. | |
| 2002/0113763 | A1 | 8/2002 | Koyama | |
| 2002/0130828 | A1 * | 9/2002 | Yamazaki et al. | 345/80 |
| 2003/0067632 | A1 | 4/2003 | Ohta et al. | |
| 2003/0071772 | A1 * | 4/2003 | Kimura | 345/76 |
| 2003/0098875 | A1 | 5/2003 | Kurokawa et al. | |
| 2003/0103025 | A1 | 6/2003 | Kurokawa et al. | |
| 2003/0234755 | A1 * | 12/2003 | Koyama | 345/82 |
| 2004/0085269 | A1 | 5/2004 | Mikami et al. | |
| 2004/0164322 | A1 | 8/2004 | Kondo et al. | |
| 2004/0183766 | A1 | 9/2004 | Koyama et al. | |
| 2004/0222955 | A1 | 11/2004 | Koyama | |
| 2005/0078073 | A1 | 4/2005 | Mikami et al. | |
| 2006/0066765 | A1 | 3/2006 | Koyama | |
| 2006/0098003 | A1 | 5/2006 | Koyama et al. | |

FOREIGN PATENT DOCUMENTS

| | | |
|---|---|---|
| EP | 566 408 | 10/1993 |
| EP | 0 717 445 | 6/1996 |
| EP | 797 182 | 9/1997 |
| EP | 0 999 595 | 5/2000 |
| EP | 1 098 290 | 5/2001 |
| EP | 139 327 | 10/2001 |
| EP | 1 182 638 | 2/2002 |
| JP | 04-350627 | 12/1992 |
| JP | 06-011734 | 1/1994 |
| JP | 06-102530 | 4/1994 |
| JP | 08-101609 | 4/1996 |
| JP | 08-101669 | 4/1996 |
| JP | 08-194205 | 7/1996 |
| JP | 08-241048 | 9/1996 |
| JP | 08-286170 | 11/1996 |
| JP | 09-212140 | 8/1997 |
| JP | 09-243996 | 9/1997 |
| JP | 09-258168 | 10/1997 |
| JP | 10-068931 | 3/1998 |
| JP | 10-503032 | 3/1998 |
| JP | 10-092576 | 4/1998 |
| JP | 10-214060 | 8/1998 |
| JP | 10-228012 | 8/1998 |
| JP | 10-232649 | 9/1998 |
| JP | 10-247735 | 9/1998 |
| JP | 410253941 A1 * | 9/1998 |

| | | |
|---|---|---|
| JP | 10-312173 | 11/1998 |
| JP | 11-064814 | 3/1999 |
| JP | 11-085111 | 3/1999 |
| JP | 11-218781 | 8/1999 |
| JP | 2001-281635 | 10/2001 |
| WO | WO96-002866 | 2/1996 |

OTHER PUBLICATIONS

Shimoda et al., "High Resolution Light Emitting Polymer Display Driven By Low Temperature Polysilicon Thin Film Transistor With Integrated Driver," ASIA DISPLAY '98, Jan. 1, 1998, pp. 217-220.

Schenk et al., "Polymers for Light Emitting Diodes," EURODISPLAY '99, Sep. 6-9, 1999, pp. 33-37.

Han et al., "Green OLED with Low Temperature Poly Si TFT," EURODISPLAY '99, Late-News Papers, Sep. 1, 1999, pp. 27-30.

Shimoda et al., "Current Status and Future of Light-Emitting Polymer Display Driven by Poly-Si TFT," SID '99 DIGEST, Jan. 1, 1999, pp. 372-375.

U.S. Patent Application Office Action (U.S. Appl. No. 09/969,591) mailed Jun. 30, 2005.

U.S. Patent Application Office Action (U.S. Appl. No. 09/916,306) mailed Jan. 25, 2005.

U.S. Patent Application Office Action (U.S. Appl. No. 09/930,956) mailed May 2, 2005.

China Patent Application Office Action (Application No. 01126012.2) mailed Mar. 18, 2005.

Koyama et al.; "A 4.0-in. Poly Si TFT-LCD with Integrated 6-bit Digital Data Driver Using CGS Technology"; *Digest of Technical Papers—AM-LCD 99*; pp. 29-32; Jul. 14-16, 1999.

M.A. Baldo et al.; "Highly efficient phosphorescent emission from organic electroluminescent devices"; *Nature*, vol. 395; Sep. 10, 1998, pp. 151-154.

M.A. Baldo et al.; "Very high-efficiency green organic light-emitting devices based on electrophosphorescence"; *Applied Physics Letters*, vol. 75, No. 1; Jul. 5, 1999, pp. 4-6.

Tetsuo Tsutsui et al.; "Electroluminescence in Organic Thin Films"; *Photochemical Processes in Organized Molecular Systems*; Sep. 22, 1990, pp. 437-450.

Tetsuo Tsutsui et al.; "High Quantum Efficiency in Organic Light-Emitting Devices with Iridium-Complex as a Triplet Emissive Center"; *Japan Journal of Applied Science*; Dec. 15, 1999, vol. 38, Part 2, No. 12B, pp. L1502-L1504.

* cited by examiner

LIQUID CRYSTAL DISPLAY DEVICE, METHOD OF DRIVING THE SAME, AND METHOD OF DRIVING A PORTABLE INFORMATION DEVICE HAVING THE LIQUID CRYSTAL DISPLAY DEVICE

BACKGROUND OF THE INVENTION

1. Field of the Invention

The present invention relates to a semiconductor display device (hereinafter referred to as display device), specifically, an active matrix display device having a thin film transistor that is formed on an insulator. More specifically, the invention relates to an active matrix liquid crystal display device that uses a digital signal as a video signal. The invention also relates to a portable information device employing this display device. Specific examples of the portable information device include a cellular phone, a PDA (Personal Digital Assistants), a portable personal computer, a portable navigation system, and an electronic book each comprised of the active matrix liquid crystal display device.

2. Description of the Related Art

Display devices having a semiconductor thin film formed on an insulator, a glass substrate, in particular, have gained a distinct popularity in recent years, and active matrix display devices employing a thin film transistors (hereinafter referred to as TFT) are especially popular among those display devices. Any of the active matrix display devices employing a TFT has from several ten thousands of TFTs to several millions of TFTs arranged into matrix and controls electric charges of pixels to display an image.

A technique that is being developed lately relates to a polysilicon TFT for simultaneously forming a pixel TFT and a driving circuit TFT. The pixel TFT is a TFT constituting a pixel, and the driving circuit TFT is a TFT constituting a driving circuit that is provided in the periphery of a pixel portion. The technique is a great contribution to reduction in size and reduction in power consumption of the liquid crystal display devices. Owing to the development of this technique, the liquid crystal display devices are becoming indispensable devices for, e.g., display units of mobile machines, which lately find their application in increasingly larger fields.

FIG. 13 shows a schematic diagram of an ordinary liquid crystal display device driven by a digital method. A pixel portion 1308 is placed in the center. Above the pixel portion, a source signal line driving circuit 1301 is arranged to control source signal lines. The source signal line driving circuit 1301 has shift register circuits 1303, first latch circuits 1304, second latch circuits 1305, D/A converter circuits (D/A converters (also called DAC)) 1306, analog switches 1307, etc. Gate signal line driving circuits 1302 for controlling gate signal lines are arranged to the left and right of the pixel portion. Although the gate signal line driving circuits 1302 are provided on both sides of the pixel portion in FIG. 13, only one gate signal line driving circuit may be provided to the left or right of the pixel portion. However, it is desirable to place the gate signal line driving circuit on each side of the pixel portion from the viewpoint of driving efficiency and driving reliability.

The source signal line driving circuit 1301 has a structure as the one shown in FIG. 14. The driving circuit shown in FIG. 14 as an example is a source signal line driving circuit with a horizontal resolution of 1024 pixels for 3 bit digital gray scale signals. The driving circuit includes shift register circuits (SR) 1401, first latch circuits (LAT1) 1402, second latch circuits (LAT2) 1403, D/A converter circuits (D/A) 1404, etc. Though not shown in FIG. 14, the driving circuit may have a buffer circuit, a level shifter circuit and the like if necessary.

Referring to FIGS. 13 and 14, the operation of the device will be explained briefly. First, clock signals (S-CLK, S-CLKb) and start pulses (S-SP) are inputted to the shift register circuits 1303 (denoted by SR in FIG. 14) and pulses are outputted sequentially. The pulses are then inputted to the first latch circuits 1304 (denoted by LAT1 in FIG. 14) so that digital signals (digital data) also inputted to the first latch circuits 1304 are held therein respectively. Here, D1 is the most significant bit (MSB) whereas D3 is the least significant bit (LSB). When the first latch circuits 1304 complete holding digital signals corresponding to one horizontal period, the digital signals held in the first latch circuits 1304 are transferred to the second latch circuits 1305 (denoted by LAT2 in FIG. 14) all at once in response to input of latch signals (latch pulses) during the retrace period.

Thereafter, the shift register circuits 1303 again operates to start holding digital signals corresponding to the next one horizontal period. At the same time, the digital signals held in the second latch circuits 1305 are converted into analog signals by the D/A converters 1306 (denoted by D/A in FIG. 14). The analog signals are written in pixels through source signal lines. An image is displayed by repeating this operation.

Now, a portable information device employing the above conventional liquid crystal display device will be described.

The description of the portable information device is given taking as an example a portable information terminal. FIG. 34 shows a block diagram of a conventional portable information terminal. The portable information terminal is intended to provide a user with desired information in accordance with the user's needs. The information to be provided includes data stored in memory devices (such as a DRAM 1509 and a flash memory 1510) in the portable information terminal, data stored in a memory card 1503 that is to be inserted to the portable information terminal, data obtained by connecting the portable information terminal to external equipment through an external interface port 1505, and like other data. The information is processed by a CPU 1506 upon receiving command inputted by the user via a pen touch tablet 1501 so that a liquid crystal display device 1513 displays the information.

Specifically, signals inputted through the pen touch tablet 1501 are detected by a detector circuit 1502 and then inputted to a tablet interface 1518. The inputted signals are processed by the tablet interface 1518 and the processed signals are inputted to a video signal input circuit 1507 and other circuits. The CPU 1506 processes necessary data, and the processed data is converted into image data based on an image format that is stored in a VRAM 1511. The image data is sent to an LCD controller 1512, which generates signals for driving the liquid crystal display device 1513. The display device is thus driven to display the information.

A cellular phone is taken as another example to describe the portable information device. FIG. 35 shows a block diagram of a conventional cellular phone. The cellular phone is composed of a transmission/reception circuit 1615 for transmitting and receiving radio wave, an audio processing circuit 1602 for processing signals received, a speaker 1614, a microphone 1608, a keyboard 1601 for inputting data, a keyboard interface 1618 for processing signals inputted through the keyboard 1601, etc.

Upon receiving command inputted by a user through the keyboard, a CPU 1606 processes information so that a liquid crystal display device 1613 displays the information. The information may be data stored in memory devices (such as a DRAM 1609 and a flash memory 1610), data stored in a memory card 1603 that is to be inserted to the cellular phone, data obtained by connecting the cellular phone to external equipment through an external interface port 1605, and like other data.

Specifically, signals inputted through the keyboard 1601 are processed by a keyboard interface 1618 and the processed signals are inputted to video signal processing circuit 1607 and other circuits. The CPU 1606 processes necessary data and the processed data is converted into image data on the basis of an image format stored in a VRAM (Video RAM) 1611. The image data is sent to an LCD controller 1612, which generates signals for driving the liquid crystal display device 1613. The display device is thus driven to display the information.

An example of the structure of the transmission/reception circuit 1615 is shown in FIG. 26.

The transmission/reception circuit 1615 includes an antenna 2662, filters 2663, 2667, 2668, 2672, and 2676, a switch 2664, amplifiers 2665, 2666, and 2677, a first frequency converter circuit 2669, a second frequency converter circuit 2673, a frequency converter circuit 2671, oscillation circuits 2670 and 2674, an AC/DC converter 2675, a data demodulation circuit 2678, and a data modulation circuit 2679.

In a general active matrix liquid crystal display device, screen display is updated about sixty times for every second in order to display animation smoothly. In other words, it is necessary to supply digital signals for every new frame and the signals have to be written in pixels each time. Even when the image to be displayed is a still image, the same signals have to be kept supplied for every new frame and an external circuit, a driving circuit and the like have to process the same digital signals repeatedly and continuously.

An alternative method is to write digital signals of the still image in an external memory circuit once and then supply the digital signals from the external memory circuit to the liquid crystal display device each time a new frame is started. However, the alternative method is not different from the above method in that the external memory circuit and the driving circuit of the display device are required continuing to operate.

In the conventional portable information device also, data of the same image have to be sent to the display device incorporated in the portable information device sixty times for every second in order to display any image on the display device, even if it is a still image. To explain this referring to the drawings, the circuits surrounded by the dotted lines in FIG. 34 must continue to operate as long as the image is being displayed (the circuits are: the video signal processing circuit 1507 in the CPU 1506; the VRAM 1511; the LCD controller 1512; the source signal line driving circuit and the gate signal line driving circuit of the liquid crystal display device 1513; the pen touch tablet 1501; the detector circuit 1502; and the tablet interface 1518). In the case of FIG. 35, the circuits surrounded by the dotted lines in FIG. 35 must continue to operate as long as the image is being displayed (the circuits are: the video signal processing circuit 1607 in the CPU 1606; the VRAM 1611; the LCD controller 1612; the source signal line driving circuit and the gate signal line driving circuit of the liquid crystal display device 1613; the keyboard 1601; and the keyboard interface 1618).

Passive matrix display devices have only a small number pixels, and some of them can stop operation of their VRAM during a still image is displayed by incorporating memory circuits in their driving ICs or controllers. However, incorporating a memory circuit in a driving or a controller is unpractical for a display device that uses a large number of pixels, such as an active matrix liquid crystal display device, from the viewpoint of chip size. Many circuits thus have to continue operating in a portable information device of prior art even when a still image is displayed, thereby forming an obstacle to reduction in power consumption.

Reduction in power consumption is greatly demanded in mobile machines. Despite the fact that mobile machines are used mostly in a still image mode, driving circuits of the mobile machines continue to operate during still image display as described above. Therefore, reducing power consumption is hindered.

SUMMARY OF THE INVENTION

The present invention has been made in view of the above problems, and an object of the present invention is therefore to reduce power consumption in a driving circuit and other circuits while a still image is displayed.

In order to attain the object above, the present invention uses the following measures.

A plurality of memory circuits are provided in each pixel so that digital signals are stored for each pixel. In the case of displaying a still image, information to be written into a pixel is the same once signals are written. Therefore, the still image can be continuously displayed by reading out the signals stored in the memory circuits instead of inputting the signals each time a new frame is started. This means that, if a still image is to be displayed, a source signal line driving circuit, a video signal processing circuit and other circuits can stop their operation once they finish processing signals corresponding to at least one frame. This makes it possible to reduce power consumption greatly.

The structures of a liquid crystal display device and a portable information device having the liquid crystal display device of the present invention will be described hereinbelow.

According to the present invention, there is provided a liquid crystal display device having pixels, characterized in that the pixels each have a plurality of memory circuits and a D/A converter.

According to the present invention, there is provided a liquid crystal display device having pixels, characterized in that the pixels each have n (n is a natural number equal to or greater than 2) memory circuits and a D/A converter for converting digital signals stored in the n memory circuits into analog signals.

According to the present invention, there is provided a liquid crystal display device having pixels, the pixels each having a liquid crystal element to which analog signals are inputted, characterized in that the pixels each have n (n is a natural number equal to or greater than 2) memory circuits and a D/A converter for converting digital signals stored in the n memory circuits into the analog signals.

According to the present invention, there is provided a liquid crystal display device having pixels, characterized in that the pixels each have n×m (n and m are both natural numbers equal to or greater than 2) memory circuits and a D/A converter for converting n bit digital signals stored in the n×m memory circuits into analog signals.

According to the present invention, there is provided a liquid crystal display device having pixels, characterized in that in a method of driving the liquid crystal device having pixels, the pixels each have n×m (n and m are both natural numbers equal to or greater than 2) memory circuits and a D/A converter for converting n bit digital signals stored in the n×m memory circuits into analog signals, and each of the pixels stores digital signals corresponding to m frames.

According to the present invention, a liquid crystal display device may have a feature such that a source signal line is provided, and the memory circuits and the D/A converter are arranged so as to overlap the source signal line.

According to the present invention, a liquid crystal display device may have a feature such that a gate signal line is provided, and the memory circuits and the D/A converter are arranged so as to overlap the gate signal line.

According to the present invention, there is provided a liquid crystal display device having pixels, the pixels each having a liquid crystal element, characterized in that: the pixels each have a source signal line, n (n is a natural number equal to or greater than 2) gate signal lines, n TFTs, n memory circuits, and a D/A converter; the n TFTs have gate electrodes each connected to one of the n gate signal lines, and each of the n TFTs has a source region and a drain region one of which is connected to the source signal line and the other of which is connected to an input terminal of one of the n memory circuits; an output terminal of each of the n memory circuits is connected to an input terminal of the D/A converter; and an output terminal of the D/A converter is connected to the liquid crystal element.

According to the present invention, there is provided a liquid crystal display device having pixels, the pixels each having a liquid crystal element, characterized in that: the pixels each have n (n is a natural number equal to or greater than 2) source signal lines, a gate signal line, n TFTs, n memory circuits, and a D/A converter; the n TFTs have gate electrodes connected to the gate signal line, and each of the n TFTs has a source region and a drain region one of which is connected to one of the n source signal lines and the other of which is connected to an input terminal of one of the n memory circuits; an output terminal of each of the n memory circuits is connected to an input terminal of the D/A converter; and an output terminal of the D/A converter is connected to the liquid crystal element.

A liquid crystal display device of the present invention may be a liquid crystal display device, characterized in that a source signal line driving circuit is provided, and the source signal line driving circuit includes shift registers, first latch circuits, second latch circuits, and switches, the first latch circuits holding n bit digital signals upon receiving sampling pulses from the shift registers until the n bit digital signals are transferred to the second latch circuits, the switches selecting the n bit digital signals that have been transferred to the second latch circuits one bit at a time to input the selected signals into the source signal line.

A liquid crystal display device of the present invention may be a liquid crystal display device, characterized in that a source signal line driving circuit is provided, and the source signal line driving circuit includes shift registers, first latch circuits, and second latch circuits, the first latch circuits holding 1 bit digital signals upon receiving sampling pulses from the shift registers until the 1 bit digital signals are transferred to the second latch circuits.

A liquid crystal display device of the present invention may be a liquid crystal display device, characterized in that a source signal line driving circuit is provided, and the source signal line driving circuit includes shift registers and first latch circuits, the first latch circuits holding n bit digital signals upon receiving sampling pulses from the shift registers.

A liquid crystal display device of the present invention may be a liquid crystal display device, characterized in that a source signal line driving circuit is provided, and the source signal line driving circuit includes shift registers, first latch circuits, and n switches, the first latch circuits holding n bit digital signals upon receiving sampling pulses from the shift registers, the n switches inputting the n bit digital signals stored in the first latch circuits to the n source signal lines.

According to the present invention, a liquid crystal display device may have a feature such that the memory circuits are static random access memories (SRAM), ferroelectric random access memories (FeRAM), or dynamic random access memories (DRAM).

According to the present invention, a liquid crystal display device may have a feature such that the memory circuits are formed on a glass substrate, a plastic substrate, a stainless steel substrate, or a single crystal wafer.

A liquid crystal display device of the present invention may be a television set, a personal computer, a portable terminal, a video camera, or a head mounted display, characterized by comprising the liquid crystal display device.

According to the present invention, there is provided a method of driving a liquid crystal display device having a plurality of pixels that are arranged into matrix, characterized in that the plural pixels each have a plurality of memory circuits and a D/A converter, and data are rewritten in the plural memory circuits of pixels in a specific row or pixels in a specific column out of all the plural pixels.

According to the present invention, there is provided a method of driving a liquid crystal display device having a plurality of pixels and a source signal line driving circuit for inputting video signals to the plural pixels, characterized in that the plural pixels each have a plurality of memory circuits and a D/A converter, and the operation of the source signal line driving circuit is stopped when a still image is displayed.

According to the present invention, a method of driving a liquid crystal display device may have a feature such that the memory circuits are static random access memories (SRAM), ferroelectric random access memories (FeRAM), or dynamic random access memories (DRAM).

According to the present invention, a method of driving a liquid crystal display device may have a feature such that the memory circuits are formed on a glass substrate, a plastic substrate, a stainless steel substrate, or a single crystal wafer.

A crystal display device of the present invention may be a television set, a personal computer, a portable terminal, a video camera, or a head mounted display characterized in that the liquid crystal display device is driven by the driving method described above.

According to the present invention, there is provided a method of driving a portable information device having a liquid crystal display device and a CPU, characterized in that: the liquid crystal display device includes pixels each having a plurality of memory circuits, a D/A converter, and a driving circuit for outputting signals to the plural memory circuits; the CPU includes a first circuit for controlling the driving circuit and a second circuit for controlling signals inputted to the portable information device; and the operation of the first circuit is stopped when the liquid crystal display device displays a still image.

According to the present invention, there is provided a method of driving a portable information device having a liquid crystal display device and a VRAM, characterized in that the liquid crystal display device includes pixels each having a plurality of memory circuits and a D/A converter, and the operation of reading data from the VRAM is stopped when the liquid crystal display device displays a still image.

According to the present invention, there is provided a method of driving a portable information device having a liquid crystal display device, characterized in that the liquid crystal display device includes pixels each having a plurality of memory circuits and a D/A converter, and the operation of a source signal line driving circuit of the liquid crystal display device is stopped when the liquid crystal display device displays a still image.

According to the present invention, a method of driving a portable information device may have a feature such that data in the plural memory circuits are read out once in one frame period.

According to the present invention, there is provided a method of driving a portable information device having a liquid crystal display device, characterized in that: the liquid crystal display device has a plurality of pixels arranged into matrix; the plural pixels each have a plurality of memory circuits and a D/A converter; and the liquid crystal display device rewrites data in the plural memory circuits of pixels in a specific row or pixels in a specific column out of all the plural pixels.

According to the present invention, a method of driving a portable information device may have a feature such that the portable information device is a cellular phone, a personal computer, a navigation system, a PDA, or an electronic book.

BRIEF DESCRIPTION OF THE DRAWINGS

In the accompanying drawings:

FIG. 27A is a top view thereof and FIGS. 27B and 27C are sectional views thereof;

DETAILED DESCRIPTION OF THE PREFERRED EMBODIMENTS

EMBODIMENT MODE

Figure 2:
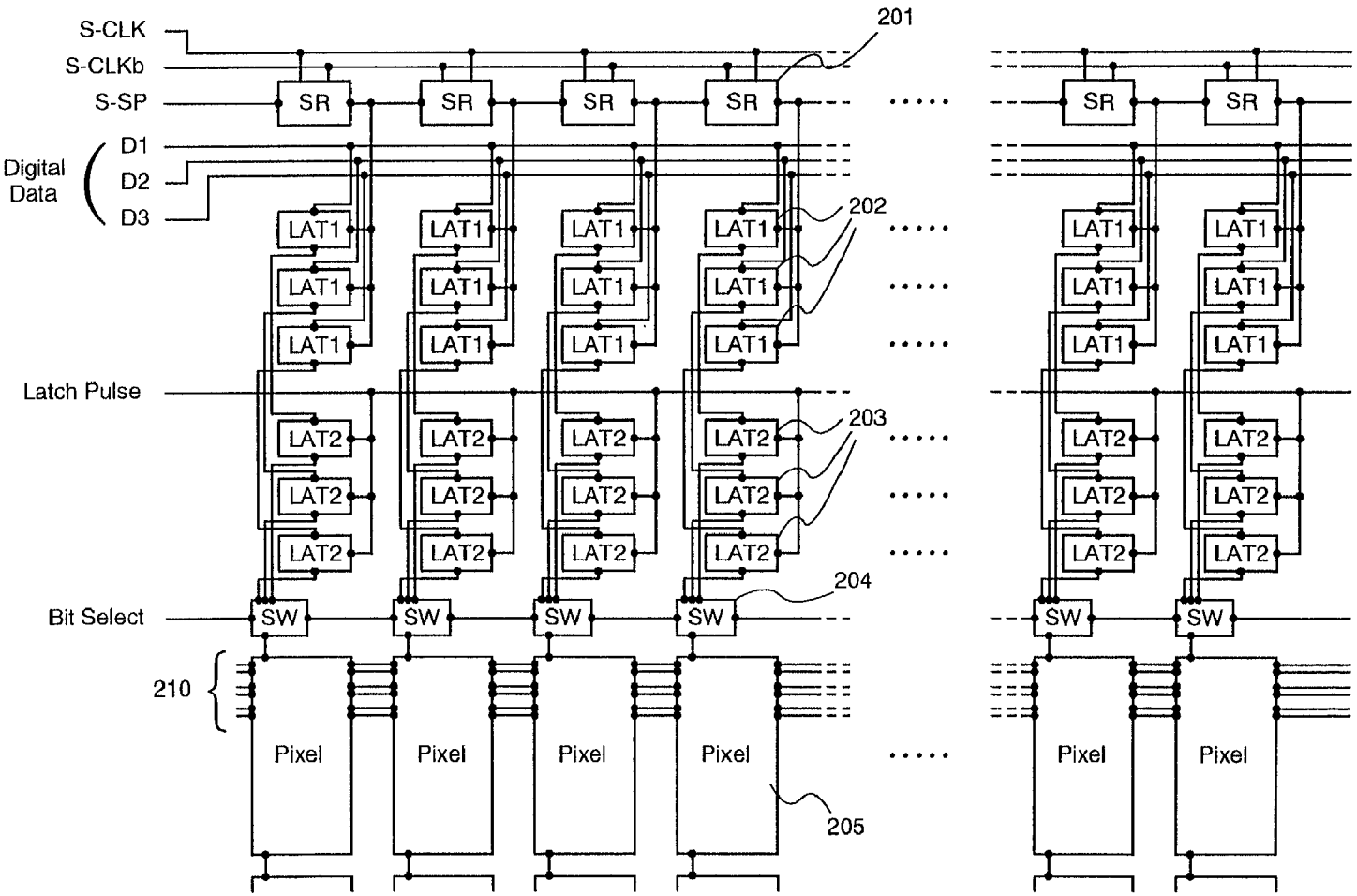
FIG. 2 is a diagram showing the circuit structure of a source signal line driving circuit for displaying an image using a pixel of the present invention.

FIG. 2 shows the structure of a source signal line driving circuit and the structure of some of pixels in a display device that employs pixels having memory circuits. The circuit is capable of handling 3 bit digital gray scale signals, and is composed of shift register circuits (SR) 201, first latch circuits (LAT1) 202, second latch circuits (LAT2) 203, bit signal selecting switches (SW) 204, and pixels 205. Denoted by 210 are signals supplied from a gate signal line driving circuit, or directly from the external, and descriptions of the signals will be found later along with explanations of the pixels.

Figure 1:
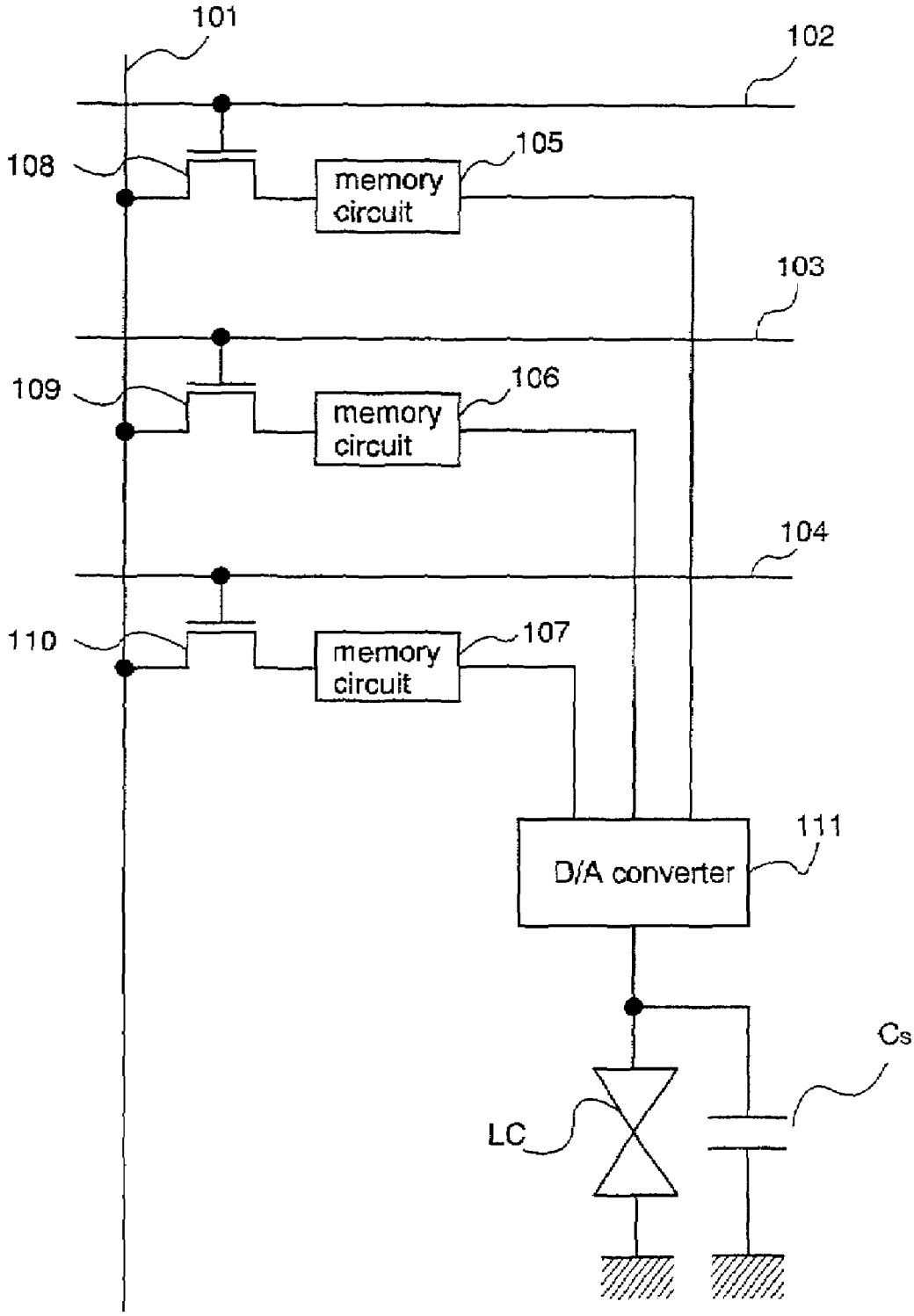
FIG. 1 is a circuit diagram of a pixel of the present invention which has a plurality of memory circuits therein.

FIG. 1 shows detailed circuit structure of one of the pixels 205 in FIG. 2. The pixel is for 3 bit digital gray scale signals, and is composed of a liquid crystal element (LC), a storage capacitor (Cs), memory circuits (105 to 107), a D/A (D/A converter 111), etc. Denoted by 101 is a source signal line, 102 to 104 represent writing gate signal lines, and 108 to 110 represent writing TFTs.

Specific examples of the D/A converter 111 will be described in Embodiments. However, the D/A converter may be structured differently from the ways described in Embodiments.

Figure 3A:
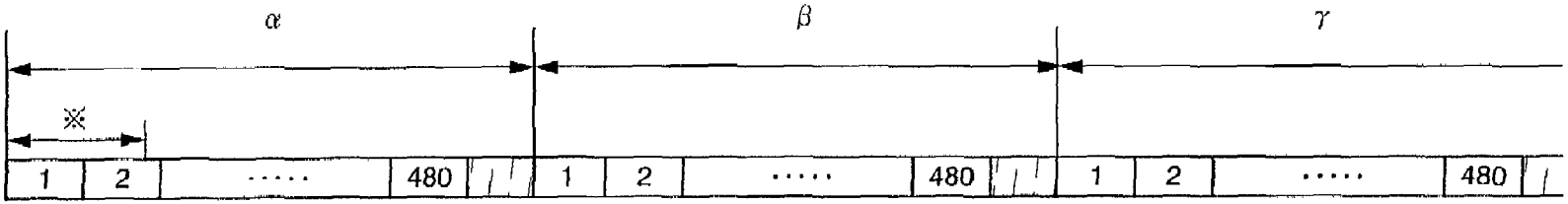
FIGS. 3A and 3B are timing charts for displaying an image using a pixel of the present invention.
Figure 3B:
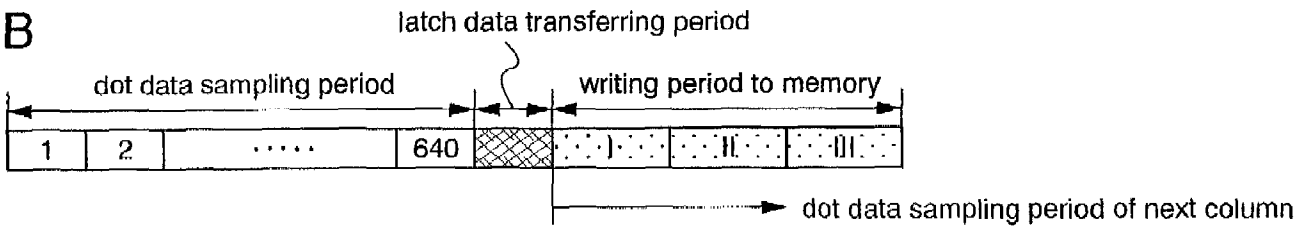

FIGS. 3A and 3B are timing charts of the display device shown in FIG. 1 in accordance with the present invention. The display device is capable of handling 3 bit digital gray scale signals and has a VGA level resolution. A method of driving this display device will be described with reference to FIGS. 1 to 3B. The reference symbols used in this description are the same as those in FIGS. 1 to 3B.

Reference is made to FIG. 2 and FIGS. 3A and 3B. In FIG. 3A, frame periods are respectively denoted by α, β, and γ. The operation of the circuit in the period α is described first.

Similar to the conventional driving circuit of digital driving method, clock signals (S-CLK, S-CLKb) and start pulses (S-SP) are inputted to the shift register circuits 201 and sampling pulses are outputted sequentially. The sampling pulses are then inputted to the first latch circuits 202 (LAT1) so that digital signals (digital data) also inputted to the first latch circuits 202 are held therein respectively. This period is referred to as dot data sampling period in this specification. The dot data sampling period corresponding to one horizontal period stretches from a period 1 to a period 480 in FIG. 3. The digital signals are 3 bit signals, and D1 is the most significant bit (MSB) whereas D3 is the least significant bit (LSB). When the first latch circuits 202 complete holding digital signals corresponding to one horizontal period, the digital signals held in the first latch circuits 202 are transferred to the second latch circuits 203 (LAT2) all at once in response to input of latch signals (latch pulses) during the retrace period.

Subsequently, the first latch circuits operate to hold digital signals corresponding to the next horizontal period in response to sampling pulses again outputted from the shift register circuits 201.

On the other hand, the digital signals transferred to the second latch circuits 203 are written in the memory circuits arranged in each pixel. As shown in FIG. 3B, the dot data sampling period of the next column is divided into three, namely, a period I, a period II, and a period III, to output the digital signals held in the second latch circuits to the source signal line. At this point, the bit signal selecting switches 204 are used to output the signals of the respective bits to the source signal lines in order.

In the period I, pulses are inputted to the writing gate signal line 102 to turn the TFT 108 conductive and digital signals are written in the memory circuit 105. Subsequently, in the period II, pulses are inputted to the writing gate signal line 103 to turn the TFT 109 conductive and digital signals are written in the memory circuit 106. Lastly, in the period III, pulses are inputted to the writing gate signal line 104 to turn the TFT 110 conductive and digital signals are written in the memory circuit 107.

The above steps complete processing of digital signals corresponding to one horizontal period. The periods in FIG. 3B correspond to the period indicated by * in FIG. 3A. The above operation is repeated until the last stage is processed, thereby completing writing digital signals corresponding to one frame in the memory circuits 105 to 107.

The digital signals written are converted into analog signals by the D/A 111 and the analog signals are inputted to the liquid crystal element. The liquid crystal element changes its transmittance in accordance with the inputted analog signals to provide gray scales. Since the signals here are 3 bit signals, the luminance obtained ranges from 0 to 7, namely, 8 levels in total.

The above operations are repeated to continue displaying an image. If the image to be displayed is a still image, digital signals are stored in the memory circuits 105 to 107 in the first operation. Once the digital signals are stored, the digital signals stored in the memory circuits 105 to 107 are repeatedly read out for every new frame period.

Appropriately, a DAC controller is used to control the operation of repeatedly reading out the digital signals stored in the memory circuits for every new frame period and converting the read out signals into analog signals in the D/A 111.

Alternatively, outputs of the memory circuits are inputted to the D/A 111 through reading out TFTs (not shown). Turning the reading out TFTs ON and OFF is controlled to repeatedly read out the digital signals stored in the memory circuits for every new frame period.

In this case, a reading out gate signal line driving circuit (not shown) is used to input signals to reading out gate signal lines (not shown) to which gate electrodes of the reading out TFTs are connected.

Thus the source signal line driving circuit can stop its driving while a still image is displayed.

Moreover, the gate signal lines can be used one by one, as opposed to driving all of them at once, in writing digital signals in the memory circuits or reading digital signals out of the memory circuits. In other words, partial rewriting of a screen is possible by operating the source signal line driving circuit for only a short period of time, thereby increasing display method options.

Figure 23:
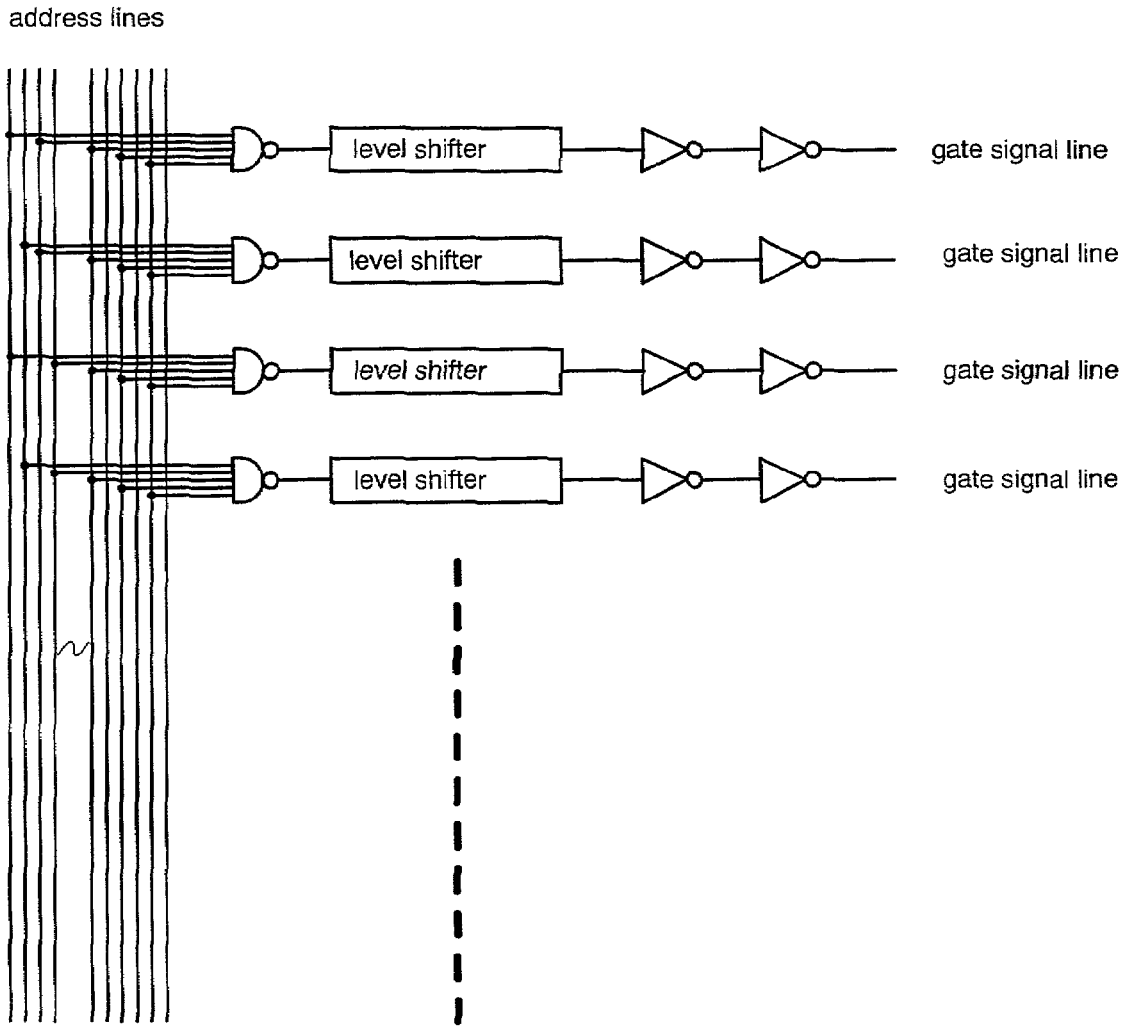
FIG. 23 is a diagram showing a gate signal line driving circuit using a decoder.

In this case, it is desirable to use a decoder as the gate signal line driving circuit. A decoder appropriate to use is a circuit disclosed in Japanese Patent Application Laid-open No. Hei 8-101669. An example of the decoder is shown in FIG. 23. The source signal line driving circuit may also include a decoder to rewrite a part of a screen.

In this embodiment mode, one pixel has three memory circuits in order to store 3 bit digital signals corresponding to one frame. However, the number of memory circuits according to the present invention is not limited to three. For example, when n (n is a natural number equal to or greater than 2) bit digital signals corresponding to m (m is a natural number equal to or greater than 2) frames are to be stored, one pixel has n×m memory circuits.

The memory circuits mounted to the pixels store digital signals in the manner described above, so that the digital signals stored in the memory circuits can be used repeatedly for every new frame period when a still image is displayed. This makes it possible to continuously display a still image without driving an external circuit, the source signal line driving circuit, or other circuits. Accordingly, the invention greatly contributes to reduction of power consumption in liquid crystal display devices.

The source signal line driving circuit may not necessarily be formed on an insulator integrally, considering arrangement of the latch circuits that increase in number in accordance with the bit number. A part of, or the entirety of, the source signal line driving circuit may be external to the insulator.

Although the source signal line driving circuit in this embodiment mode is provided with a number of latch circuits in accordance with the bit number, the source signal line driving circuit can operate also when the latch circuits are provided in a number necessary for only one bit data processing. In this case, digital signals of from significant bit to less significant bit are inputted to the latch circuits in series.

Figure 24:
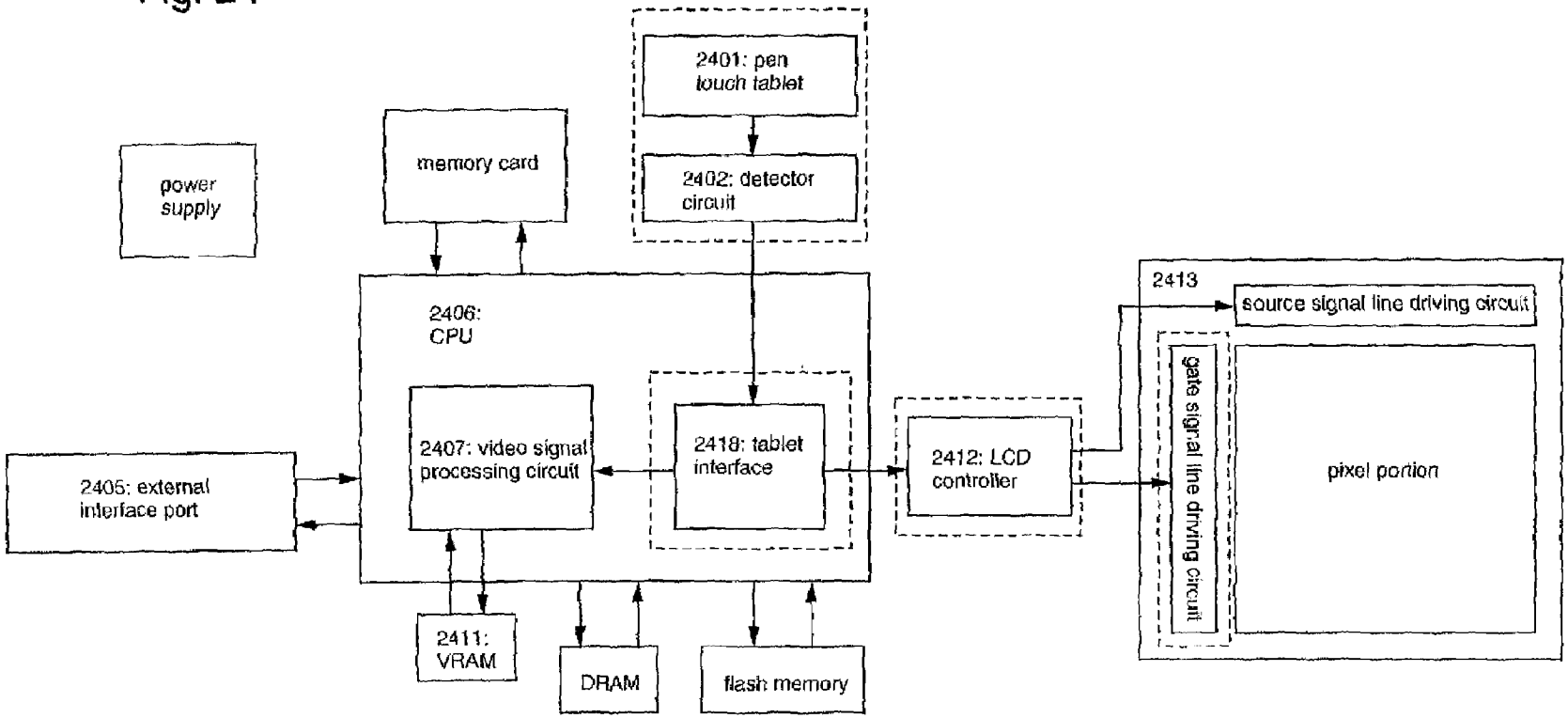
FIG. 24 is a block diagram showing a portable information terminal to which the present invention is applied.

FIG. 24 shows the structure of a portable information device of the present invention which employs the liquid crystal display device structured as above. When a still image is to be displayed, video signals are stored in memory circuits in pixels of a display device 2413, and the stored video signals are retrieved to display the image. Out of internal circuits of a CPU 2406, accordingly, a video signal processing circuit 2407, a VRAM 2411, and a source signal line driving circuit of the display device 2413 can stop their operation during still image display, as opposed to all of the internal circuits of the CPU have to operate in prior art.

Specific explanations of the above paragraph will be given in the following. The CPU 2406 judges that the device is in a still image mode when lack of input through a pen touch tablet 2401 lasts a given period of time, or when a signal that requires changing image display is not inputted from an external interface port 2405 for a given period of time. Making that judgement, the CPU 2406 operates as follows. The CPU stops the source signal line driving circuit of the display device 2413 through an LCD controller 2412. To elaborate, the operation of the source signal line driving circuit is stopped by cutting supply of start pulses, clock signals, and video signals to the source signal line driving circuit. At this point, the gate signal line driving circuit does not stop its operation but receives supply of signals to repeatedly read out data out of the memory circuits.

The gate signal line driving circuit is generally driven at a frequency 1/100 times or less of the frequency used to drive the source signal line driving circuit. Therefore, the gate signal line driving circuit hardly influences power consumption if its operation is not stopped during still image display. The operation of the gate signal line driving circuit may of course be stopped when the liquid crystal material used does not cause a problem regarding image quality, such as the burn-in phenomenon. Thus the display device 2413 displays a still image while stopping operation of the source signal line driving circuit alone, or both the source signal line driving circuit and the gate signal line driving circuit.

The CPU 2406 next stops the operation of the video signal processing circuit 2407 and the VRAM 2411 in the CPU 2406. The display device 2413 displays an image using video data stored in the memory circuits provided in the display device as described above, and hence there is no need to input new video data to the display device. The video signal processing circuit 2407, the VRAM 2411, and other circuits involving generation and processing of video data thus do not need to operate during still image display. In this way, reduction in power consumption can be achieved in the CPU 2406, in the VRAM 2411, and in the source signal line driving circuit.

When signals are inputted through the pen touch tablet 2401 to input video signals, an instruction for changing display contents is sent from a detector circuit 2402 of the pen touch tablet through a tablet interface 2418 to the CPU 2406. Receiving the instruction, the CPU 2406 starts the VRAM 2411 and the video signal processing circuit 2407 which have stopped operating. Then start pulses, clock signals, and video data are supplied to the source signal line driving circuit of the display device 2413 through the LCD controller 2412 to write new video signals in the pixels.

In this way, the portable information terminal can continue to display a still image as long as the circuits surrounded by the dotted lines in FIG. 24 operate (namely, the gate signal line driving circuit, the LCD controller 2412, the pen touch tablet 2401, the detector circuit 2402, and the tablet interface 2418).

Figure 25:
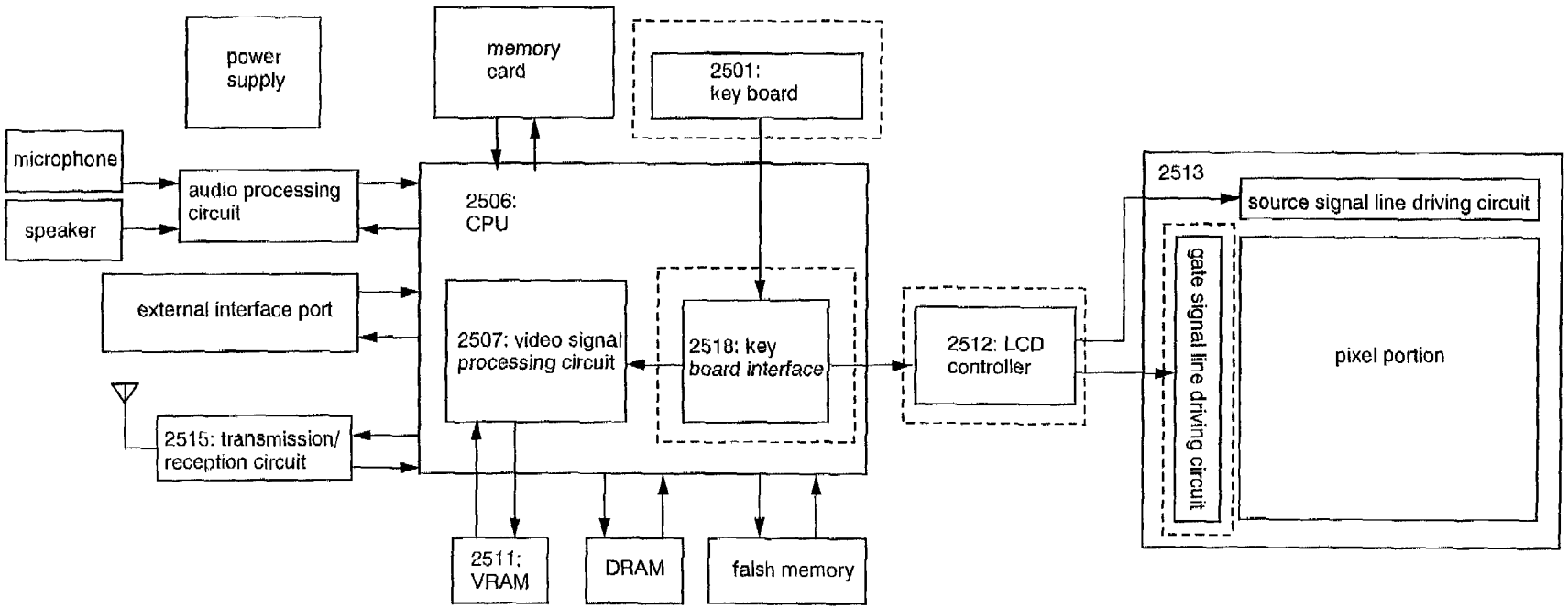
FIG. 25 is a block diagram showing a cellular phone to which the present invention is applied.
Figure 26:
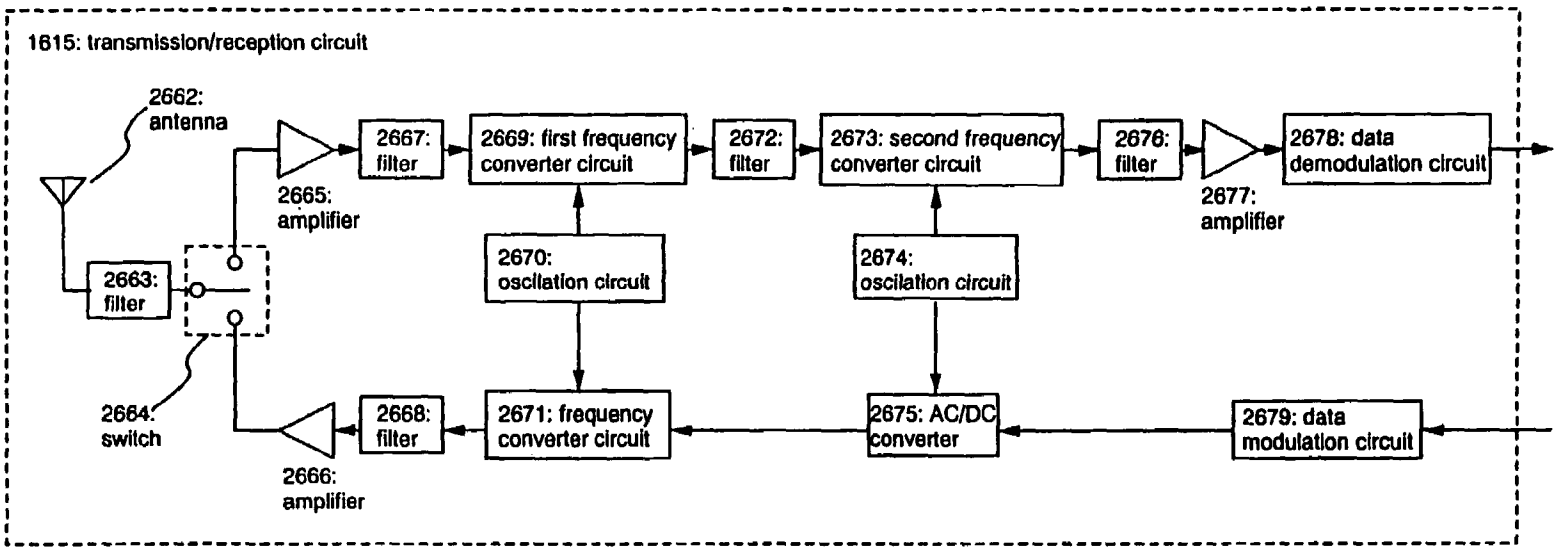
Fig. 26 (PRIOR ART)
FIG. 26 is a block diagram showing a transmission/reception unit of the cellular phone.

FIG. 25 shows an example of a cellular phone to which the present invention is applied. The cellular phone operates generally the same way as the portable information terminal of FIG. 24 operates. A difference between the cellular phone and the portable information terminal is that the cellular phone adopts keyboard 2501 to input data and control is given by a CPU 2506 through a keyboard interface 2518. Another difference is that external data is inputted to an antenna through a communication system of a phone service company and is amplified by a transmission/reception circuit 2515 to be controlled by the CPU 2506. When a still image is displayed, the operation of a video signal processing circuit 2507, a VRAM 2511, and a source signal line driving circuit can be stopped similar to the portable information terminal.

In this way, the cellular phone can continue to display a still image as long as the circuits surrounded by the dotted lines in FIG. 25 operate (namely, a gate signal line driving circuit, an LCD controller 2512, a keyboard 2501, and a keyboard interface 2518).

Embodiments of the present invention will be described below.

EMBODIMENT 1

This embodiment gives descriptions on the pixel in the circuit shown in Embodiment Mode, regarding its specific structure (arrangement of transistors and other components) and its operation.

Figure 8:
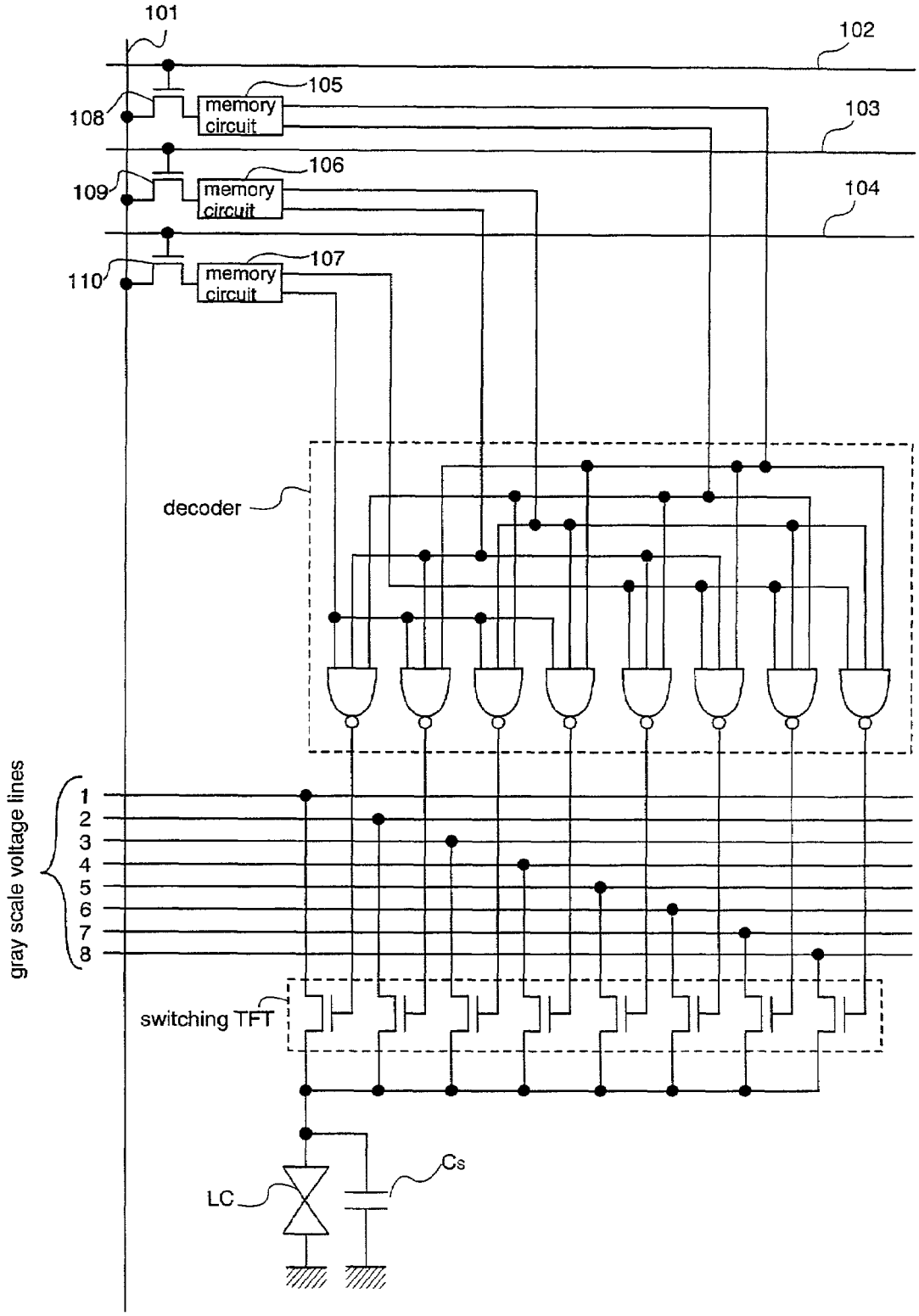
FIG. 8 is a diagram showing the structure of a D/A converter for a liquid crystal display device of the present invention.

FIG. 8 shows a pixel similar to the one shown in FIG. 1, but circuits constituting a D/A 111 are shown here unlike FIG. 1. In FIG. 8, components identical with those in FIG. 1 are denoted by the same reference symbols. Memory circuits 105, 106, and 107 are connected to writing TFTs 108, 109, and 110, respectively, and are controlled by memory circuit selecting signal lines (writing gate signal lines) 102, 103, and 104, respectively.

Figure 4:
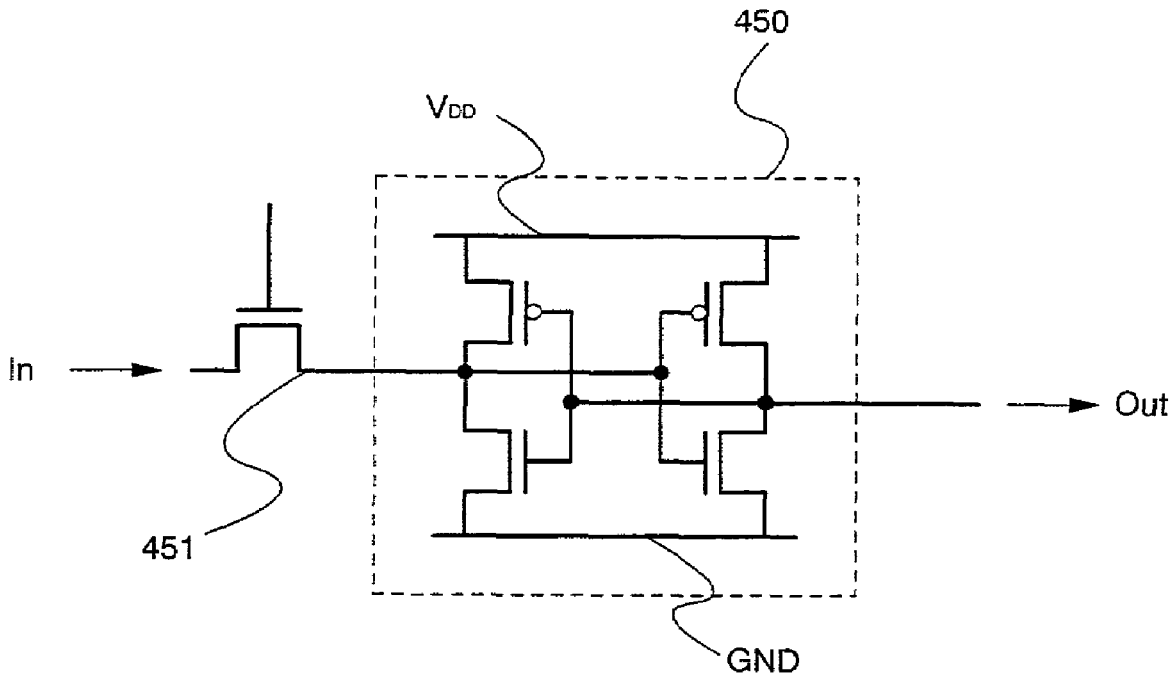
FIG. 4 is a detailed circuit diagram of a memory circuit.

FIG. 4 shows an example of the memory circuits. An area surrounded by a dotted line frame 450 is one memory circuit (corresponding to 105, 106, or 107 in FIG. 8), whereas 451 denotes one writing TFT (corresponding to 108, 109, or 110 in FIG. 8). The memory circuit 450 shown here is a static random access memory (SRAM) utilizing flip-flop. However, the memory circuit is not limited to this structure.

The circuit of this embodiment, shown in FIG. 8, may be driven in accordance with the timing charts described in Embodiment Mode with reference to FIGS. 3A and 3B. The operation of the circuit, plus a method of actually driving a memory circuit selecting unit, will be described referring to FIGS. 3A and 3B and FIG. 8. The description adopts the reference symbols used in FIGS. 3A and 3B and FIG. 8.

Reference is made to FIGS. 3A and 3B. In FIG. 3A, frame periods are respectively denoted by α, β, and γ. The operation of the circuit in the period α is described first.

Shift register circuits, first latch circuits, and second latch circuits operate the same way as those in Embodiment Mode, so see the descriptions of Embodiment Mode.

In the period I, pulses are inputted to the writing gate signal line 102 to turn the TFT 108 conductive and digital signals are written in the memory circuit 105. Subsequently, in the period II, pulses are inputted to the writing gate signal line 103 to turn the TFT 109 conductive and digital signals are written in the memory circuit 106. Lastly, in the period III, pulses are inputted to the writing gate signal line 104 to turn the TFT 110 conductive and digital signals are written in the memory circuit 107.

The above steps complete processing of digital signals corresponding to one horizontal period. The periods in FIG. 3B correspond to the period indicated by * in FIG. 3A. The above operation is repeated until the last stage is processed, thereby completing writing digital signals corresponding to one frame in the memory circuits 105 to 107.

The digital signals written are converted into analog signals by the D/A 111 and the analog signals are inputted to a liquid crystal element. The liquid crystal element change its transmittance in accordance with the inputted analog signals to provide gray scales. Since the signals here are 3 bit signals, the luminance obtained ranges from 0 to 7, namely, 8 levels in total.

Thus data corresponding to one frame period are displayed. Concurrently, the driving circuit is processing digital signals of the next frame period.

The procedure above is repeated to display an image.

When a still image is to be displayed, the operation of the source signal line driving circuit is stopped after finishing writing digital signals of a certain frame in the memory circuits, and the same signals written in the memory circuits are read each time a new frame is started to display the still image.

There is an alternative to this though not shown in FIG. 8. In the alternative method, outputs of the memory circuits in each pixel are inputted to the D/A through the reading out TFTs, and the signals are repeatedly read out of the memory circuits for every new frame period by operating the reading out TFTs. The circuit for operating the reading out TFTs may have any known structure.

A still image can be displayed by another method in which signals inputted to the memory circuits are constantly inputted to the D/A circuit and corresponding analog signals are outputted to the liquid crystal element. In this case, display of the same level of luminance is continued until selection of the writing TFTs is made and information is newly written in the memory circuits. This driving method does not need the reading out TFTs and the like mentioned above.

In this way, current consumption during displaying a still image can be reduced greatly.

EMBODIMENT 2

This embodiment gives a description on a case where signals are written in memory circuits of a pixel portion by dot-sequential system to eliminate the need for a second latch circuit of a source signal line driving circuit.

Figure 5:
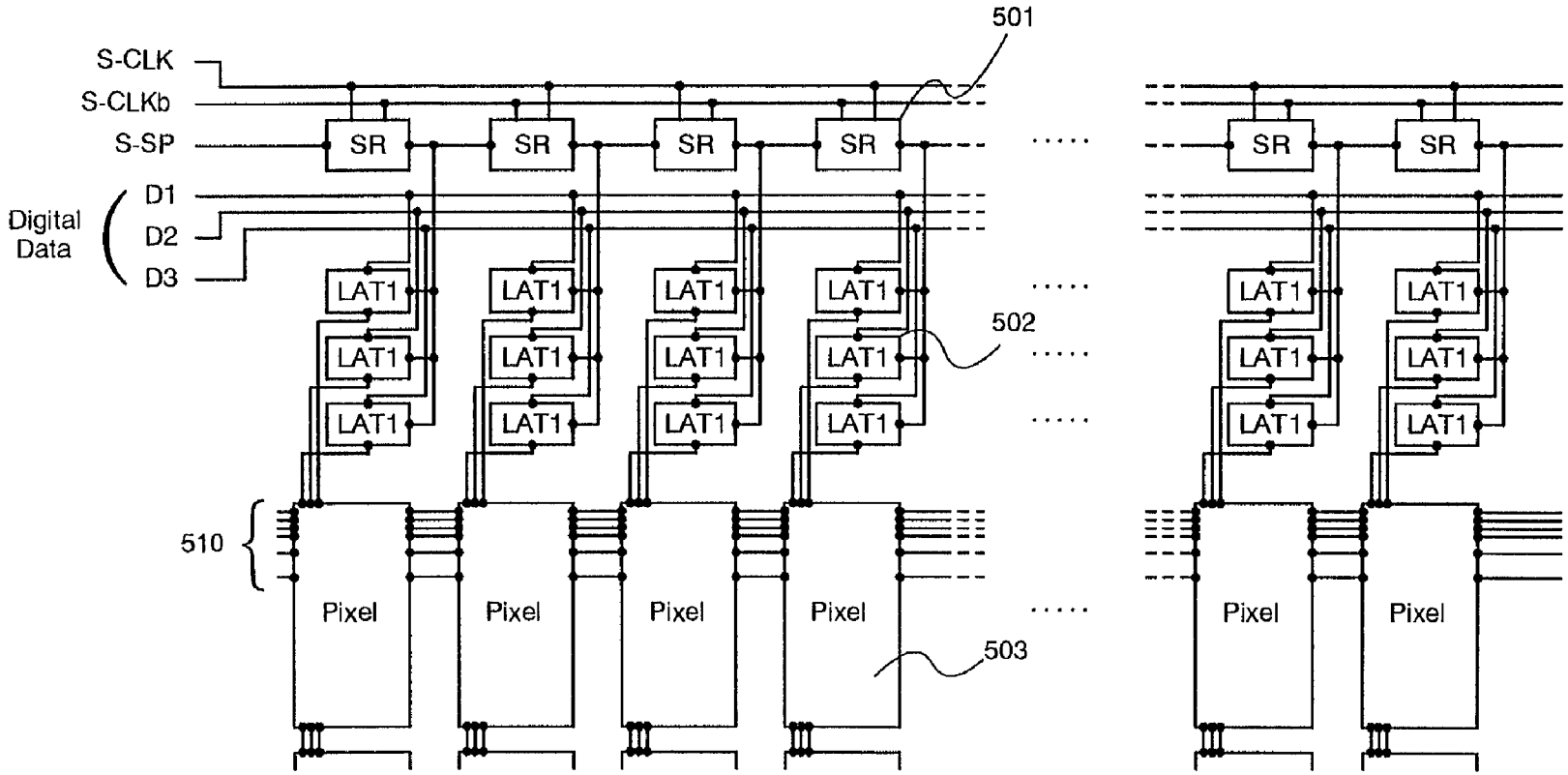
FIG. 5 is a diagram showing the circuit structure of a source signal line driving circuit that does not have a second latch circuit.

FIG. 5 shows the structure of a source signal line driving circuit and the structure of some of pixels in a liquid crystal display device that employs pixels having memory circuits. The circuit is capable of handling 3 bit digital gray scale signal, and is composed of shift register circuits (SR) 501, latch circuits (LAT1) 502, and pixels 503. Denoted by 510 are signals supplied directly from a gate signal line driving circuit or the like and descriptions of the signals will be found later along with explanations of the pixels.

Figure 6:
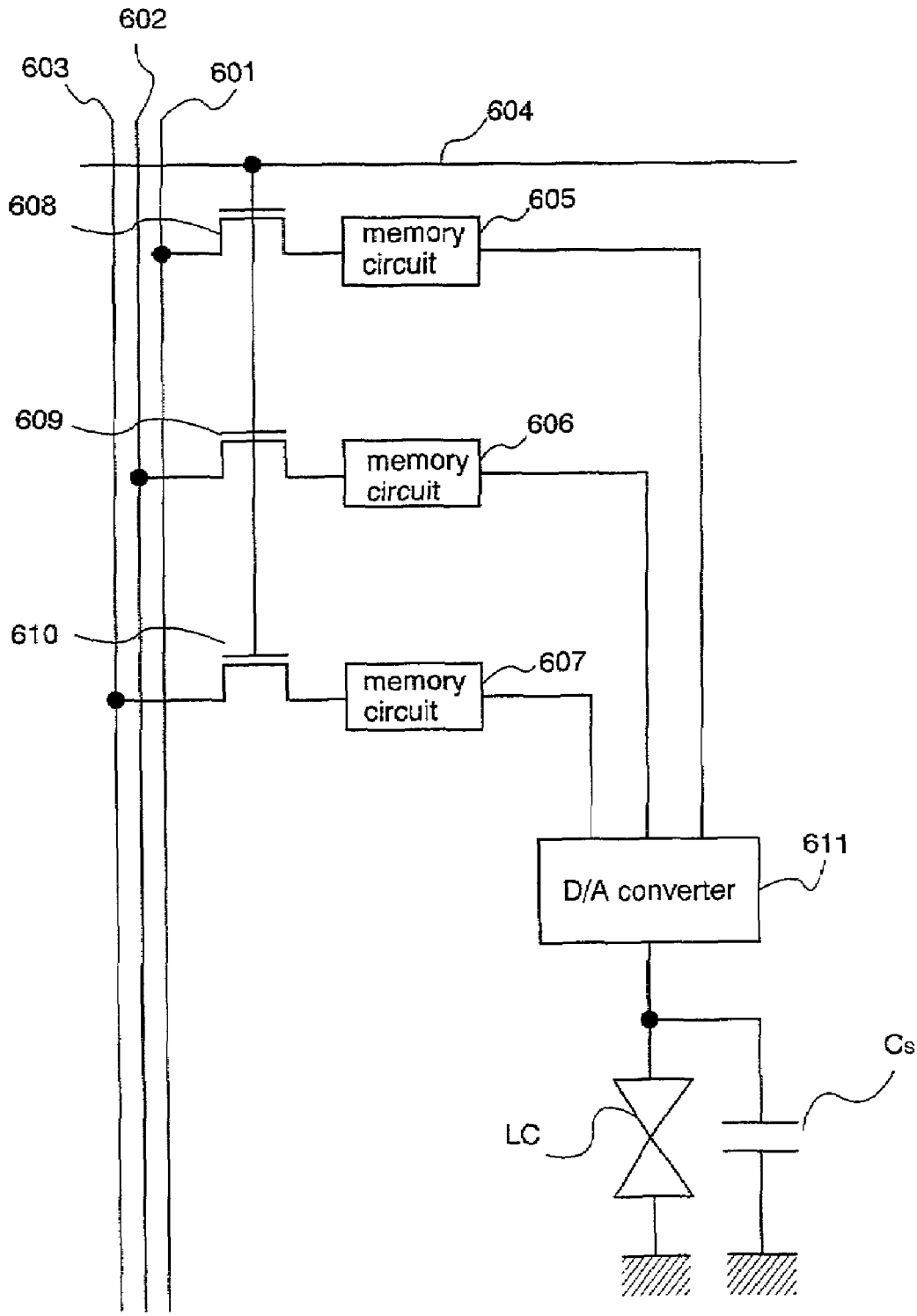
FIG. 6 is a circuit diagram of a pixel of the present invention which is driven by the source signal line driving circuit of FIG. 5.

FIG. 6 shows detailed circuit structure of one of the pixels 503 in FIG. 5. As in Embodiment 1, the pixel is for 3 bit digital gray scale signals, and is composed of a liquid crystal element (LC), a storage capacitor (Cs), memory circuits (605 to 607), a D/A (D/A converter 611), etc. Denoted by 601 is a first bit (MSB) signal source signal line, 602, a second bit signal source signal line, and 603, a third bit (LSB) signal source signal line. Reference symbol 604 represents a writing gate signal line whereas 608 to 610 represent writing TFTs.

Figure 7A:
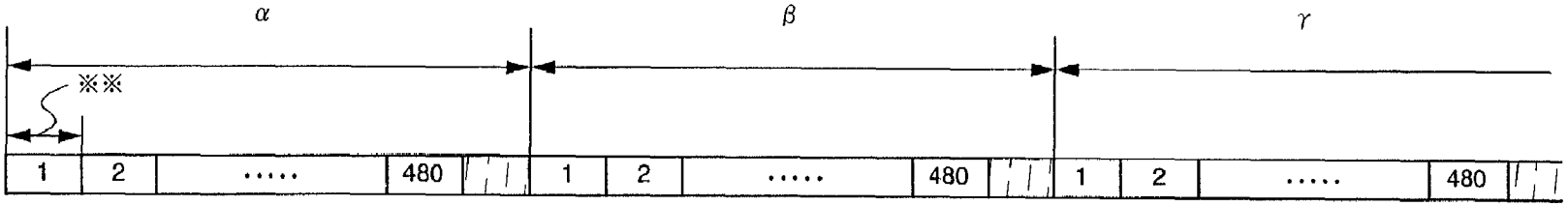
FIGS. 7A and 7B are timing charts for displaying an image using the circuits shown in FIGS. 5 and 6.
Figure 7B:
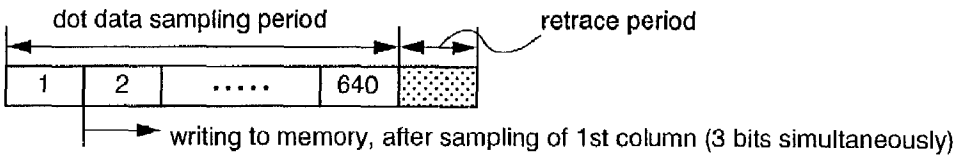

FIGS. 7A and 7B are timing charts regarding driving of the circuit of this embodiment. The description will be given with reference to FIG. 6 and FIGS. 7A and 7B.

The operation of the shift register circuits 501 and the latch circuits (LAT1) 502 is the same as Embodiment Mode and Embodiment 1. As shown in FIG. 7B, writing in the memory circuit of the pixels is started immediately after the latch operation for the first stage is finished. Pulses are inputted to the writing gate signal line 604 to turn the writing TFTs 608 to 610 conductive and ready the memory circuits for writing. The digital signals sorted by their bits and separately held in the latch circuits 502 are simultaneously written in the memory circuits through the three source signal lines 601 to 603.

While the digital signals held in the latch circuits are written in the memory circuits in the first stage, digital signals for the next stage are beginning to be held in the latch circuits in response to next sampling pulses. Signals are thus sequentially written in the memory circuits.

The above operation is repeated till the final stage, thereby completing one horizontal period.

The periods in FIG. 7B correspond to the period indicated by  in FIG. 7**A.

The same operation is conducted for all of the horizontal periods 1 to 480.

Then a display period for the first frame is completed. In the period β, digital signals of the next frame are processed.

An image is displayed by repeating the above procedure. When a still image is to be displayed, the operation of the source signal line driving circuit is stopped after finishing writing digital signals of a certain frame in the memory circuits, and the same signals written in the memory circuits are read each time a new frame is started to display the still image. In this way, current consumption during displaying a still image can be reduced greatly. Furthermore, the number of latch circuits is reduced to half the number of latch circuits in Embodiment Mode. This embodiment is therefore space-saving in arrangement of the circuits, and can contribute to overall size reduction of the display device.

EMBODIMENT 3

This embodiment describes an example of a liquid crystal display device to which the circuit structure of the liquid crystal display device shown in Embodiment 2 and having no second latch circuit is applied, and which employs dot-sequential driving to write signals in memory circuits in pixels.

Figure 17:
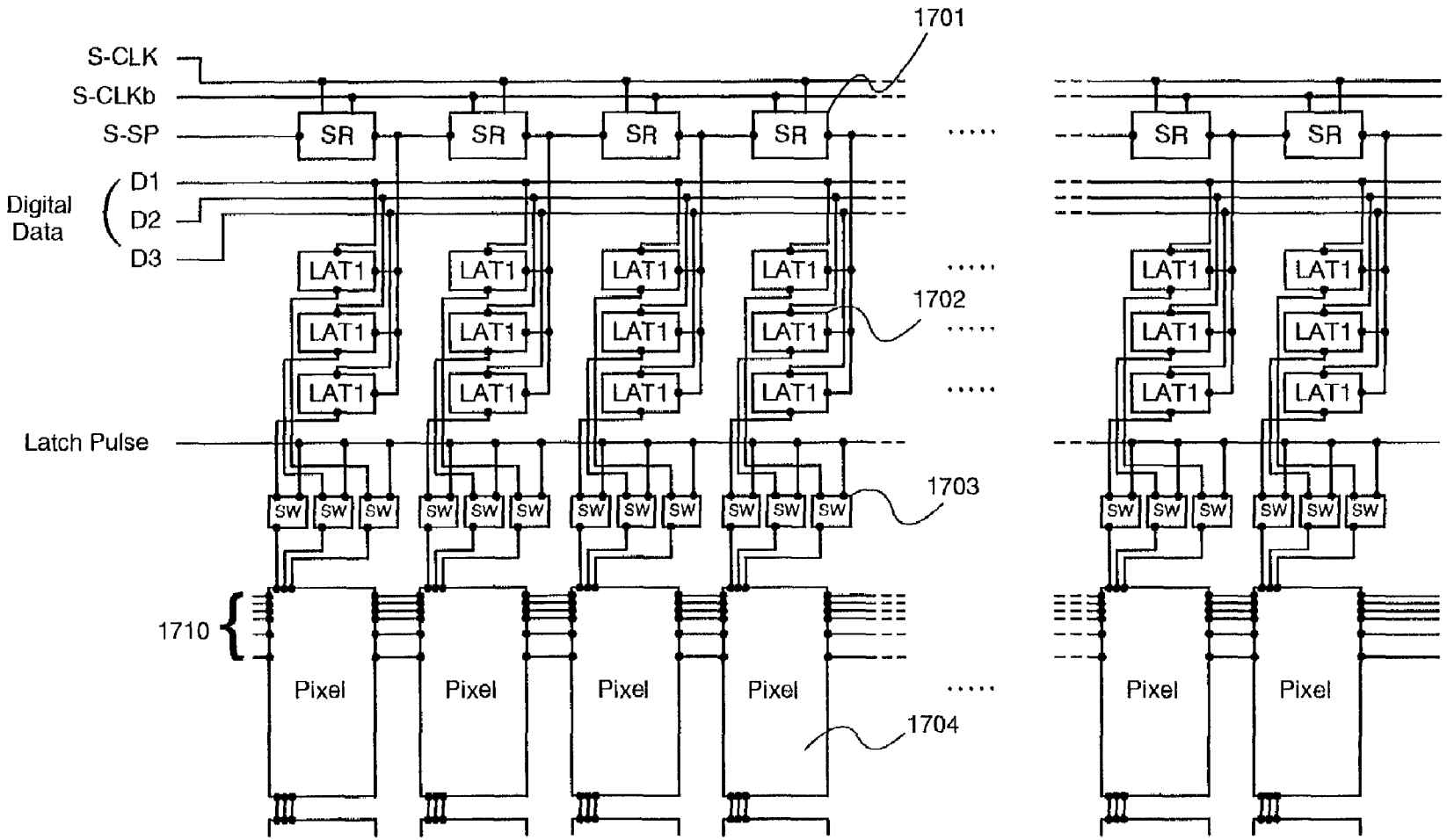
FIG. 17 is a diagram showing the circuit structure of a source signal line driving circuit that does not have a second latch circuit.

FIG. 17 shows an example of the circuit structure for a source signal line driving circuit of a liquid crystal display device according to this embodiment. The circuit is capable of handling 3 bit digital gray scale signals, and is composed of shift register circuits 1701, latch circuits 1702, switching circuits 1703, and pixels 1704. Denoted by 1710 are signals supplied from a gate signal line driving circuit, or directly from the external. The circuit structure of the pixels is the same as Embodiment 2, and hence FIG. 6 can be referred to as it is.

Figure 18A:
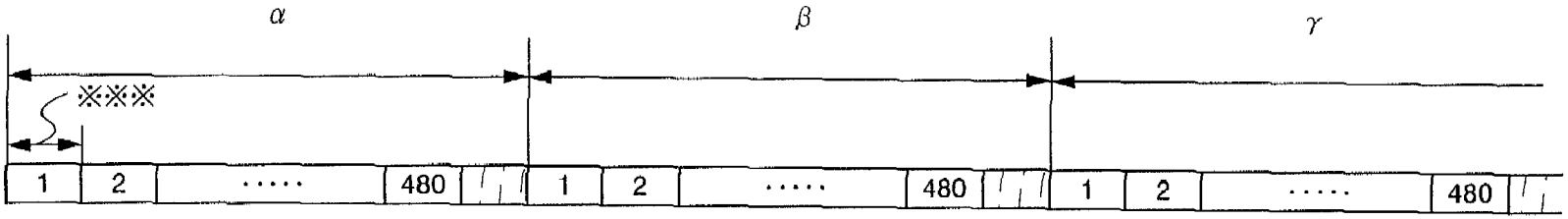
FIGS. 18A and 18B are timing charts for displaying an image using the circuit shown in FIG. 17.
Figure 18B:
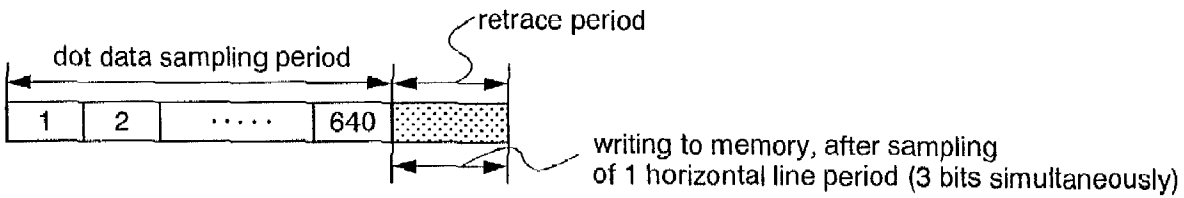

FIGS. 18A and 18B are timing charts regarding driving of the circuit of this embodiment. The description will be given with reference to FIG. 6, FIG. 17 and FIGS. 18A and 18B.

The operations from outputting sampling pulses from the shift register circuits 1701 through holding digital signals in the latch circuits 1702 in response to the sampling pulses are the same as Embodiments 1 and 2. In this embodiment, the switching circuits 1703 are placed between the latch circuits 1702 and the memory circuits in the pixels 1704. Therefore writing in the memory circuits does not start immediately after completing holding the digital signals in the latch circuits. The switching circuits 1703 are kept closed until the dot data sampling period is ended, and the latch circuits continue to hold the digital signals as long as the switching circuits are closed.

As shown in FIG. 18B, the switching circuits 1703 are opened all at once upon receiving input of latch signals (latch pulses) during the retrace period that follows completion of holding digital signals corresponding to one horizontal period. Then the digital signals held in the latch circuits 1702 are simultaneously written in the memory circuits in the pixels 1704. The operation in the pixels 1704 during this writing operation, and the operation in the pixels 1704 during reading out operation for display for the next frame period are the same as Embodiment 2, and hence explanations thereof are omitted here.

The periods in FIG. 18B correspond to the period indicated by * in FIG. 18**A.

In this way, driving in accordance with dot-sequential system can easily be made also when a source signal line driving circuit has no second latch circuit.

EMBODIMENT 4

Described in this embodiment is a case of using a D/A converter of the type that selects from a plurality of gray scale voltage lines. FIG. 8 shows a circuit diagram thereof.

When the circuit processes 3 bit digital signals, eight gray scale voltage lines are provided and the voltage lines are respectively connected to switching TFTs. Outputs of memory circuits are used to selectively drive the switching TFTs through a decoder. The switching TFTs may employ transmission gates.

In FIG. 8, outputs from memory circuits 105 to 107 are composed of signals stored in the memory circuits and inversion signals of the stored signals.

This embodiment can be combined freely with Embodiments 1 through 3.

EMBODIMENT 5

Figure 9:
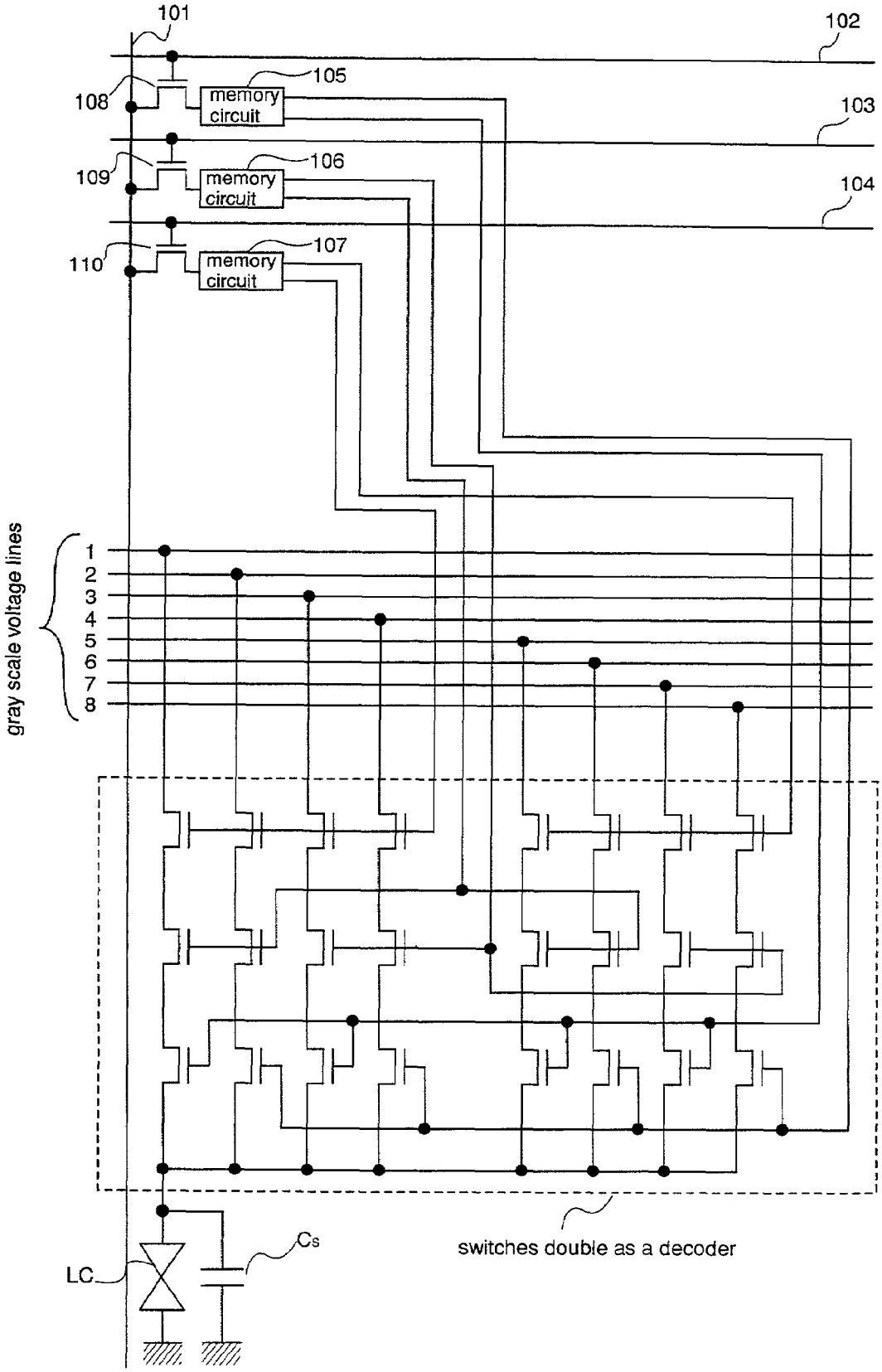
FIG. 9 is a diagram showing the structure of a D/A converter for a liquid crystal display device of the present invention.

This embodiment explains a case of using a D/A converter having a structure different from the one described in Embodiment 4 referring to FIG. 8. FIG. 9 shows a circuit diagram thereof.

The circuit of this embodiment is of the type that selects from plural gray scale voltage lines similar to the one shown in Embodiment 4 with reference to FIG. 8. The circuit of FIG. 8 has a lot of elements and hence the elements take up a large area in the pixel. Then, in FIG. 9, switches are connected in series so that the switches double as a decoder to reduce the number of elements. The switches may employ transmission gates.

In FIG. 9, outputs from the memory circuits 105 to 107 are composed of signals stored in the memory circuits and inversion signals of the stored signals.

This embodiment can be combined freely with Embodiments 1 through 3.

EMBODIMENT 6

Figure 20:
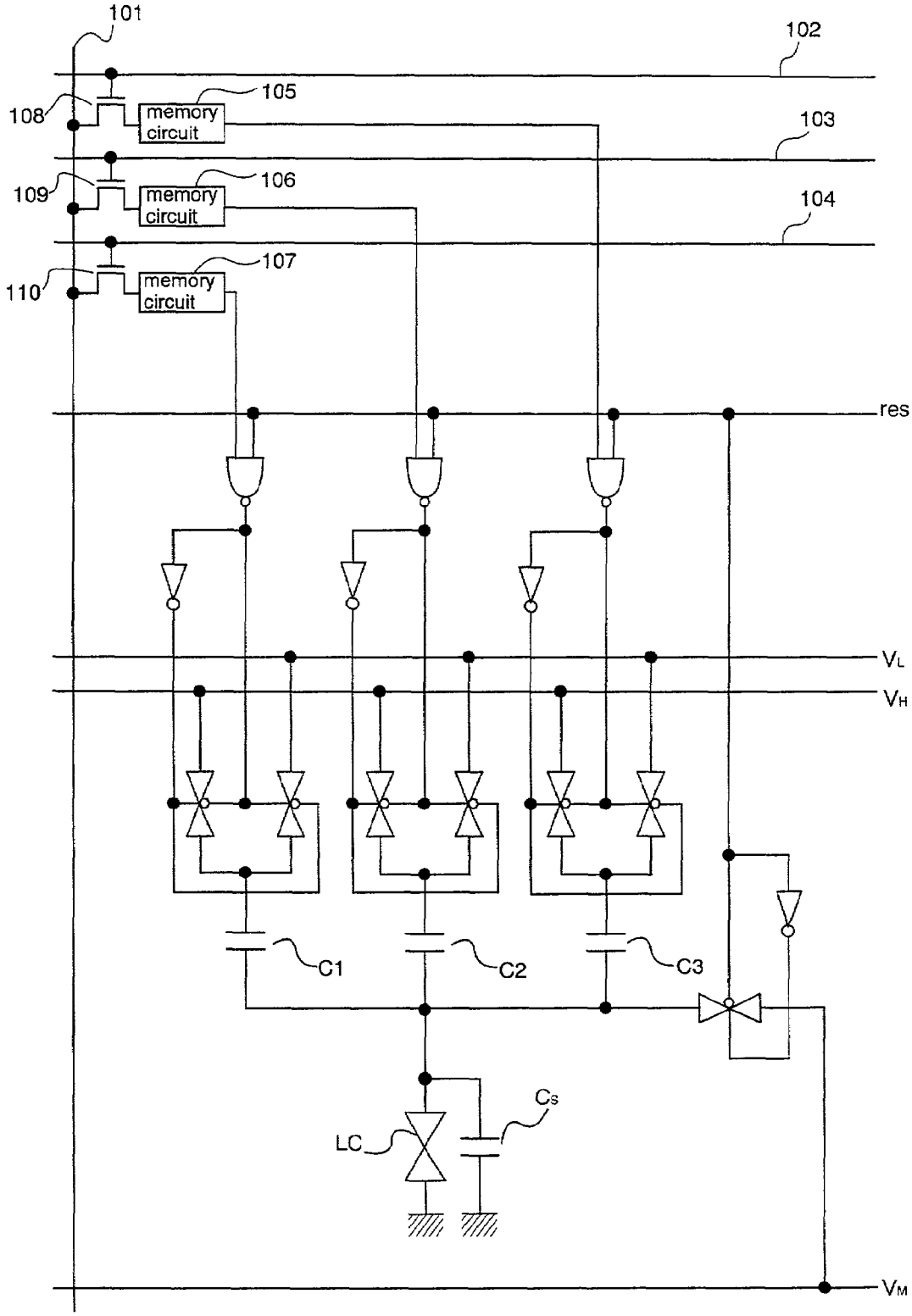
FIG. 20 is a diagram showing the structure of a D/A converter for a liquid crystal display device of the present invention.

This embodiment explains a case of using a D/A converter having a structure different from the ones described in Embodiments 4 and 5 referring to FIG. 8 and FIG. 9. FIG. 20 shows a circuit diagram thereof.

The D/A converters shown in FIGS. 8 and 9 use gray scale voltage lines, requiring wiring lines in a number corresponding to the number of gray scales. Therefore the converters of FIGS. 8 and 9 are not suitable for multi-gray scale. Then in the converter of FIG. 20, the reference voltage is divided to provide gray scale voltages in accordance with combinations of capacitors C1 to C3. The capacitance dividing method as this obtains gray scales in accordance with the proportion of the capacitors C1 to C3, thereby providing various gray scale displays.

D/A converters of capacitance dividing method as such are described in AMLCD99, Digest of Technical Papers pp. 29~32.

This embodiment can be combined freely with Embodiments 1 through 3.

EMBODIMENT 7

Figure 21:
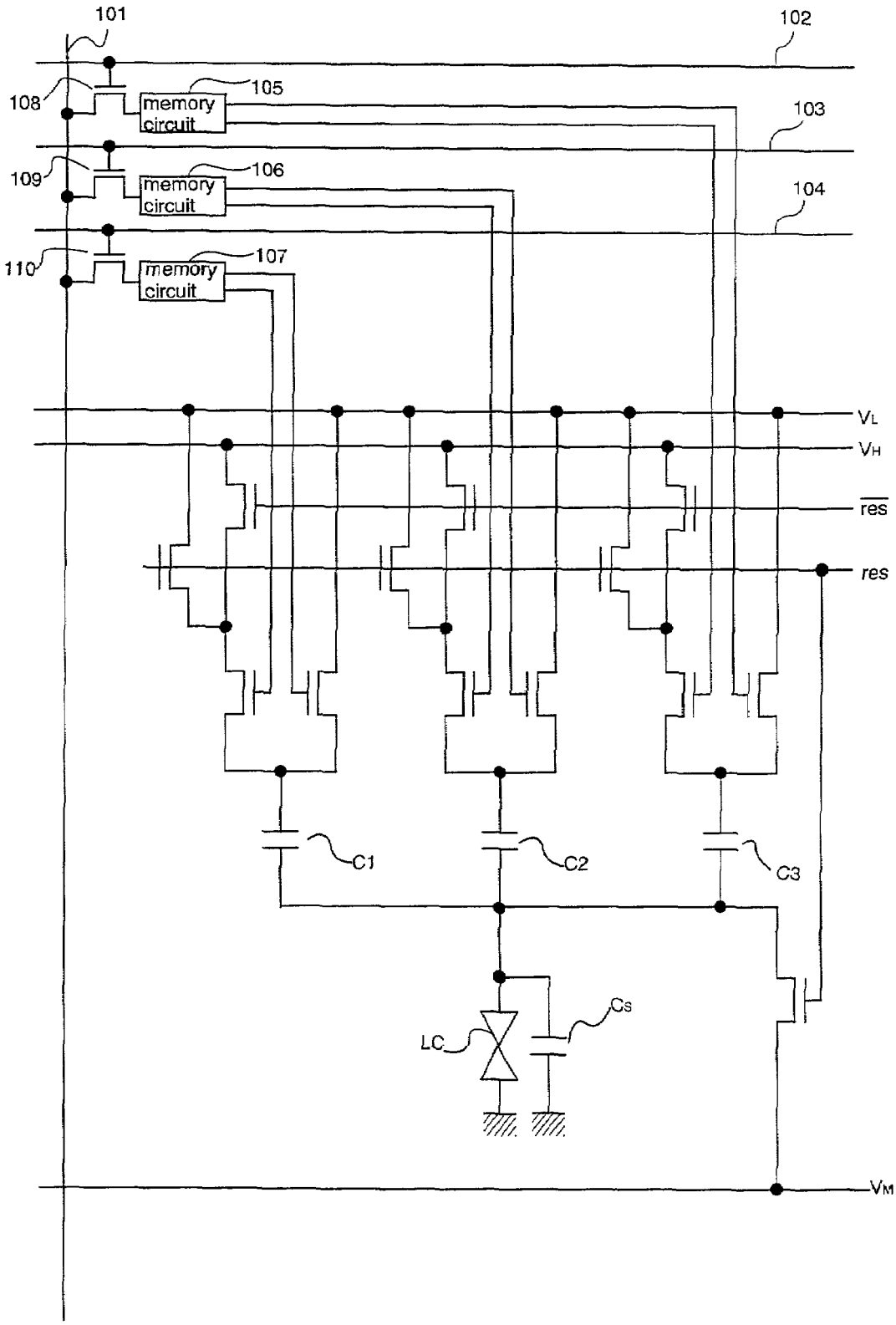
FIG. 21 is a diagram showing the structure of a D/A converter for a liquid crystal display device of the present invention.

This embodiment gives a description on a case of using a D/A converter having a structure different from the ones described in Embodiments 4, 5, and 6 referring to FIG. 8, FIG. 9, and FIG. 20. FIG. 21 shows a circuit diagram thereof.

The converter shown in FIG. 21 is a circuit obtained by further simplifying the D/A converter described in Embodiment 6 with reference to FIG. 20. Of two electrodes of each of the capacitors C1, C2, and C3, an electrode that is not connected to a liquid crystal element is connected to $V_L$ at the time of resetting, and is connected to $V_H$ or $V_L$ during other times. This connection may be established by a switch alone. The switch may employ a transmission gate.

In FIG. 21, outputs from the memory circuits 105 to 107 are composed of signals stored in the memory circuits and inversion signals of the stored signals.

This embodiment can be combined freely with Embodiments 1 through 3.

EMBODIMENT 8

Figure 22:
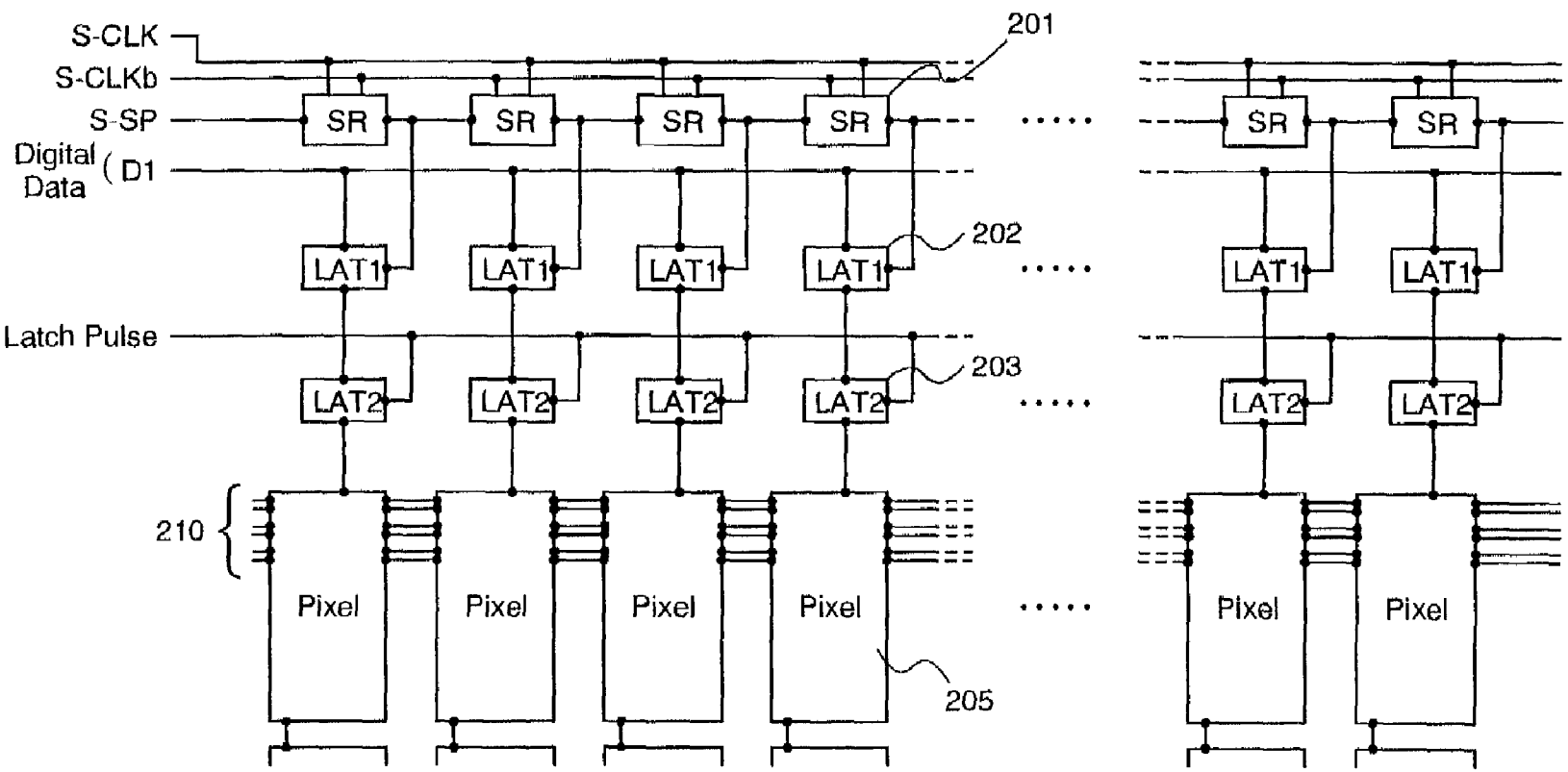
FIG. 22 is a diagram showing the circuit structure of a source signal line driving circuit that has latch circuits in a number necessary for one bit data processing.

As shown in FIG. 22, latch circuits of a source signal line driving circuit are provided in a number necessary for only one bit data processing. To compensate the small number, the source signal line driving circuit is operated three times faster, and first bit data, second bit data, and third bit data are inputted in order during one line period to the source signal line driving circuit. The source signal line driving circuit of this embodiment thus can provide the same effect as the one in Embodiment 1.

This method requires an external circuit for replacing data in order, but can reduce the size of the source signal line driving circuit.

EMBODIMENT 9

Note that a description is set forth regarding a step for fabricating TFTs for driving circuit (a source signal line driving circuit, a gate signal line driving circuit and a pixel selective line driving circuit) provided in the pixel portion of a display device using the driving method of the present invention and periphery portion of the pixel portion. For the simplicity of the explanation, a CMOS circuit is shown in figures, which is a fundamental structure circuit for the driving circuit portion.

Figures 10A, 10B, 10C:
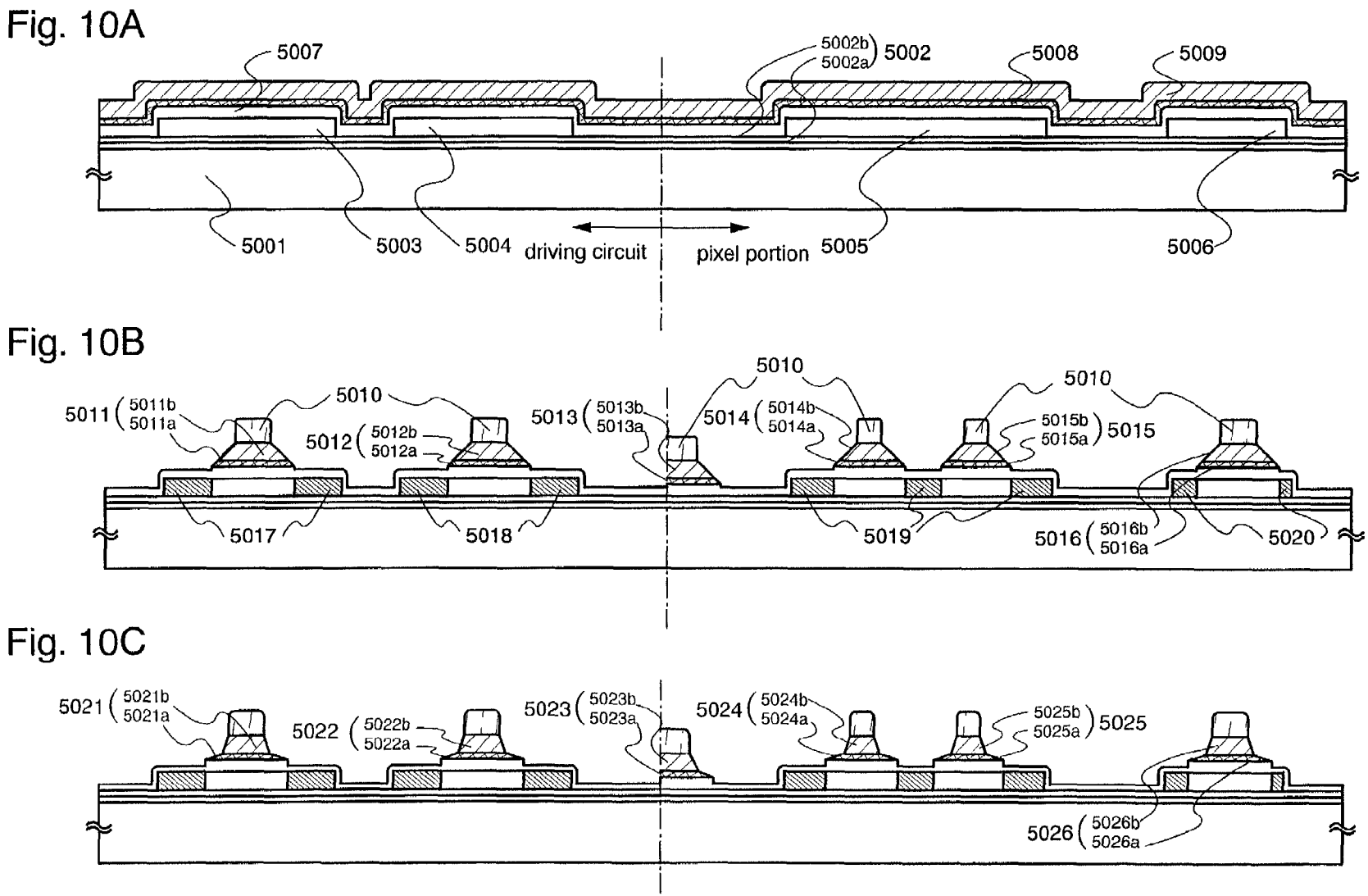
FIGS. 10A to 10C are diagrams showing an exemplary process of manufacturing a liquid crystal display device that has a pixel of the present invention.

First, as shown in FIG. 10A, a base film 5002 made of an insulating film such as a silicon oxide film, a silicon nitride film, or a silicon oxynitride film, is formed on a substrate 5001 made of a glass such as barium borosilicate glass or aluminum borosilicate glass, typically a glass such as Corning Corp. #7059 glass or #1737 glass. For example, a lamination film of a silicon oxynitride film 5002*a*, manufactured from $SiH_4$, $NH_3$, and $N_2O$ by plasma CVD, and formed having a thickness of 10 to 200 nm (preferably between 50 and 100 nm), and a hydrogenated silicon oxynitride film 5002*b*, similarly manufactured from $SiH_4$ and $N_2O$, and formed having a thickness of 50 to 200 nm (preferably between 100 and 150 nm), are formed. A two-layer structure is shown for the base film 5002 in Embodiment 9, but a single layer film of the insulating film, and a structure in which more than two layers are laminated, may also be formed.

Island shape semiconductor layers 5003 to 5006 are formed by crystalline semiconductor films made from a semiconductor film having an amorphous structure, using a laser crystallization method or a known thermal crystallization method. The thickness of the island shape semiconductor layers 5003 to 5006 may be formed from 25 to 80 nm (preferably between 30 and 60 nm). There are no limitations placed on the materials for forming a crystalline semiconductor film, but it is preferable to form the crystalline semiconductor films by silicon or a silicon germanium (SiGe) alloy.

A laser such as a pulse oscillation type or continuous light emission type excimer laser, a YAG laser, or a $YVO_4$ laser can be used to fabricate the crystalline semiconductor films by the laser crystallization method. A method of condensing laser light emitted from a laser oscillator into a linear shape by an optical system and then irradiating the light to the semiconductor film may be used when these types of lasers are used. The crystallization conditions may be suitably selected by the operator, but when using the excimer laser, the pulse oscillation frequency is set to 30 Hz, and the laser energy density is set form 100 to 400 mJ/cm$^2$ (typically between 200 and 300 mJ/cm$^2$). Further, when using the YAG laser, the second harmonic is used and the pulse oscillation frequency is set from 1 to 10 kHz, and the laser energy density may be set from 300 to 600 mJ/cm$^2$ (typically between 350 and 500 mJ/cm$^2$). The laser light condensed into a linear shape with a width of 100 to 1000 μm, for example 400 μm, is then irradiated over the entire surface of the substrate. This is performed with an overlap ratio of 80 to 98% for the linear laser light.

A gate insulating film 5007 is formed covering the island shape semiconductor layers 5003 to 5006. The gate insulating film 5007 is formed of an insulating film containing silicon with a thickness of 40 to 150 nm by plasma CVD or sputtering. A 120 nm thick silicon oxynitride film is formed in Embodiment 9. The gate insulating film is not limited to this type of silicon oxynitride film, of course, and other insulating films containing silicon may also be used in a single layer or in a lamination structure. For example, when using a silicon oxide film, it can be formed by plasma CVD with a mixture of TEOS (tetraethyl orthosilicate) and $O_2$, at a reaction pressure of 40 Pa, with the substrate temperature set from 300 to 400° C., and by discharging at a high frequency (13.56 MHz) electric power density of 0.5 to 0.8 W/cm$^2$. Good characteristics as a gate insulating film can be obtained by subsequently performing thermal annealing, at between 400 and 500° C., of the silicon oxide film thus manufactured.

A first conductive film 5008 and a second conductive film 5009 are then formed on the gate insulating film 5007 in order to form gate electrodes. The first conductive film 5008 is formed of a Ta film with a thickness of 50 to 100 nm, and the second conductive film 5009 is formed of a W film having a thickness of 100 to 300 nm, in Embodiment 9.

The Ta film is formed by sputtering, and sputtering of a Ta target is performed by Ar. If appropriate amounts of Xe and Kr are added to Ar, the internal stress of the Ta film is relaxed, and film peeling can be prevented. The resistivity of an α phase Ta film is about 20 μΩcm, and it can be used in the gate electrode, but the resistivity of a β phase Ta film is about 180 μΩcm and it is unsuitable for the gate electrode. The α Ta film can easily be obtained if a tantalum nitride film, which possesses a crystal structure similar to that of α phase Ta, is formed with a thickness of about 10 to 50 nm as a base for a Ta film in order to form the α phase Ta film.

The W film is formed by sputtering with a W target, which can also be formed by thermal CVD using tungsten hexafluoride ($WF_6$). Whichever is used, it is necessary to make the film become low resistance in order to use it as the gate electrode, and it is preferable that the resistivity of the W film be made equal to or less than 20 μΩcm. The resistivity can be lowered by enlarging the crystal grains of the W film, but for cases in which there are many impurity elements such as oxygen within the W film, crystallization is inhibited, thereby the film becomes high resistance. A W target having a purity of 99.9999% is thus used in sputtering. In addition, by forming the W film while taking sufficient care that no impurities from the gas phase are introduced at the time of film formation, the resistivity of 9 to 20 μΩcm can be achieved.

Note that, although the first conductive film 5008 is a Ta film and the second conductive film 5009 is a W film in Embodiment 9, both may also be formed from an element selected from the group consisting of Ta, W, Ti, Mo, Al, and Cu, or from an alloy material having one of these elements as its main constituent, and a chemical compound material. Further, a semiconductor film, typically a polycrystalline silicon film into which an impurity element such as phosphorus is doped, may also be used. Examples of preferable combinations other than that used in Embodiment 9 include: forming the first conductive film 5008 by tantalum nitride (TaN) and combining it with the second conductive film 5009 formed from a W film; forming the first conductive film 5008 by tantalum nitride (TaN) and combining it with the second conductive film 5009 formed from an Al film; and forming the first conductive film 5008 by tantalum nitride (TaN) and combining it with the second conductive film 5009 formed from a Cu film. Whichever is used, it is preferable to combine the conductive materials which can be etched with the suitable selectivity.

Then, mask 5010 are formed from resist, and a first etching treatment is performed in order to form electrodes and wirings. An ICP (inductively coupled plasma) etching method is used in Embodiment 9. A gas mixture of $CF_4$ and $Cl_2$ is used as an etching gas, and a plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. In case of mixing $CF_4$ and $Cl_2$, the W film and the Ta film are etched to the approximately same level.

Edge portions of the first conductive layer and the second conductive layer are made into a tapered shape in accordance with the effect of the bias voltage applied to the substrate side under the above etching conditions by using a suitable resist mask shape. The angle of the tapered portions is from 15 to 45°. The etching time may be increased by approximately 10 to 20% in order to perform etching without any residue remaining on the gate insulating film. The selectivity of a silicon oxynitride film with respect to a W film is from 2 to 4 (typically 3), and therefore approximately 20 to 50 nm of the exposed surface of the silicon oxynitride film is etched by this over-etching process. First shape conductive layers 5011 to 5016 (first conductive layers 5011*a* to 5016*a* and second conductive layers 5011*b* to 5016*b*) are thus formed of the first conductive layers and the second conductive layers in accordance with the first etching process. Reference numeral 5007 denotes a gate insulating film, and the regions not covered by the first shape conductive layers 5011 to 5016 are made thinner by etching of about 20 to 50 nm. (FIG. 10B)

A first doping process is then performed, and an impurity element which imparts n-type conductivity is added. (FIG. 10B) Ion doping or ion implantation may be performed for the method of doping. Ion doping is performed under the conditions of a dose amount of from $1\times10^{13}$ to $5\times10^{14}$ atoms/cm$^2$ and an acceleration voltage of 60 to 100 keV. A periodic table group 15 element, typically phosphorus (P) or arsenic (As) is used as the impurity element which imparts n-type conductivity, and phosphorus (P) is used here. The conductive layers 5011 to 5016 become masks with respect to the n-type conductivity imparting impurity element in this case, and first impurity regions 5017 to 5020 are formed in a self-aligning manner. The impurity element which imparts n-type conductivity is added to the first impurity regions 5017 to 5020 with a concentration in the range of $1\times10^{20}$ to $1\times10^{20}$ atoms/cm$^3$. (FIG. 10B)

A second etching process is performed next without removing the resist mask, as shown in FIG. 10C. A mixture of $CF_4$, $Cl_2$, and $O_2$ is used as the etching gas, and a W film is selectively etched. By the second etching process, the second shape conductive layers 5021 to 5026 (first conductive layers 5021*a* to 5026*a* and second conductive layers 5021*b* to 5026*b*) are foemed. Reference numeral 5007 denotes a gate insulating film, and regions not covered by the second shape conductive layers 5021 to 5026 are additionally etched on the order of 20 to 50 nm, forming thinner regions.

The etching reaction of a W film or a Ta film in accordance with a mixed gas of $CF_4$ and $Cl_2$ can be estimated from the radicals generated and from the ion types and vapor pressures of the reaction products. Comparing the vapor pressures of fluorides and chlorides of W and Ta, the W fluoride compound $WF_6$ is extremely high, and the vapor pressures of $WCl_5$, $TaF_5$, and $TaCl_5$ are of similar order. Therefore the W film and the Ta film are both etched by the $CF_4$ and $Cl_2$ gas mixture. However, if a suitable quantity of $O_2$ is added to this gas mixture, $CF_4$ and $O_2$ react, forming CO and F, and a large amount of F radicals or F ions is generated. As a result, the etching speed of the W film having a high fluoride vapor pressure is increased. On the other hand, even if F increases, the etching speed of Ta does not relatively increase. Further, Ta is easily oxidized compared to W, and therefore the surface of Ta is oxidized by the addition of $O_2$. The etching speed of the Ta film is further reduced because Ta oxides do not react with fluorine and chlorine. Therefore, it becomes possible to have a difference in etching speeds between the W film and the Ta film, and it becomes possible to make the etching speed of the W film larger than that of the Ta film.

Figures 11A, 11B, 11C:
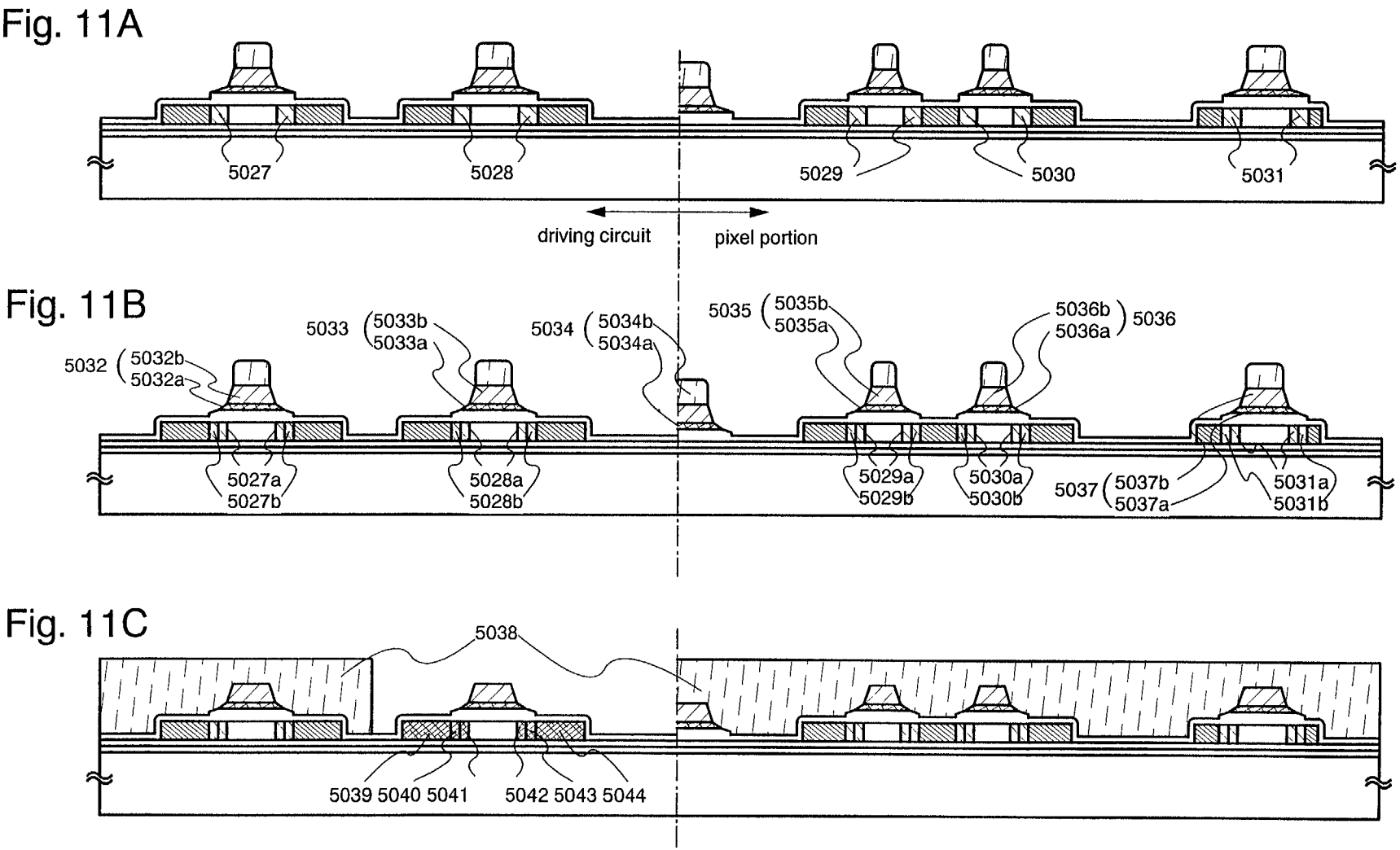
FIGS. 11A to 11C are diagrams showing the exemplary process of manufacturing a liquid crystal display device that has a pixel of the present invention.

Then, as shown in FIG. 11A, a second doping process is performed. In this case, a dosage is made lower than that of the first doping process and under the condition of a high acceleration voltage, an impurity element for imparting the n-type conductivity is doped. For example, the process is carried out with an acceleration voltage set to 70 to 120 keV and at a dosage of $1\times10^{13}$ atoms/cm$^2$, so that new impurity regions are formed inside of the first impurity regions formed into the island-like semiconductor layers in FIG. 10B. Doping is carried out such that the second shape conductive layers 5021 to 5026 are used as masks to the impurity element and the impurity element is added also to the regions under the first conductive layers 5021*a* to 5026*a*. In this way, second impurity regions 5027 to 5031 are formed. The concentration of phosphorus (P) added to the second impurity regions 5027 to 5031 has a gentle concentration gradient in accordance with the thickness of tapered portions of the first conductive layers 5021*a* to 5026*a*. Note that in the semiconductor layer that overlap with the tapered portions of the first conductive layers 5021*a* to 5026*a*, the concentration of impurity element slightly falls from the end portions of the tapered portions of the first conductive layers 5021*a* to 5026*a* toward the inner portions, but the concentration keeps almost the same level.

As shown in FIG. 11B, a third etching process is performed. This is performed by using a reactive ion etching method (RIE method) with an etching gas of $CHF_6$. The tapered portions of the first conductive layers 5021*a* to 5026*a* are partially etched, and the region in which the first conductive layers overlap with the semiconductor layer is reduced by the third etching process. Third shape conductive layers 5032 to 5037 (first conductive layers 5032*a* to 5037*a* and second conductive layers 5032*b* to 5037*b*) are formed. At this point, regions of the gate insulating film 5007, which are not covered with the third shape conductive layers 5032 to 5037 are made thinner by about 20 to 50 nm by etching.

By the third etching process, in the case of second impurity regions 5027 to 5031, second impurity regions 5027*a* to 5031*a* which overlap with the first conductive layers 5032*a* to 5037*a*, and third impurity regions 5027*b* to 5231*b* between the first impurity regions and the second impurity regions.

Then, as shown in FIG. 11C, fourth impurity regions 5039 to 5044 having a conductivity type opposite to the first conductivity type are formed in the island-like semiconductor layers 5004 forming p-channel TFTs. The third conductive layers 5033*b* are used as masks to an impurity element, and the impurity regions are formed in a self-aligning manner. At this time, the whole surfaces of the island-like semiconductor layers 5003, 5005, the storage capacitor portion 5006 and the wiring portion 5034, which form n-channel TFTs are covered with a resist mask 5038. Phosphorus is added to the impurity regions 5039 to 5044 at different concentrations, respectively. The regions are formed by an ion doping method using diborane ($B_2H_6$) and the impurity concentration is made $2\times10^{20}$ to $2\times10^{21}$ atoms/cm$^3$ in any of the regions.

By the steps up to this, the impurity regions are formed in the respective island-like semiconductor layers. The third shape conductive layers 5032, 5033, 5035, and 5036 overlapping with the island-like semiconductor layers function as gate electrodes. The numeral 5034 functions as an island-like source signal line. The numeral 5037 functions as a capacitor wiring.

After the resist mask 5038 is removed, a step of activating the impurity elements added in the respective island-like semiconductor layers for the purpose of controlling the conductivity type. This step is carried out by a thermal annealing method using a furnace annealing oven. In addition, a laser annealing method or a rapid thermal annealing method (RTA method) can be applied. The thermal annealing method is performed in a nitrogen atmosphere having an oxygen concentration of 1 ppm or less, preferably 0.1 ppm or less and at 400 to 700° C., typically 500 to 600° C. In Embodiment 9, a heat treatment is conducted at 500° C. for 4 hours. However, in the case where a wiring material used for the third shape conductive layers 5032 to 5037 is weak to heat, it is preferable that the activation is performed after an interlayer insulating film (containing silicon as its main ingredient) is formed to protect the wiring line or the like.

Further, a heat treatment at 300 to 450° C. for 1 to 12 hours is conducted in an atmosphere containing hydrogen of 3 to 100%, and a step of hydrogenating the island-like semiconductor layers is conducted. This step is a step of terminating dangling bonds in the semiconductor layer by thermally excited hydrogen. As another means for hydrogenation, plasma hydrogenation (using hydrogen excited by plasma) may be carried out.

Next, a first interlayer insulating film 5045 of a silicon oxynitride film is formed with a thickness of 100 to 200 nm. Then, a second interlayer insulating film 5046 of an organic insulating material is formed thereon. After that, etching is carried out to form contact holes.

Figure 12A:
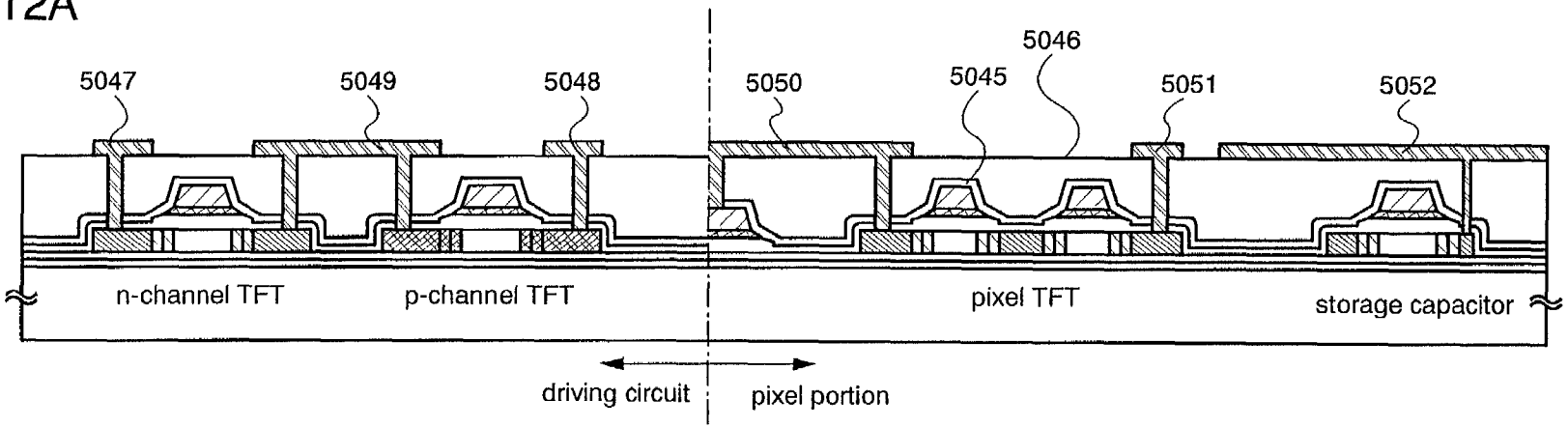
FIGS. 12A and 12B are diagrams showing the exemplary process of manufacturing a liquid crystal display device that has a pixel of the present invention.

Then, in the driving circuit portion, source wirings 5047 and 5048 for contacting the source regions of the island-like semiconductor layers, and a drain wiring 5049 for contacting the drain regions of the island-like semiconductor layers are formed. In the pixel portion, a connecting electrode 5050 and pixel electrodes 5051 and 5052 are formed (FIG. 12A). The connecting electrode 5050 allows electric connection between the source signal line 5034 and pixel TFTs. It is to be noted that the pixel electrode 5052 and a storage capacitor are of an adjacent pixel.

Thus, a driving circuit having an n-channel TFT and p-channel TFT, a pixel TFT and a pixel portion having a storage capacitor can be formed on the same substrate. In this specification, such substrate is referred to as an active matrix substrate.

Further, edge portions of the pixel electrodes are arranged overlapping a source signal line and a gate signal line such that the gaps between the pixel electrodes can be shielded from light without using a black matrix.

Furthermore, in accordance with the processes shown in Embodiment 9, the active matrix substrate can be manufactured by using five photomasks (an island shape semiconductor layer pattern, a first wiring pattern (source signal line, gate signal line, capacitor wirings), a p-channel region mask pattern, a contact hole pattern, and a second wiring pattern (including pixel electrodes and connection electrodes). As a result, the processes can be reduced, and this contributes to a reduction in the manufacturing costs and an increase in throughput.

Figure 12B:
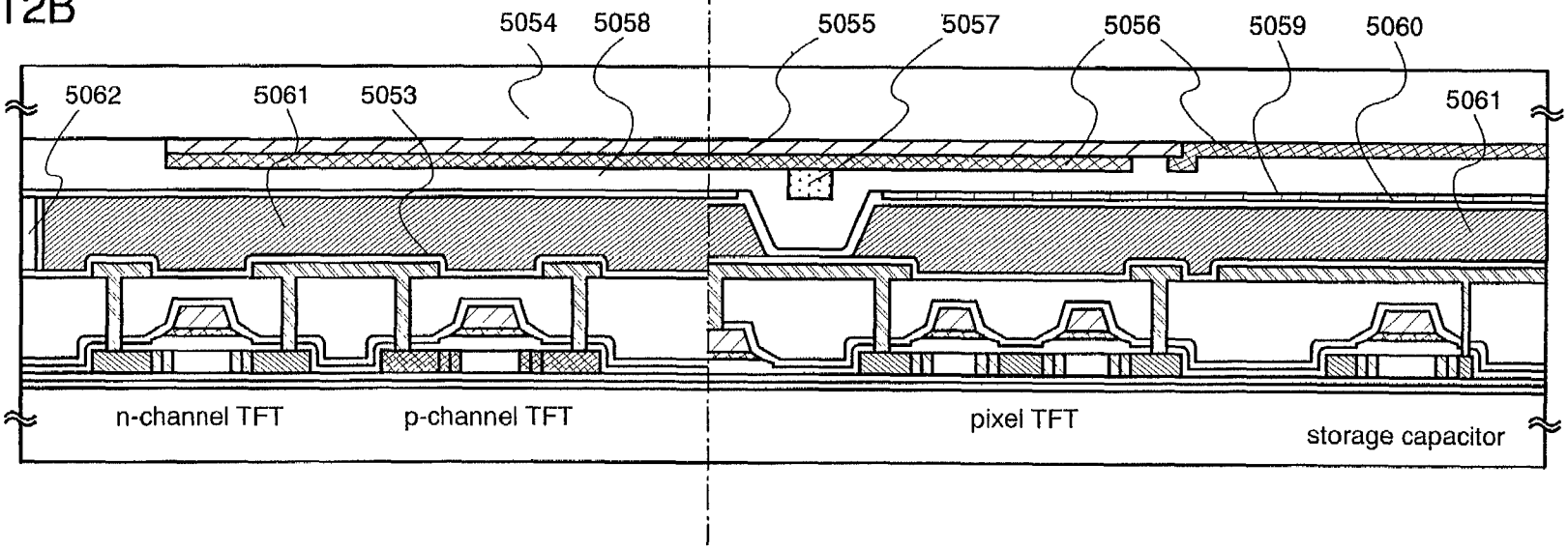
Figure 13:
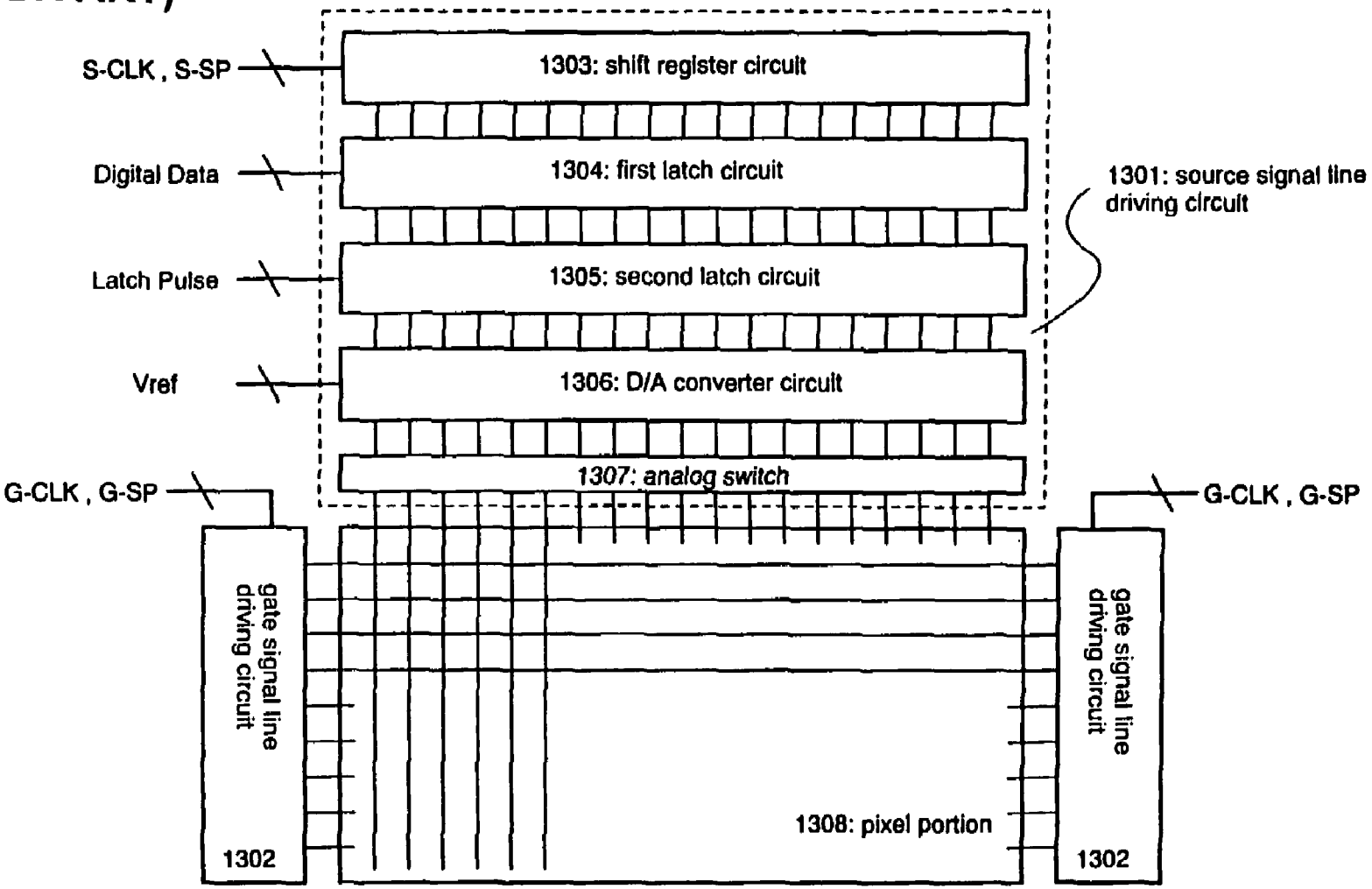
Fig. 13 (PRIOR ART)
FIG. 13 is a diagram schematically showing the overall circuit structure of a conventional liquid crystal display device.
Figure 14:
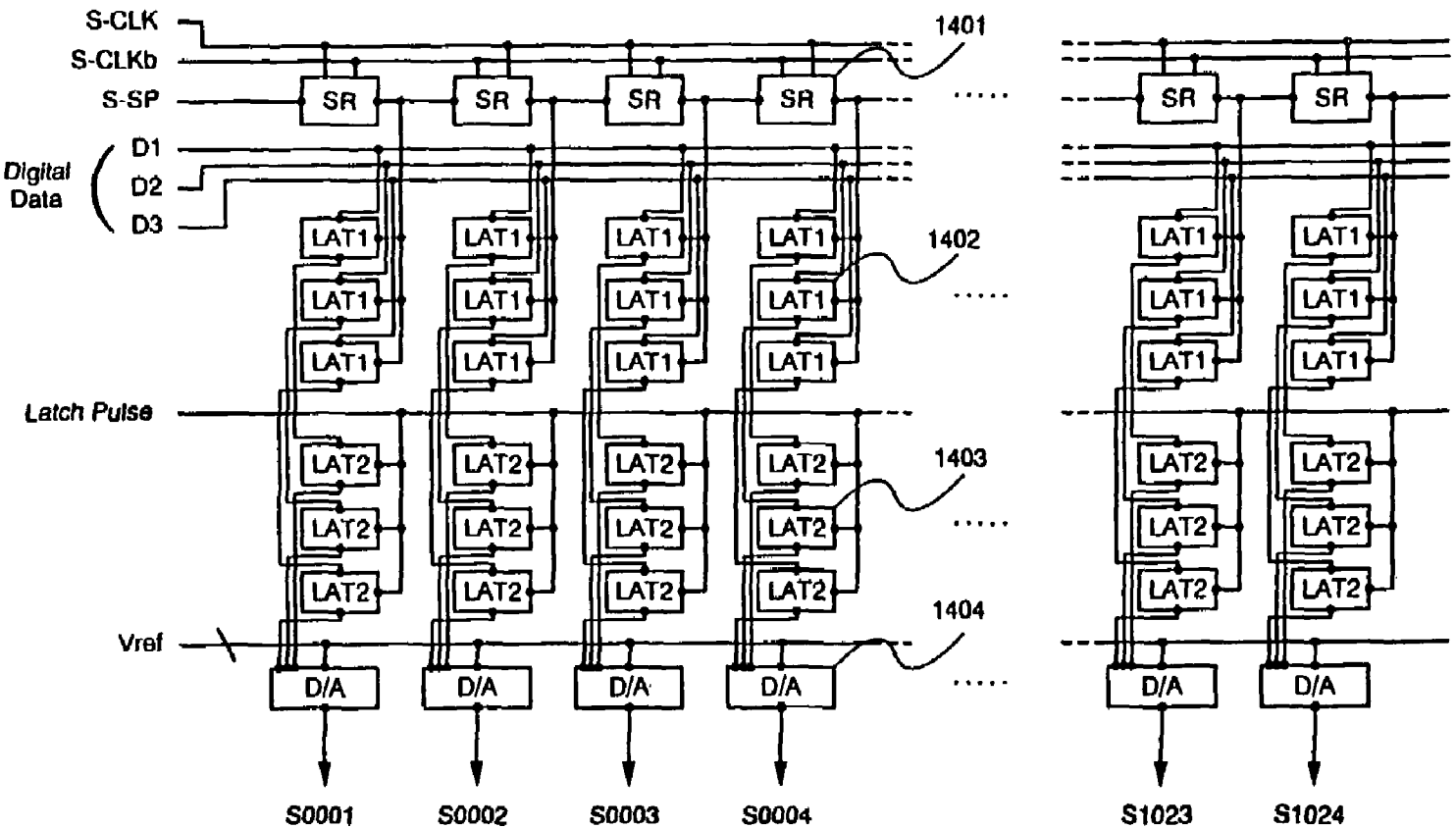
Fig. 14 (PRIOR ART)
FIG. 14 is a diagram showing the circuit structure of a source signal line driving circuit for a conventional liquid crystal display device.

After obtaining the active matrix substrate of FIG. 12A, an alignment film 5053 is formed on the active matrix substrate of FIG. 12B, and a rubbing process is performed.

An opposing substrate 5054 is prepared. Color filter layers 5055 to 5057, and an overcoat layer 5058 are formed on the opposing substrate 5054. The color filter layers are formed such that the color filter layer 5055, having a red color, and the color filter layer 5056, having a blue color, are overlapped with each other, and also serve as a light shielding film. It is necessary to shield at least the spaces between the TFTs, and the connection electrodes and the pixel electrodes, and therefore, it is preferable that the red color filters and the blue color filters are arranged so as to overlap and shield the necessary positions.

Further, combined with the connection electrode 5050, the red color filter layer 5055, the blue color filter layer 5056, and a green color filter layer 5057 are overlaid, forming a spacer. Each color filter is formed having a thickness of 1 to 3 μm by mixing a pigment into an acrylic resin. A predetermined pattern can be formed using a mask which uses a photosensitive material. Considering the thickness of the overcoat layer of 1 to 4 μm, the height of the spacers can be made from 2 to 7 μm, preferably between 4 and 6 μm. A gap is formed by this height when the active matrix substrate and the opposing substrate are joined together. The overcoat layer 5058 is formed by an optical hardening, or a thermosetting, organic resin material, and materials such as polyimide and acrylic resin are used, for example.

The arrangement of the spacers may be determined arbitrarily, and the spacers may be arranged on the opposing substrate 5054 so as to line up with positions over the connection electrodes, as shown in FIG. 12B, for example. Further, the spacers may also be arranged on the opposing substrate 5054 so as to line up with positions over the TFTs of the driving circuit. The spacers may be arranged over the entire surface of the driving circuit portion, and they may be arranged so as to cover source wirings and drain wirings.

An opposing electrode 5059 is formed by patterning after forming the overcoat layer 5058, and a rubbing process is performed after forming an alignment film 5060.

The active matrix substrate on which the pixel portion and the driving circuit are formed, and the opposing substrate are then joined together by a sealing member 5062. Fillers are mixed into the sealing member 5062, and the two substrates are joined together with a uniform gap maintained by the filler and the spacers. A liquid crystal material 5061 is then injected between both the substrate, and this is completely sealed by using a sealing material (not shown in the figure). A known liquid crystal material may be used as the liquid crystal material 5061. The active matrix liquid crystal display device shown in FIG. 12B is thus completed.

While the TFT manufactured by the above mentioned process has a top gate structure, the present invention can be also applied to the bottom gate structure TFT or other structure TFT.

Further, the glass substrate is used in this embodiment, but it is not limited. Other than glass substrate, such as the plastic substrate, the stainless substrate and the single crystalline wafers can be used to implement.

The present embodiment can be performed by freely combining with Embodiment 1 to Embodiment 8.

EMBODIMENT 10

A liquid crystal display device of the present invention has a plurality of memory circuits in its pixel portion, and hence the number of elements constituting one pixel is larger than in a normal pixel. If the liquid crystal display device is of transmissive type, then low aperture ratio can cause insufficient luminance. Therefore the present invention is desirably applied to a reflective liquid crystal display device. This embodiment shows an example of manufacturing a reflective liquid crystal display device.

Figure 19A:
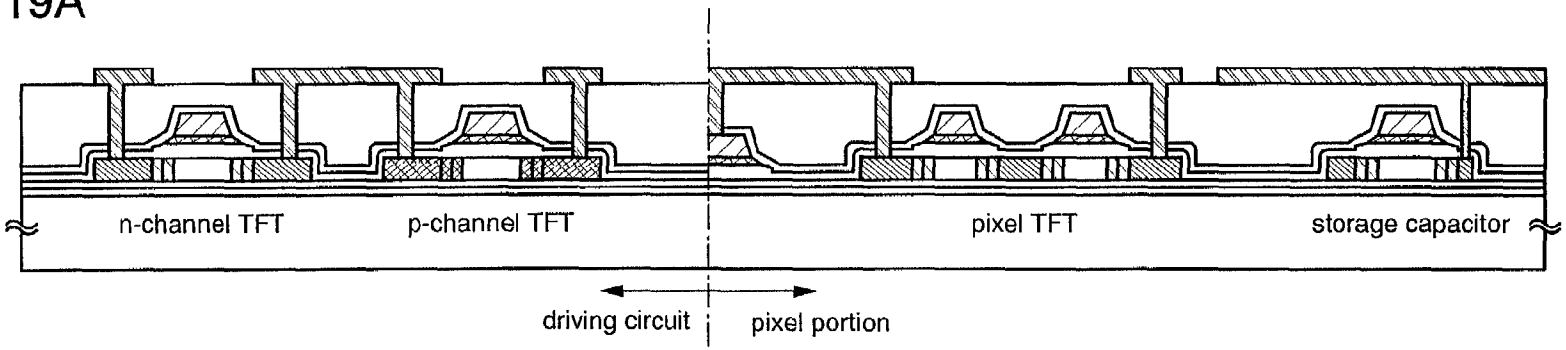
FIGS. 19A and 19B are diagrams showing an example of process of manufacturing a reflective liquid crystal display device.

Following descriptions of Embodiment 9, an active matrix substrate shown in FIG. 19A (the substrate is similar to the one shown in FIG. 12A) is fabricated. A resin film is then formed as a third interlayer insulating film 5201. Thereafter, a contact hole is opened in a pixel electrode portion to form a reflective electrode 5202. The reflective electrode 5202 is desirably formed of a material having excellent reflectivity, such as a film mainly containing Al or Ag, or a laminate of a Al containing film and a Ag containing film.

On the other hand, an opposing substrate 5054 is prepared. In this embodiment, an opposing electrode 5205 is formed on the opposing substrate 5054 by patterning. The opposing electrode 5205 is formed of a transparent conductive film. The material of the transparent conductive film may contain a compound of indium oxide and tin oxide (the compound is called ITO) or a compound of indium oxide and zinc oxide.

Although not shown in the drawing, a color filter layer is formed when a color liquid crystal display device is to be manufactured. A preferred structure in this case is that adjacent color filter layers of different colors overlap with each other so as to double as a light-shielding film for an area that serves as a TFT.

Thereafter, alignment films 5203 and 5204 are formed on the active matrix substrate and the opposing substrate, respectively, and rubbing treatment is given to the alignment films.

Figure 19B:
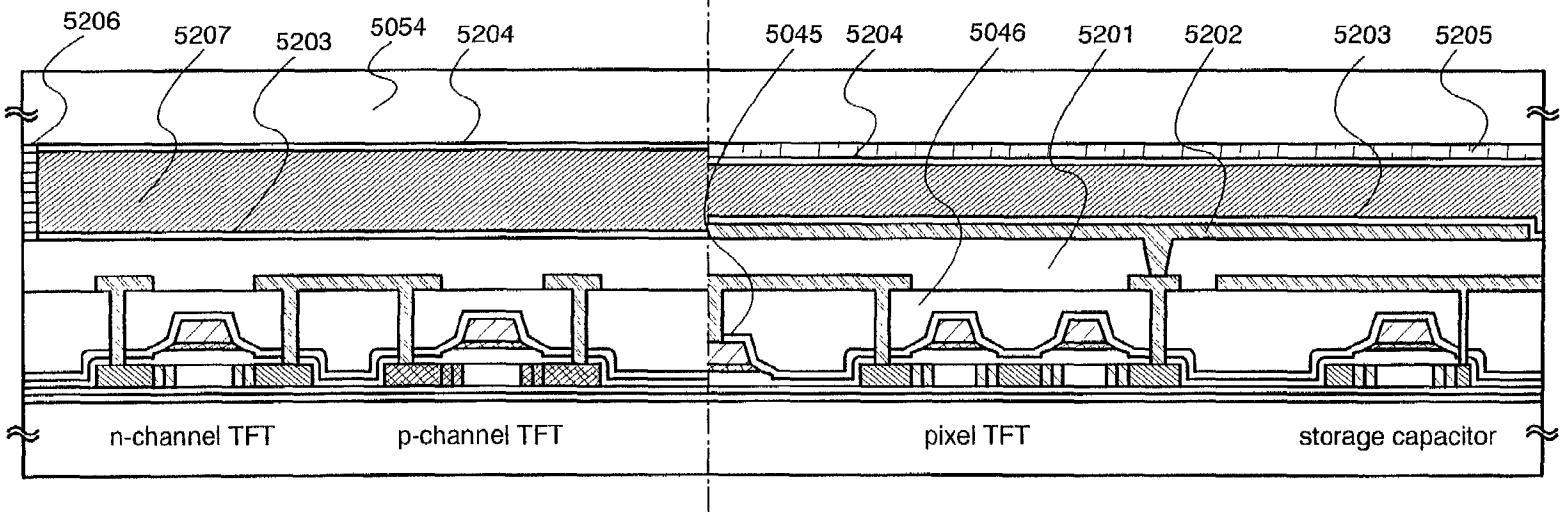

The active matrix substrate on which the pixel portion and the driving circuit portion are formed is then bonded to the opposing substrate using a sealing member 5206. The sealing member 5206 has a filler mixed therein, and the filler, together with a spacer, keeps the distance uniform between the two substrates when they are bonded. A liquid crystal material 5207 is injected between the substrates, and then the substrates are completely sealed by an end sealing material (not shown). The liquid crystal material 5207 may be a known liquid crystal material. Thus completed is a reflective liquid crystal display device shown in FIG. 19B.

In this embodiment, substrates other than the glass substrate, including a plastic substrate, a stainless steel substrate, and a single crystal wafer, may also be used.

Also, the present invention can readily be applied to a semi-transmissive display device in which half the pixels have reflective electrodes and the rest of the pixels have transparent electrodes.

This embodiment can be freely combined with Embodiments 1 through 8.

EMBODIMENT 11

Figure 27A:
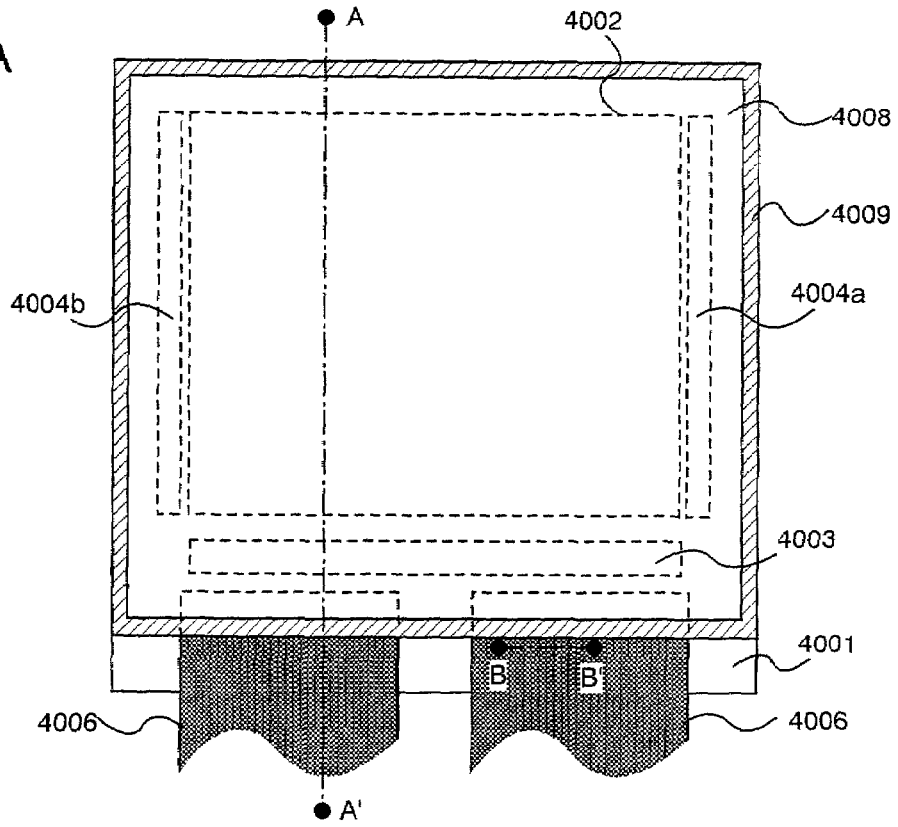
FIGS. 27A to 27C are diagrams showing a liquid crystal display device for a portable information device of the present invention, where
Figure 27B:
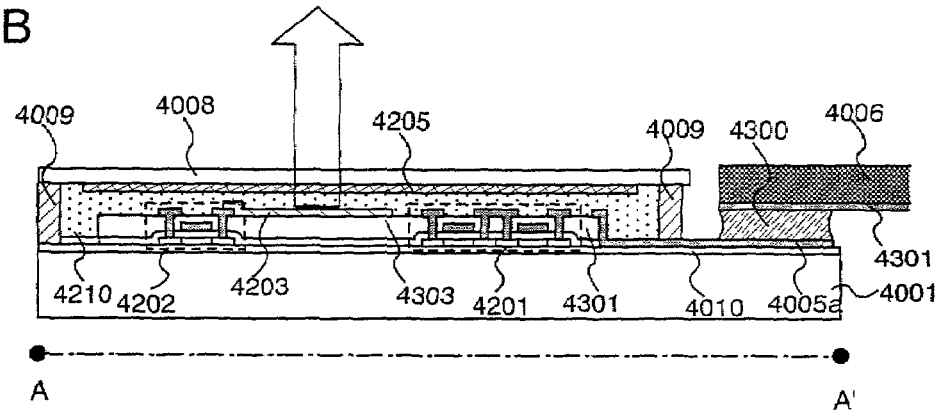
Figure 27C:
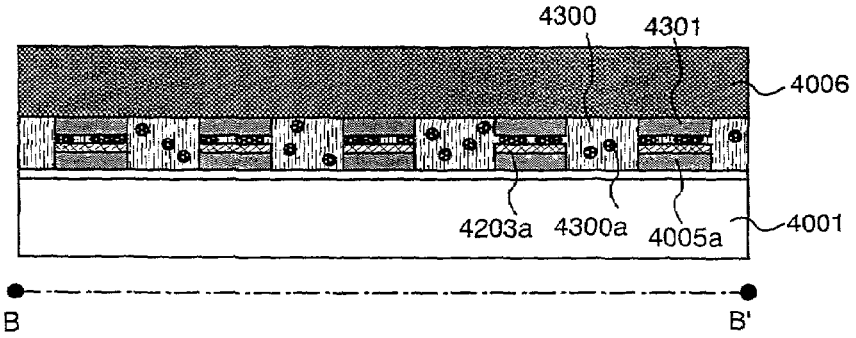

This embodiment gives a description with reference to FIGS. 27A to 27C on an example of manufacturing a liquid crystal display device of the present invention.

FIG. 27A is a top view of a liquid crystal display device with a liquid crystal sealed between a TFT substrate and an opposing substrate. FIG. 27B is a sectional view taken along the line A-A' in FIG. 27A. FIG. 27C is a sectional view taken along the line B-B' in FIG. 27A.

A sealing member 4009 is provided so as to surround a pixel portion 4002, a source signal line driving circuit 4003, and first and second gate signal line driving circuits 4004*a* and 4004*b*, which are formed on a TFT substrate 4001. An opposing substrate 4008 is placed on the pixel portion 4002, the source signal line driving circuit 4003, and the first and second gate signal line driving circuits 4004*a* and 4004*b*. The space surrounded by the TFT substrate 4001, the sealing member 4009, and the opposing substrate 4008 is filled with a liquid crystal 4210.

The pixel portion 4002, the source signal line driving circuit 4003, and the first and second gate signal line driving circuits 4004*a* and 4004*b*, which are formed on TFT substrate 4001, have a plurality of TFTs. FIG. 27B shows as representatives of those TFTs a driving TFT 4201 and a pixel TFT 4202. The driving TFT (shown here are an n-channel TFT and a p-channel TFT) 4201 is formed on a base film 4010 and is included in the source signal line driving circuit 4003. The pixel TFT (a TFT for controlling the voltage applied to a pixel electrode) 4202 is included in the pixel portion 4002.

In this embodiment, a p-channel TFT and an n-channel TFT formed by a known method are used for the driving TFT 4201, and a p-channel TFT formed by a known method is used for the pixel TFT 4202. The pixel portion 4002 is provided with a storage capacitor (not shown) electrically connected to a gate electrode of the pixel TFT 4202.

An interlayer insulating film (planarization film) 4301 is formed on the driving TFT 4201 and the pixel TFT 4202. On the interlayer insulating film 4301, a pixel electrode 4203 electrically connected to a drain of the pixel TFT 4202 is formed.

An opposing electrode 4205 is formed on the opposing substrate 4008. Though not shown in FIG. 27B, a color filter and a polarizing plate are provided suitably. A given voltage is applied to the opposing electrode 4205.

In the manner described above, a liquid crystal cell composed of the pixel electrode 4203, the liquid crystal 4210, and the opposing electrode 4205 is completed.

Reference symbol 4005*a* denotes lead-out wiring lines, which connect the pixel portion 4002, the source signal line driving circuit 4003, the first gate signal line driving circuit 4004*a*, and the second gate signal line driving circuit 4004*b* to an external power supply. A lead-out wiring line 4005*a* runs between the sealing member 4009 and the TFT substrate 4001 to be electrically connected to an FPC wiring line 4301 of an FPC 4006 through an anisotropic conductive film 4300.

The opposing substrate 4008 may be formed of a glass material, a metal material (typically, a stainless steel material), a ceramic material, or a plastic material (including a plastic film). Examples of the plastic material usable include an FRP (fiberglass-reinforced plastics) plate, a PVF (polyvinyl fluoride) film, a Mylar film, a polyester film, and an acrylic resin film. A sheet having an aluminum foil sandwiched between PVF films or between Mylar films may also be used.

If the light from the pixel electrode travels toward the cover member side, the cover member has to be transparent. In this case, a transparent material such as a glass plate, a plastic plate, a polyester film, or an acrylic film is used.

The pixel electrode 4203 and a conductive film 4203*a* are formed simultaneously. The conductive film 4203*a* is formed so as to contact the top face of the lead-out wiring line 4005*a* as shown in FIG. 27C.

The anisotropic conductive film 4300 contains conductive fillers 4300*a*. The conductive fillers 4300*a* electrically connect the conductive film 4203*a* on the TFT substrate 4001 with the FPC wiring line 4301 on the FPC 4006 by subjecting the TFT substrate 4001 and the FPC 4006 to thermal press-fitting.

This embodiment can be combined freely with Embodiments 1 through 10.

EMBODIMENT 12

The description given in this embodiment is of an example in which a liquid crystal display device of the present invention is embodied in a transmissive liquid crystal display device.

The design rule is set to 1 μm rule, and the pixel pitch is set to about 100 ppi. Then memory circuits, a D/A converter and other components in a pixel can be placed under a source signal line, thereby solving the problem of low aperture ratio. This makes it possible to apply the present invention to a transmissive liquid crystal display device in addition to a reflective liquid crystal display device.

Figure 30:
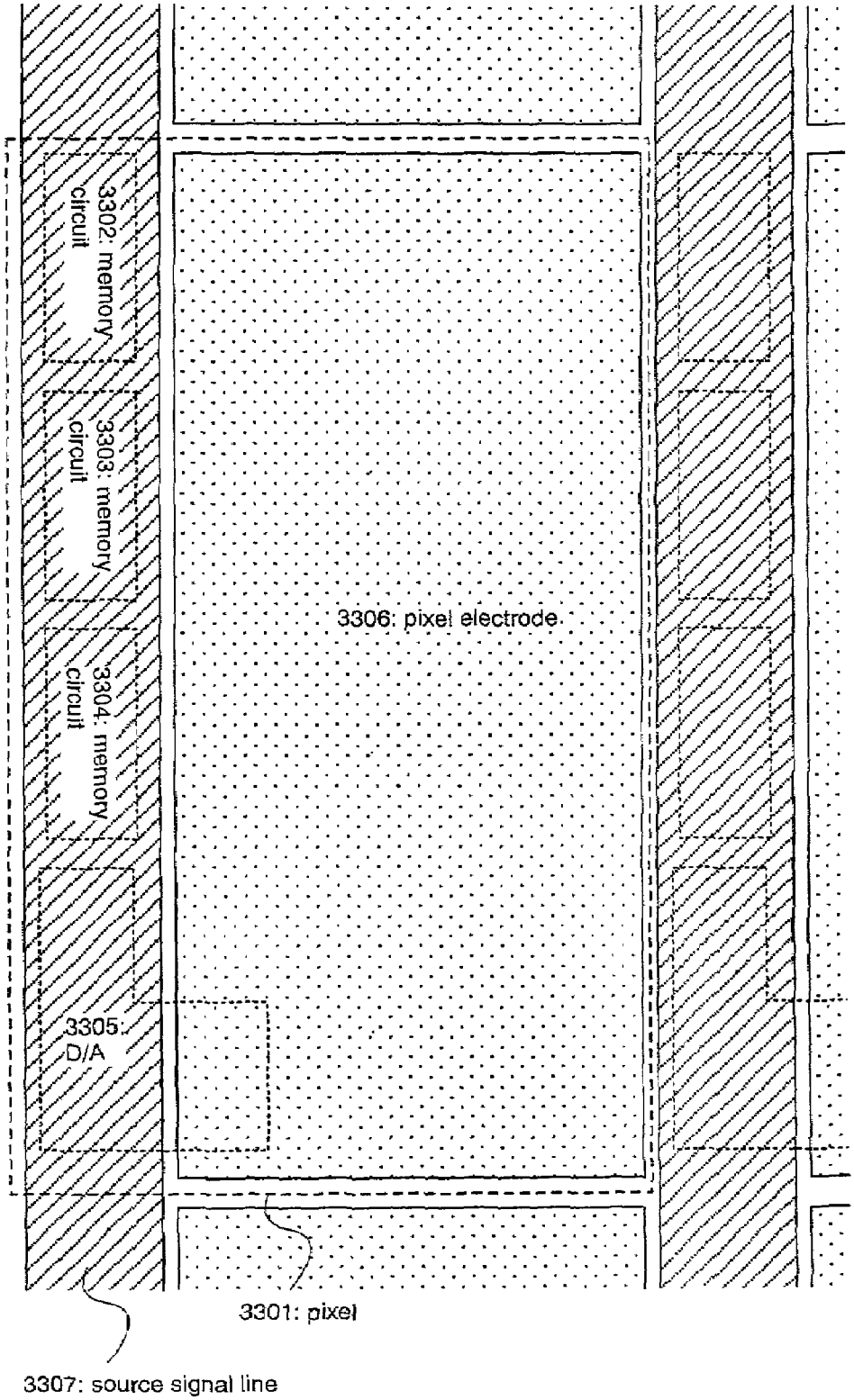
FIG. 30 is a top view of a pixel in a liquid crystal display device of a portable information device of the present invention.

FIG. 30 schematically shows a top view of a pixel in a transmissive liquid crystal display device structured as above.

Reference symbol 3301 denotes a pixel, 3302 to 3304, memory circuits, 3305, a D/A converter, 3306, a pixel electrode, and 3307, a source signal line. An opposing electrode, a color filter, a storage capacitor, and some other components are omitted from the drawing. The memory circuits 3302 to 3304 and the D/A converter 3305 are formed so as to overlap the source signal line 3307.

Though not shown, the memory circuits 3302 to 3304 and the D/A converter 3305 may be arranged so as to overlap a gate signal line, instead of placing them under the source signal line 3307.

EMBODIMENT 13

Static random access memories (SRAM) are used for the memory circuits in the pixel portions of the liquid crystal display devices according to Embodiments 1 through 12 of the present invention. However, the memory circuits are not limited to SRAM. Dynamic random access memories (DRAM) can be given as other memory circuits employable by a pixel portion in a liquid crystal display device of the present invention.

Still another format of memory circuits that can be used to constitute a pixel portion in a liquid crystal display device of the present invention is, though not shown in the drawing, FeRAM (ferroelectric random access memory). FeRAM is a non-volatile memory having the same level of writing speed as SRAM and DRAM. Characteristics of FeRAM, including low writing voltage, can be utilized to further reduce power consumption of the liquid crystal display device of the present invention. Flash memories may also be used to constitute the memory circuits of the present invention.

This embodiment can be combined freely with Embodiments 1 through 12.

EMBODIMENT 14

An active matrix type liquid crystal display device using a driving circuit which is formed along with the present invention have various usage. In this embodiment, the semiconductor device implemented the display device using a driving circuit which is formed along with the present invention.

The following can be given as examples of such display device: a portable information terminal (such as an electronic book, a mobile computer, or a mobile telephone), a video camera; a digital camera; a personal computer; a television and a projector device. Examples of those electronic equipments are shown in FIGS. 15 and 16.

Figure 15A:
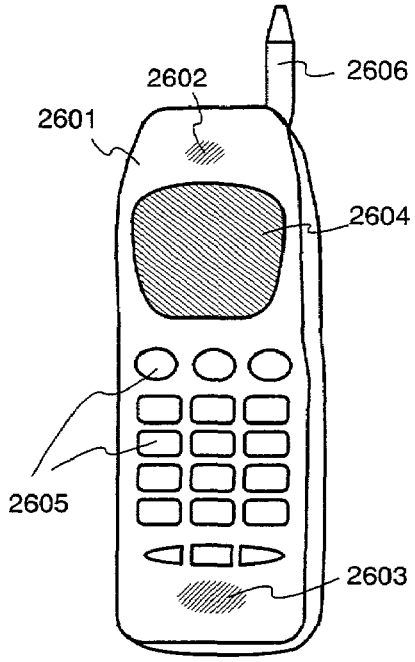
FIGS. 15A to 15F are diagrams showing electronic devices to which a display device having a pixel of the present invention can be applied.

FIG. 15A is a portable telephone which includes a main body 2601, a voice output portion 2602, a voice input portion 2603, a display portion 2604, operation switches 2605, and an antenna 2606. The present invention can be applied to the display portion 2604.

Figure 15B:
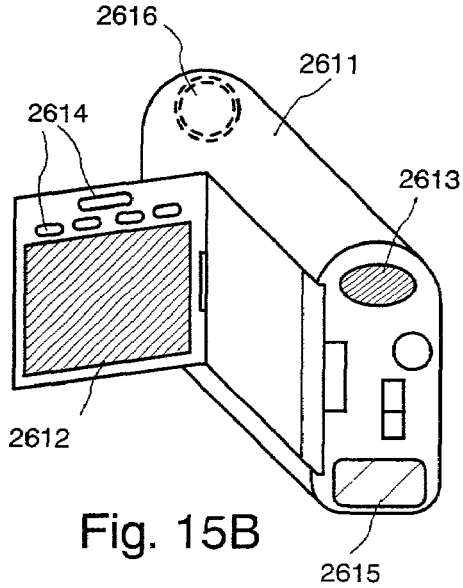

FIG. 15B illustrates a video camera which includes a main body 2611, a display portion 2612, an audio input portion 2613, operation switches 2614, a battery 2615, an image receiving portion 2616, or the like. The present invention can be applied to the display portion 2612.

Figure 15C:
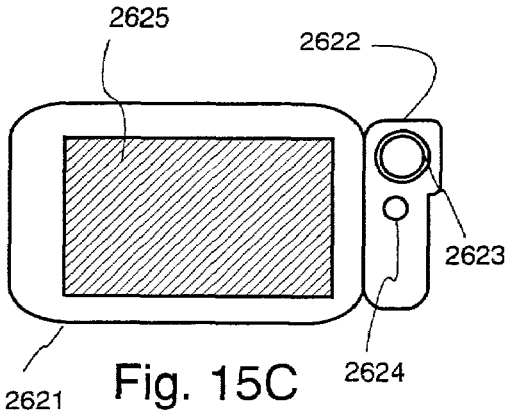

FIG. 15C illustrates a mobile computer or portable information terminal which includes a main body 2621, a camera section 2622, an image receiving section 2623, operation switches 2624, a display portion 2625, or the like. The present invention can be applied to the display portion 2625.

Figure 15D:
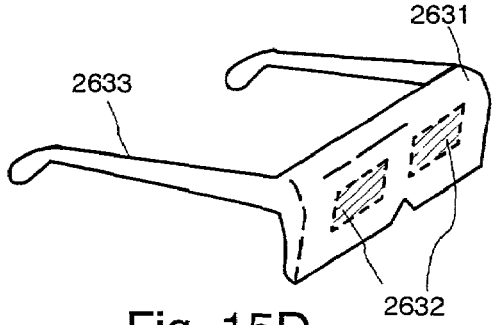

FIG. 15D illustrates a head mounted display which includes a main body 2631, a display portion 2632 and an arm portion 2633. The present invention can be applied to the display portion 2632.

Figure 15E:
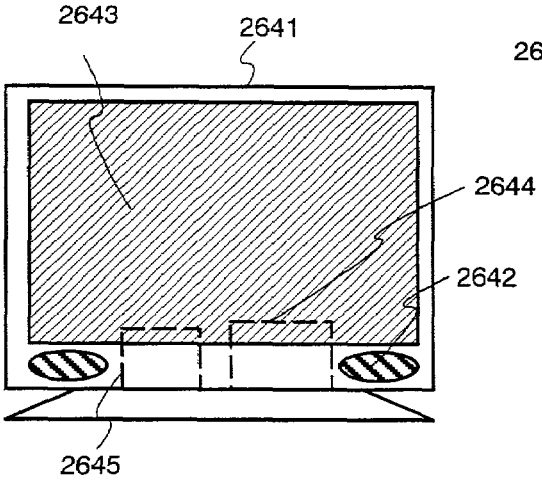

FIG. 15E illustrates a television which includes a main body 2641, a speaker 2642, a display portion 2643, an input device 2644 and an amplifier device 2645. The present invention can be applied to the display portion 2643.

Figure 15F:
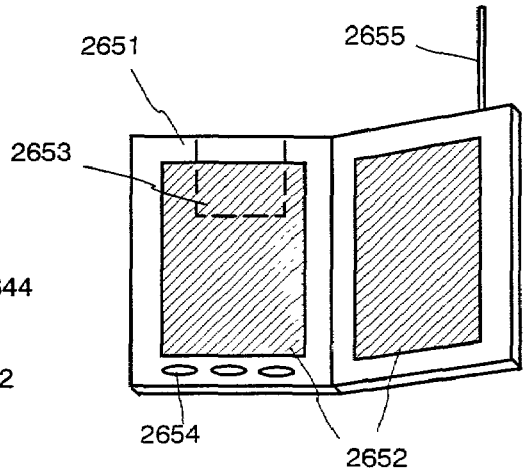

FIG. 15F illustrates a portable electronic book which includes a main body 2651, display portion 2652, a memory medium 2653, an operation switch 2654 and an antenna 2655 and the portable electronic displays a data recorded in mini disc (MD) and DVD (Digital Versatile Disc) and a data recorded by an antenna. The present invention can be applied to the display portions 2652.

Figure 16A:
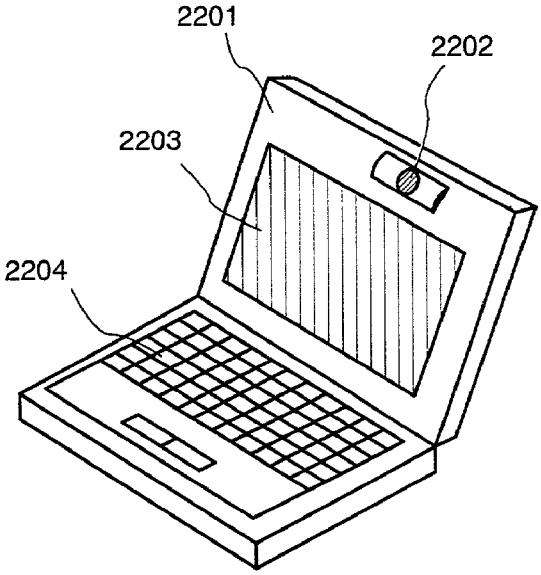
FIGS. 16A to 16D are diagrams showing electronic devices to which a display device having a pixel of the present invention can be applied.

FIG. 16A illustrates a personal computer which includes a main body 2201, an image input portion 2202, a display portion 2203, a key board 2204, or the like. The present invention can be applied to the display portion 2203.

Figure 16B:
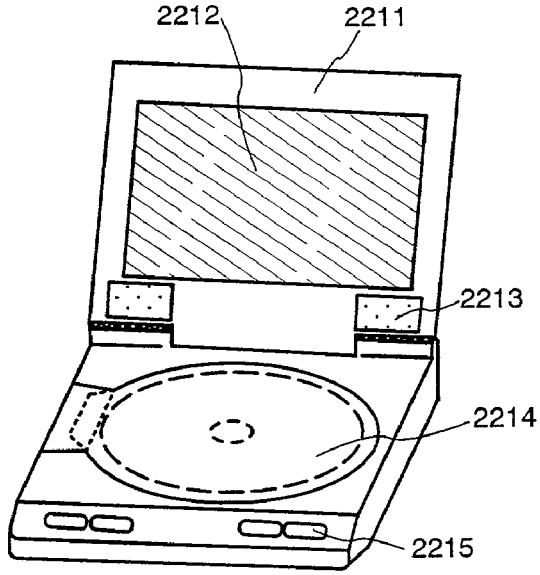

FIG. 16B illustrates a player using a recording medium which records a program (hereinafter referred to as a recording medium) and includes a main body 2211, a display portion 2212, a speaker section 2213, a recording medium 2214, and operation switches 2215. This player uses DVD (digital versatile disc), CD, etc. for the recording medium, and can be used for music appreciation, film appreciation, games and Internet. The present invention can be applied to the display portion 2212.

Figure 16C:
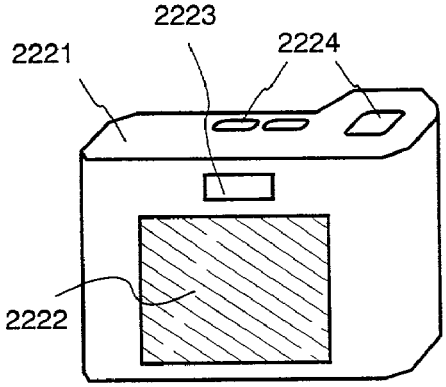

FIG. 16C illustrates a digital camera which includes a main body 2221, a display portion 2222, a view finder portion 2223, operation switches 2224, and an image receiving section (not shown in the figure). The present invention can be applied to the display portion 2222.

Figure 16D:
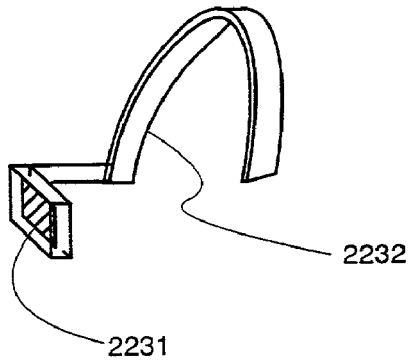

FIG. 16D illustrates a one-eyed head mounted display which includes a main body 2231 and band portion 2232. The present invention can be applied to the display portion 2231.

EMBODIMENT 15

Figure 31:
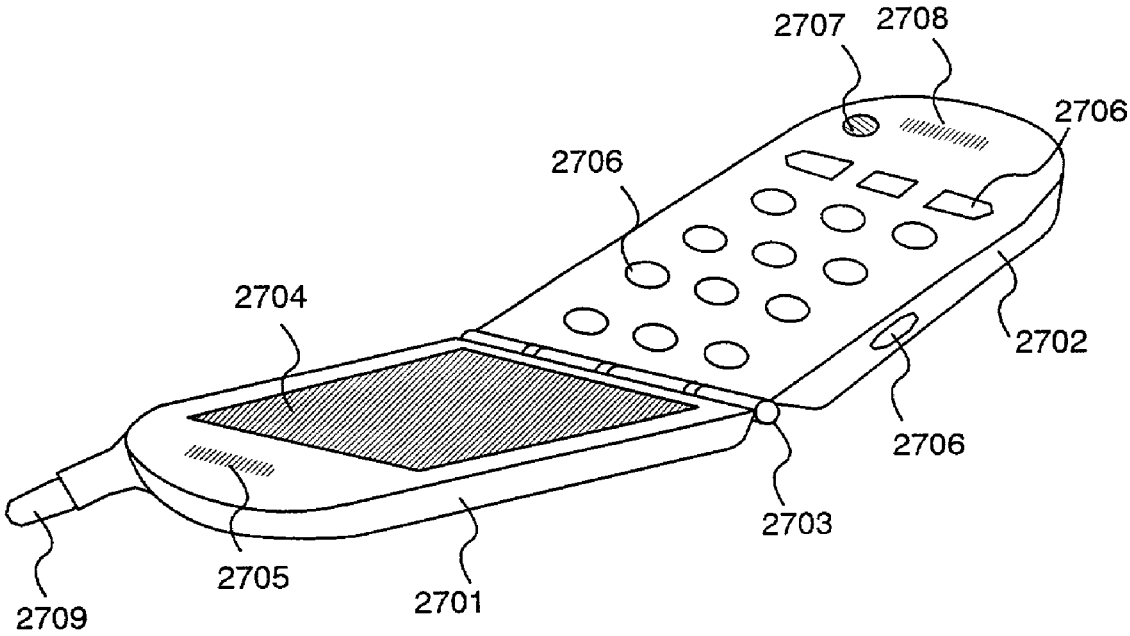
FIG. 31 is a diagram showing an example of a portable information terminal of the present invention.

This embodiment describes the appearance of a portable information terminal according to the present invention. Shown in FIG. 31 is a portable information terminal having the structure of the present invention. In FIG. 31, 2701 denotes a display panel and 2702 denotes an operation panel. The display panel 2701 is connected to the operation panel 2702 at a connector unit 2703. The plane on which a display unit 2704 of the display panel 2701 is set and the plane on which operation keys 2706 of the operation panel 2702 are set to form an angle θ at the connector unit 2703. The angle θ can be changed arbitrarily.

The portable information terminal shown in FIG. 31 has a function of telephone, and the display panel 2701 is provided with an audio output unit 2705 so that sounds are outputted from the audio output unit 2705. A liquid crystal display device of the present invention is applied to the display unit 2704.

The aspect ratio of the display unit 2704 can be set at discretion, for example, 16:9 or 4:3. A desirable size of the display unit 2704 is about 1 to 4.5 inches in diagonal.

The operation panel 2702 is provided with a power switch 2707 and an audio input unit 2708 in addition to the operation keys 2706. The power switch 2702 is provided separately from the operation keys 2706 in FIG. 31. However, the power switch 2707 may be one of the operation keys 2706. Sounds are inputted from the audio input unit 2708.

In FIG. 31, the display panel 2701 has the audio output unit 2705 whereas the operation panel 2702 has the audio input unit 2708. However, the present invention is not limited to this arrangement, and the display panel 2701 may have the audio input unit 2708 whereas the operation panel 2702 has the audio output unit 2705. Instead, both of the audio output unit 2705 and the audio input unit 2708 may be provided on the display panel 2701, or the audio output unit 2705 and the audio input unit 2708 may be provided together on the operation panel 2702.

Figure 32:
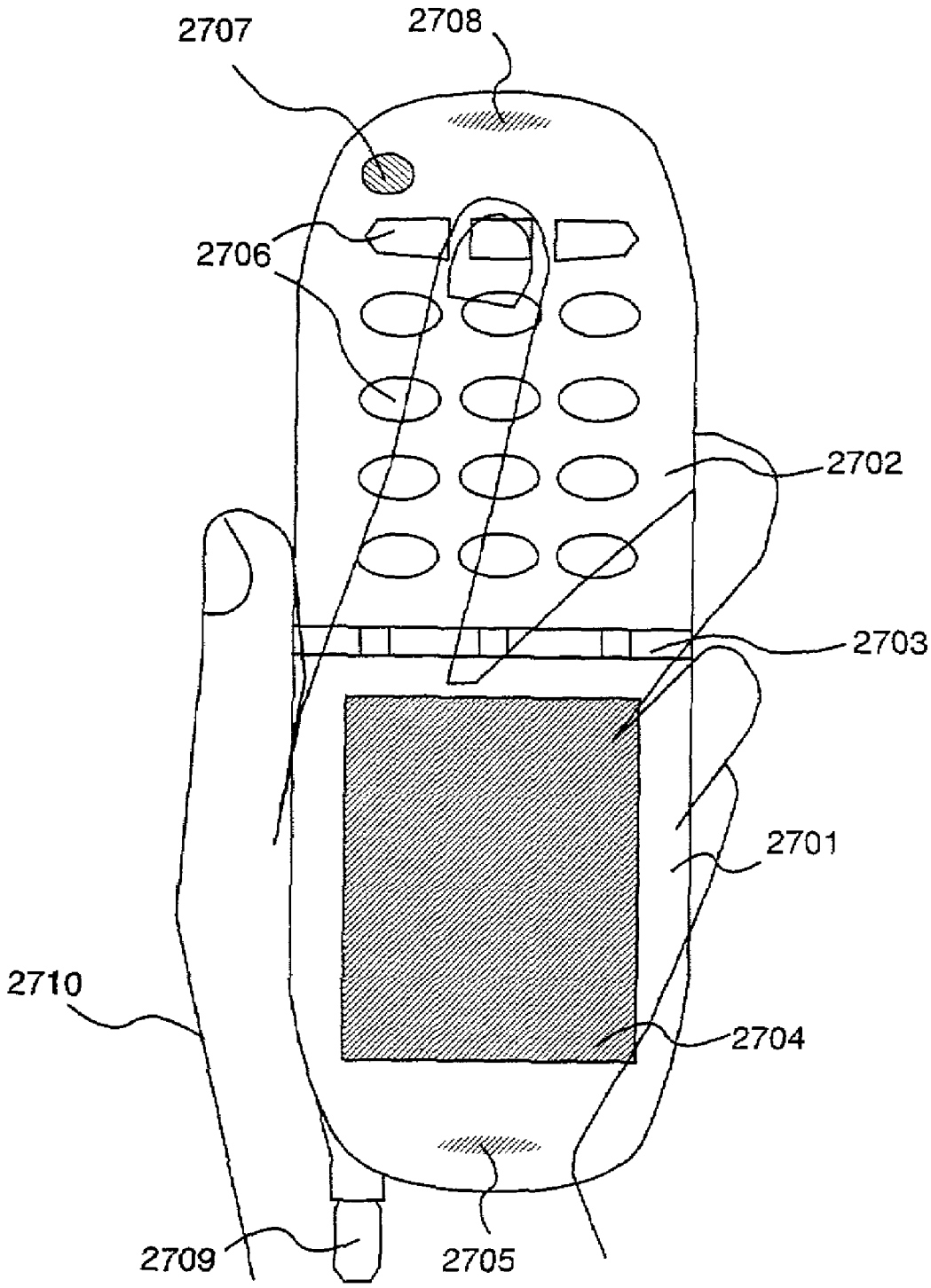
FIG. 32 is a diagram showing an example of a portable information terminal of the present invention.
Figure 33:
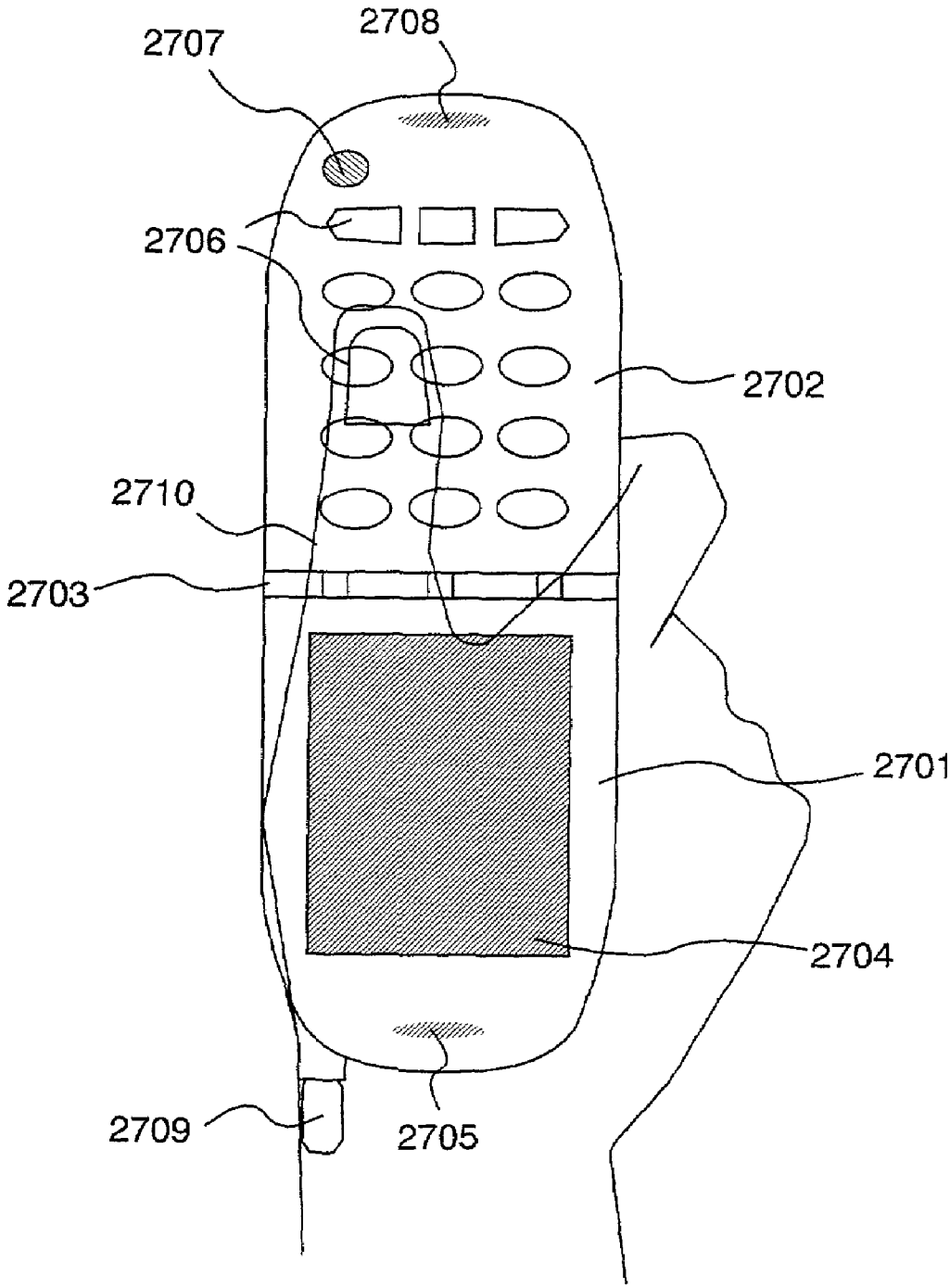
FIG. 33 is a diagram showing an example of a portable information terminal of the present invention.
Figure 34:
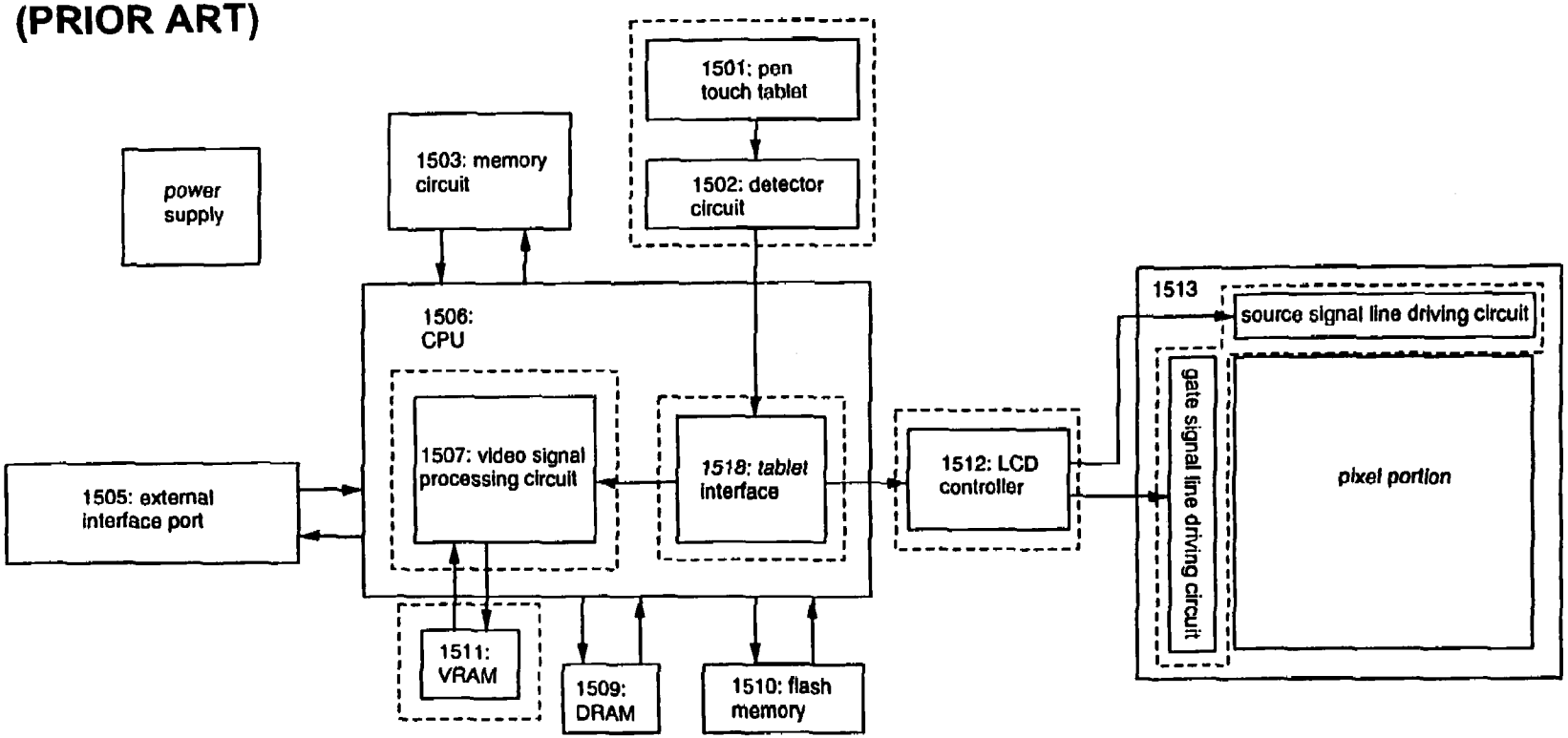
Fig. 34 (PRIOR ART)
FIG. 34 is a block diagram of a conventional portable information terminal.
Figure 35:
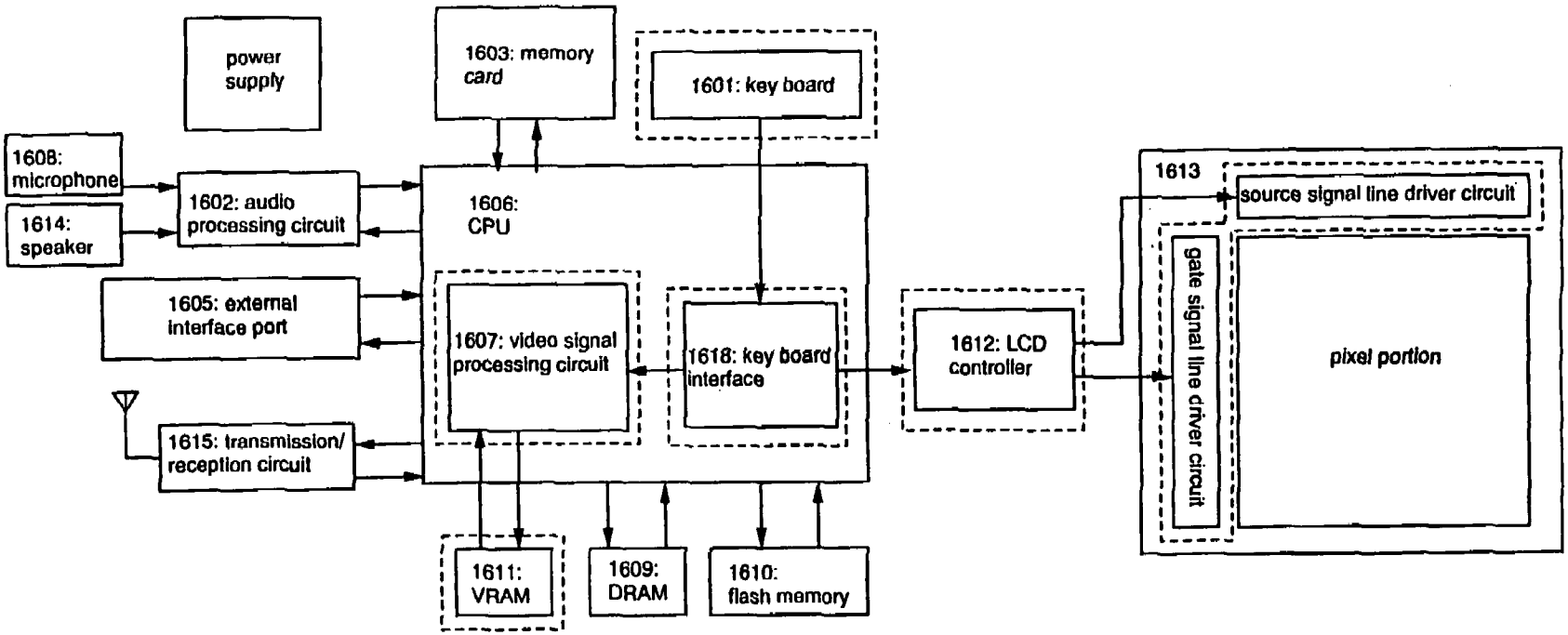
Fig. 35 (PRIOR ART)
FIG. 35 is a block diagram of a conventional cellular phone.

FIG. 32 shows a case in which an index finger is used to operate the operation keys 2706 of the portable information terminal shown in FIG. 31. On the other hand, FIG. 33 shows a case in which a thumb is used to operate the operation keys 2706 of the portable information terminal shown in FIG. 31. The operation keys 2706 may be provided on a side face of the operation panel 2702. Operation of the terminal requires only the index finger or the thumb of one (dominant) hand.

EMBODIMENT 16

This embodiment describes with reference to FIGS. 28A to 29B electronic machines to which a portable information device of the present invention is applied.

Figure 28A:
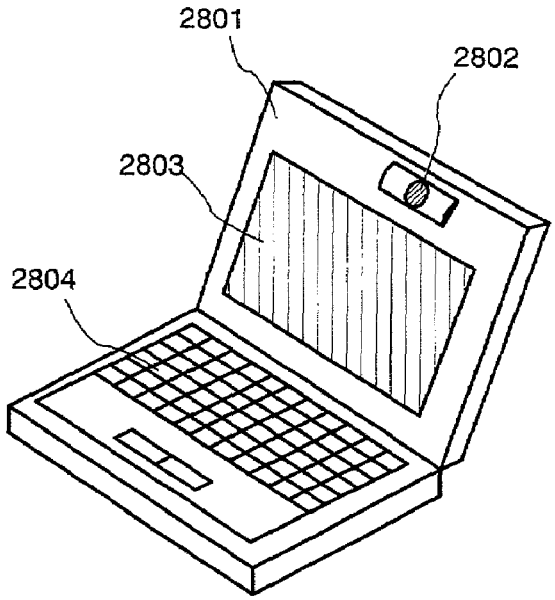
FIGS. 28A to 28C are diagrams showing application examples of a portable information device of the present invention.

A personal computer can be given as an example of the portable information device of the present invention. FIG. 28A shows a personal computer, which is composed of a main body 2801, an image input unit 2802, a display unit 2803, a keyboard 2804, etc. Power consumption of the personal computer can be reduced by employing as the display unit 2803 a liquid crystal display device in which each pixel has memory circuits.

Figure 28B:
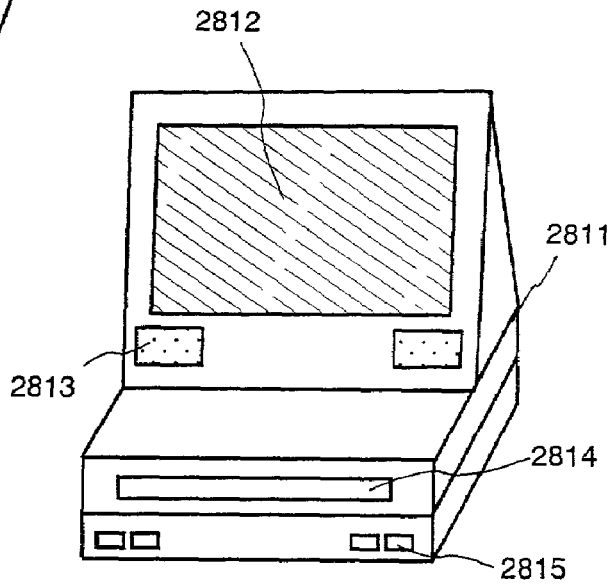

A navigation system can be given as an example of the portable information device of the present invention. FIG. 28B shows a navigation system, which is composed of a main body 2811, a display unit 2812, speaker units 2813, a storing medium 2814, operation switches 2815, etc. Power consumption of the navigation system can be reduced by employing as the display unit 2812 a liquid crystal display device in which each pixel has memory circuits.

Figure 28C:
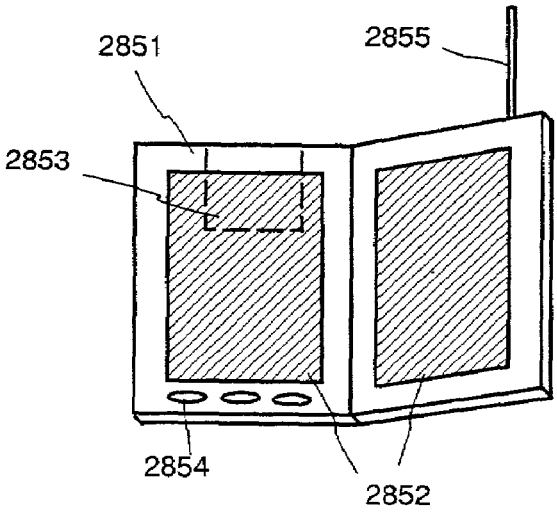

An electronic book can be given as an example of the portable information device of the present invention. FIG. 28C shows an electronic book, which is composed of a main body 2851, display units 2852, a storing medium 2853, operation switches 2854, an antenna 2855, etc. The electronic book displays data stored in a mini disk (MD) or a DVD (digital versatile disk) or a data received through the antenna. Power consumption of the electronic book can be reduced by employing as the display unit 2852 a liquid crystal display device in which each pixel has memory circuits.

Figure 29A:
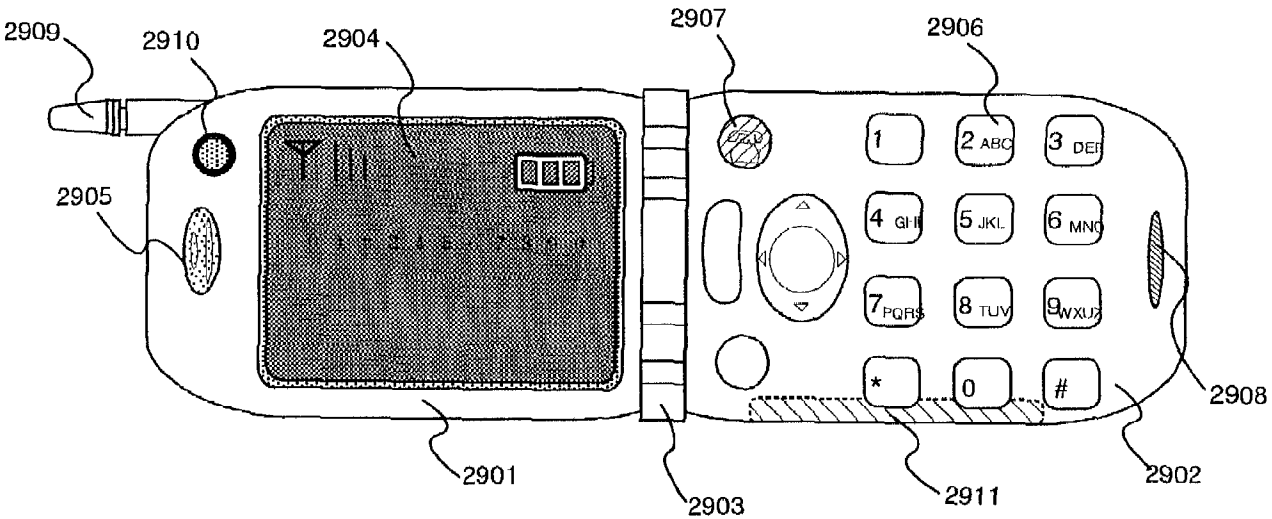
FIGS. 29A and 29B are diagrams showing application examples of a portable information device of the present invention.

A cellular phone can be given as an example of the portable information device of the present invention. FIG. 29A shows a cellular phone, which is composed of a display panel 2901, an operation panel 2902, a connector unit 2903, a display unit 2904, an audio output unit 2905, operation keys 2906, a power switch 2907, an audio input unit 2908, an antenna 2909, a CCD light receiving unit 2910, an external input port 2911, etc. Power consumption of the cellular phone can be reduced by employing as the display unit 2904 a liquid crystal display device in which each pixel has memory circuits.

Figure 29B:
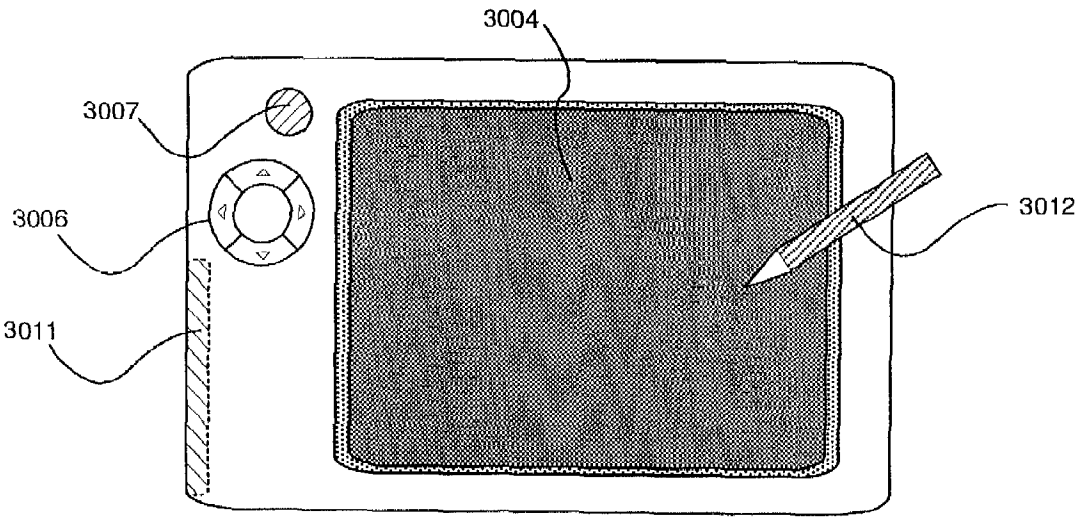

A PDA can be given as an example of the portable information device of the present invention. FIG. 29B shows a PDA, which is composed of a display unit/pen touch tablet 3004, operation keys 3006, a power switch 3007, an external input port 3011, a stylus pen 3012, etc. Power consumption of the PDA can be reduced by employing as the display unit 3004 a liquid crystal display device in which each pixel has memory circuits.

EMBODIMENT 17

This embodiment gives a description on a case where a DAC controller (not shown) is used to convert signals that are held in memory circuits of each pixel and inputted to a D/A converter into corresponding analog signals in a liquid crystal display device with its pixels structured the same way as FIG. 20. The description will be given with reference to FIG. 37.

In this embodiment, the operation of converting signals held in the memory circuits of each pixel and inputted to the D/A converter into corresponding analog signals and outputting the analog signals from the D/A converter is called a memory circuit reading out operation.

Figure 37:
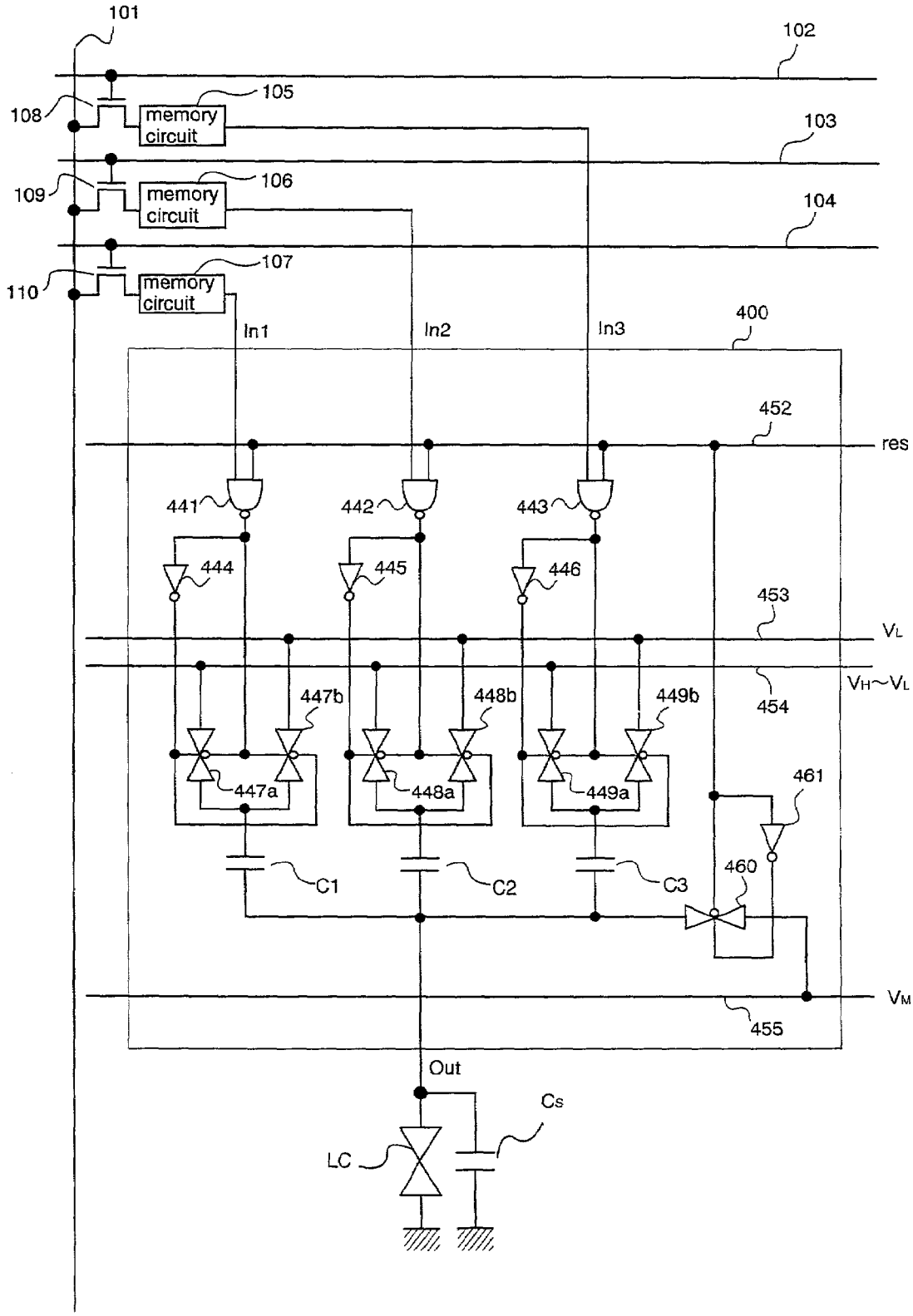
FIG. 37 is a diagram showing the structure of a pixel for a liquid crystal display device of the present invention.

In FIG. 37, the pixel has writing TFTs 108 to 110, memory circuits 105 to 107, a source signal line 101, writing gate signal lines 102 to 104, a D/A converter 400, a liquid crystal element LC, and a storage capacitor Cs.

Each of the writing TFTs 108 to 110 has a source region and a drain region one of which is connected to the source signal line 110 and the other of which is connected to an input of its associated memory circuit (108 is connected to 105, 109 is connected to 106, and 110 is connected to 107). The writing TFT 108 has a gate electrode connected to the gate signal line 102, the TFT 109 has a gate electrode connected to the line 103, and the TFT 110 has a gate electrode connected to the line 104. Outputs of the memory circuits 105 to 107 are connected to inputs In1 to In3 of the D/A converter 400, respectively. An output OUT of the D/A converter 400 is connected to the liquid crystal element LC and to one of electrodes of the storage capacitor Cs.

The D/A converter 400 is composed of NAND circuits 441 to 443, inverters 444 to 446 and 461, switches 447*a* to 449*a*, switches 447*b* to 449*b*, a switch 460, a capacitors C1 to C3, a reset signal line 452, a low voltage side gray scale power supply line 453, a high voltage side gray scale power supply line 454, and an intermediate voltage side gray scale power supply line 455.

The operations up through storing digital signals in the memory circuits 105 to 107 are the same as the operations in Embodiment Mode and Embodiment 1. The explanations of them are therefore omitted here.

Now, the operation of the D/A converter 400 will be described.

A signal RES is inputted to the reset signal line 452 to turn the switch 460 ON. The electric potential of the capacitors C1 to C3 on the side connected to OUT terminals is fixed to an electric potential $V_M$ of the intermediate voltage side gray scale power supply line 455. The electric potential of the high voltage side gray scale power supply line 453 is set to an electric potential equal to an electric potential $V_L$ of the low voltage side gray scale power supply line 453. If digital signals are inputted to In1 to In3 at this point, the signals are not written in the capacitors C1 to C3.

Thereafter, the signal RES of the reset signal line 452 changes to turn the switch 460 OFF, thereby freeing the electric potential of the capacitors C1 to C3 on the OUT terminal side from the fixed electric potential. Then the electric potential of the high voltage side gray scale power supply line 454 changes to an electric potential $V_H$ that is different from the electric potential $V_L$ of the low voltage side gray scale power supply line 453. At this point, outputs of the NAND circuits 441 to 443 are changed in accordance with the signals inputted to the terminals In1 to In3. The change in outputs of the NAND circuits turns one of the switches 447*a* and 447*b* ON, as well as one of the switches 448*a* and 448*b* and one of the switches 449*a* and 449*b*. Then the electric potential $V_H$ of the high voltage side gray scale power supply line or the electric potential $V_L$ of the low voltage side gray scale power supply line is applied to electrodes of the capacitors C1 to C3.

The capacitance of the capacitors C1 to C3 is set in accordance with the bits. For instance, C1:C2:C3 is 1:2:4.

The voltage applied to the capacitors C1 to C3 changes the electric potential of the capacitors C1 to C3 on the OUT terminal side to alter the electric potential of the outputs. In other words, analog signals corresponding to the inputted digital signals of the In1 to In3 are outputted from the OUT terminals.

The DAC controller controls the signal RES inputted to the reset signal line 452, the electric potential of the high voltage side gray scale power supply line 454, and the like, thereby controlling analog signals outputted from the D/A converter 400 in accordance with digital signals inputted.

Once digital signals are written in the memory circuits of the pixel, the above operation is repeated using the DAC controller to repeatedly read out the digital signals held in the memory circuits. A still image thus can be displayed.

The source signal line driving circuit and the gate signal line driving circuit can stop their operation during displaying a still image.

Although FIG. 37 shows as an example a pixel that has three memory circuits, the present invention is not limited thereto. To generalize, this embodiment can be applied to a liquid crystal display device in which each pixel has n (n is a natural number equal to or greater than 2) memory circuits.

The DAC controller to be used may be a circuit of known structure.

EMBODIMENT 18

Figure 36:
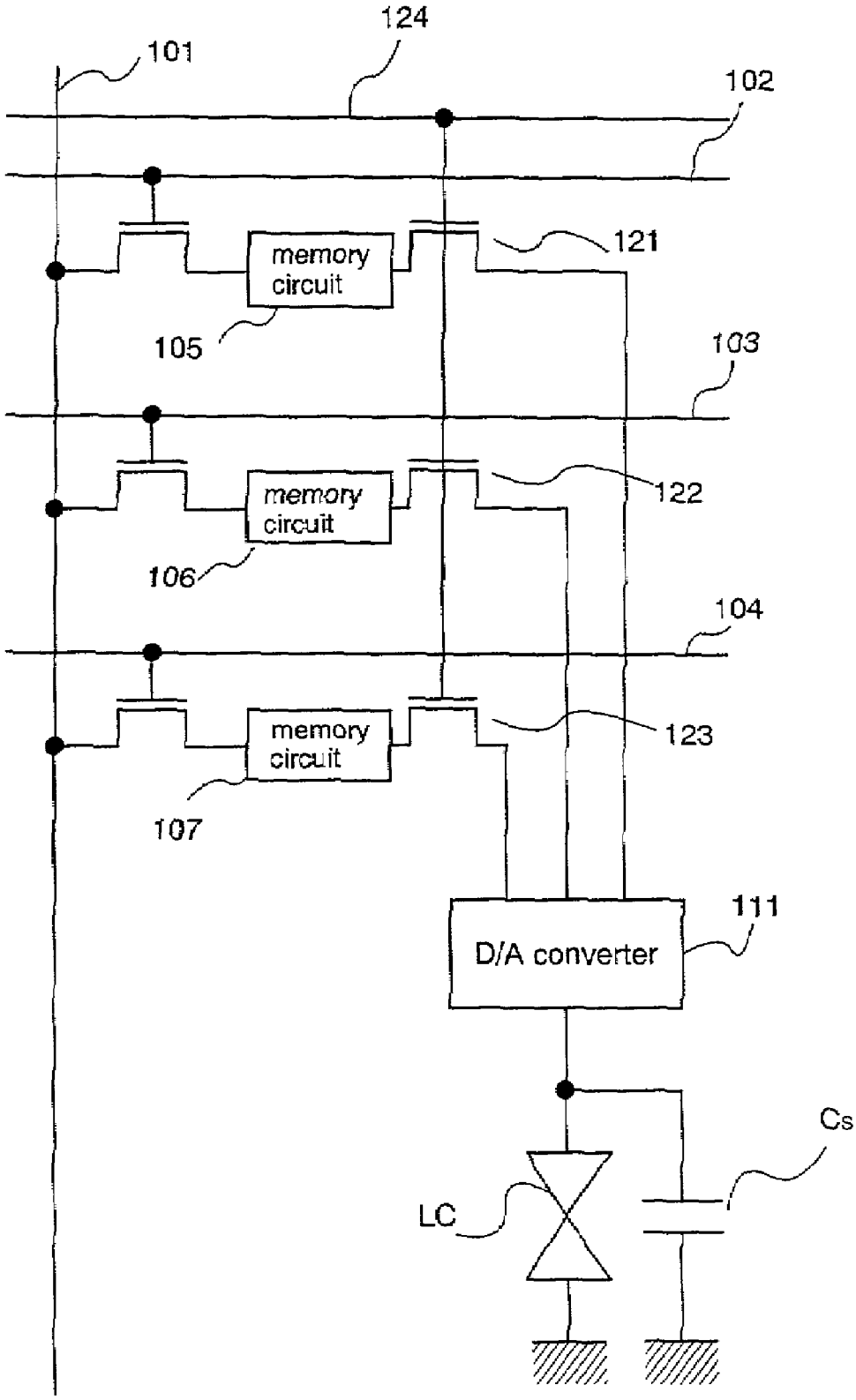
FIG. 36 is a diagram showing the structure of a pixel for a liquid crystal display device of the present invention.

This embodiment describes an example of the structure of a pixel according to the present invention with reference to FIG. 36.

In FIG. 36, components that are identical with the components in FIG. 1 are denoted by the same reference symbols and explanations thereof will be omitted.

In FIG. 36, outputs of memory circuits 105 to 107 are sent to reading out TFTs 121 to 123, respectively, and then inputted to a D/A 111. Gate electrodes of the reading out TFTs 121 to 123 are connected to a reading out gate signal line 124.

In the pixel structured as shown in FIG. 36, the operation of writing signals in the memory circuits 105 to 107 is the same as Embodiment Mode and Embodiment 1. The explanation of the operation is therefore omitted here.

If a still image is to be displayed, once digital signals are stored in the memory circuits 105 to 107, the reading TFTs 121 to 123 are turned ON by inputting signals to the reading out gate signal line 124. This causes the digital signals held in the memory circuits 105 to 107 to be inputted to the D/A 111. In the case where each pixel has reading out TFTs as in this embodiment, inputting digital signals held in the memory circuits 105 to 107 to the D/A 111 is called herein memory circuit signal reading operation.

The reading out TFTs 121 to 123 are turned ON and OFF to repeat the reading operation, whereby a still image is displayed.

The reading operation is achieved by selecting a reading out gate signal line. The reading out gate signal line 124 can be driven by a reading out gate signal line driving circuit.

This reading out gate signal line driving circuit can be any known gate signal line driving circuit.

Although FIG. 36 shows as an example a pixel that has three memory circuits, the present invention is not limited thereto. To generalize, this embodiment can be applied to a liquid crystal display device in which each pixel has n (n is a natural number equal to or greater than 2) memory circuits.

EMBODIMENT 19

Figure 38:
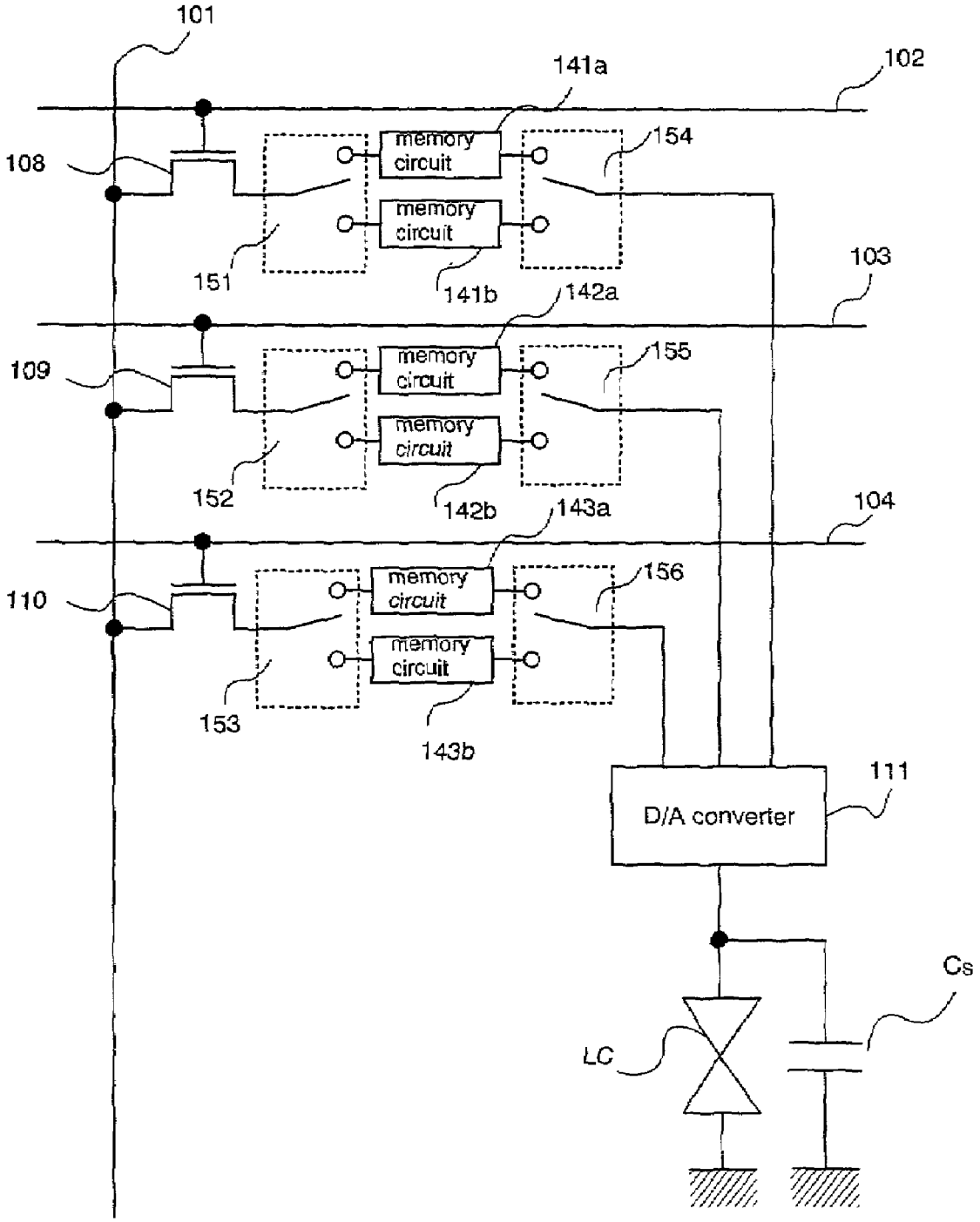
FIG. 38 is a diagram showing the structure of a pixel for a liquid crystal display device of the present invention.

This embodiment describes the structure of a pixel in a liquid crystal display device according to the present invention with reference to FIG. 38.

In FIG. 38, components that are identical with the components in FIG. 1 are denoted by the same reference symbols and explanations thereof will be omitted.

Each pixel has memory circuits 141*a* to 143*a* and memory circuits 141*b* to 143*b*.

A selecting switch 151 chooses a connection of a writing TFT 108 to the memory circuit 141*a* or to the memory circuit 141*b*. A selecting switch 152 chooses a connection of a writing TFT 109 to the memory circuit 142*a* or to the memory circuit 142*b*. A selecting switch 153 chooses a connection of a writing TFT 110 to the memory circuit 143*a* or to the memory circuit 143*b*.

A selecting switch 154 chooses a connection of a D/A 111 to the memory circuit 141*a* or to the memory circuit 141*b*. A selecting switch 155 chooses a connection of the D/A 111 to the memory circuit 142*a* or to the memory circuit 142*b*. A selecting switch 156 chooses a connection of the D/A 111 to the memory circuit 143*a* or to the memory circuit 143*b*.

With the selecting switches 151 to 153 and the selecting switches 154 to 156, whether digital signals are stored in the memory circuits 141*a* to 143*a* or whether digital signals are stored in the memory circuits 141*b* to 143*b* can be determined. Also the switches are used to choose between inputting digital signals to the D/A 111 from the memory circuits 141*a* to 143*a* and inputting digital signals to the D/A 111 from the memory circuits 141*b* to 143*b*.

In each pixel, the operation of inputting digital signals in the selected memory circuits and the operation of reading out the digital signals stored in the selected memory circuits are the same as Embodiment Mode and Embodiment 1. The explanations of the operations are therefore omitted here.

Each pixel uses the memory circuits 141*a* to 143*a* to store 3 bit digital signals corresponding to one frame period, and uses the memory circuits 141*b* to 143*b* to store 3 bit digital signals corresponding to another frame period different from the above one frame period.

The memory circuits shown in FIG. 38 store 3 bit digital signals corresponding to two frame periods, but this embodiment is not limited thereto. To generalize, this embodiment can be applied to a liquid crystal display device in which each pixel can store n (n is a natural number equal to or greater than 2) bit digital signal corresponding to m (m is a natural number equal to or greater than 2) frames.

A plurality of memory circuits arranged in each pixel are used to store digital signals, so that the digital signals stored in the memory circuits can be repeatedly used for every new frame during a still image is displayed. Thus a source signal line driving circuit can stop its operation when a still image is to be displayed continuously. Accordingly, the invention can greatly contribute to overall power consumption reduction of a liquid crystal display device.

A video signal processing circuit and other circuits for processing signals inputted to a liquid crystal display device that is incorporated in a portable information device can also stop their operation when a still image is to be displayed continuously. Therefore the invention is a great contribution to reduction in power consumption of a portable information device.

What is claimed is:

1. A liquid crystal display device comprising pixels, each of said pixels comprising:

a source signal line;

n×m (n is a natural number equal to or greater than 2, m is a natural number) memory circuits;

n gate signal lines;

n TFTs having gate electrodes wherein each of the n TFTs is connected to the source signal line and a corresponding one of said n×m memory circuits; and a D/A converter for converting n bit digital signals stored in said n×m memory circuits into analog signals, wherein said memory circuits store digital signals corresponding to m frames, and wherein each of said gate electrodes is connected to a corresponding one of said n gate signal lines.

2. A liquid crystal display device according to claim 1, wherein said memory circuits and said D/A converter are arranged so as to overlap the source signal line.

3. A liquid crystal display device according to claim 1, wherein said memory circuits are formed over one selected from the group consisting of a glass substrate, a plastic substrate, a stainless steel substrate, and a single crystal wafer.

4. A liquid crystal display device according to claim 1, wherein said liquid crystal display device is incorporated in one selected from the group consisting of a mobile telephone, a video camera, a mobile computer, a head mount display, a television set, a portable electronic book, a personal computer, and a digital camera.

5. A liquid crystal display device comprising pixels, each of said pixels comprising:

a liquid crystal element;

a source signal line;

n (n is a natural number equal to or greater than 2) gate signal lines;

n TFTs having gate electrodes;

n×m (m is a natural number) memory circuits; and a D/A converter, wherein each of said gate electrodes is connected to a corresponding one of said n gate signal lines, wherein each of said n TFTs is connected to said source signal line and an input terminal of a corresponding one of said n×m memory circuits, wherein an output terminal of each of said n×m memory circuits is connected to an input terminal of said D/A converter, and wherein an output terminal of said D/A converter is connected to said liquid crystal element.

6. A liquid crystal display device according to claim 5, wherein said liquid crystal display device has a source signal line driving circuit including shift registers, first latch circuits, second latch circuits, and switches, wherein said first latch circuits hold n bit digital signals upon receiving sampling pulses from said shift registers until said n bit digital signals are transferred to said second latch circuits, and wherein said switches select said n bit digital signals that have been transferred to said second latch circuits one bit at a time to input said selected signals into said source signal line.

7. A liquid crystal display device according to claim 5, wherein said liquid crystal display device has a source signal line driving circuit including shift registers, first latch circuits, and second latch circuits, and wherein said first latch circuits hold 1 bit digital signals upon receiving sampling pulses from said shift registers until said 1 bit digital signals are transferred to said second latch circuits.

8. A liquid crystal display device according to claim 5, wherein said memory circuits are formed over one selected from the group consisting of a glass substrate, a plastic substrate, a stainless steel substrate, and a single crystal wafer.

9. A liquid crystal display device according to claim 5, wherein said liquid crystal display device is incorporated in one selected from the group consisting of a mobile telephone, a video camera, a mobile computer, a head mount display, a television set, a portable electronic book, a personal computer, and a digital camera.

10. A liquid crystal display device according to claim 5, wherein said memory circuits and said D/A converter are arranged so as to overlap the source signal line.

11. A liquid crystal display device comprising pixels, each of said pixels comprising:

a source signal line;

a liquid crystal element;

n×m (n is a natural number equal to or greater than 2, m is a natural number) memory circuits;

n gate signal lines;

n TFTs having gate electrodes wherein each of the n TFTs is connected to the source signal line and a corresponding one of said n×m memory circuits; and a D/A converter for converting n bit digital signals stored in said n×m memory circuits into analog signals, wherein said memory circuits store digital signals corresponding to m frames, and wherein each of said gate electrodes is connected to a corresponding one of said n gate signal lines.

12. A liquid crystal display device according to claim 11, wherein said memory circuits and said D/A converter are arranged so as to overlap the source signal line.

13. A liquid crystal display device according to claim 11, wherein said memory circuits are formed over one selected from the group consisting of a glass substrate, a plastic substrate, a stainless steel substrate, and a single crystal wafer.

14. A liquid crystal display device according to claim 11, wherein said liquid crystal display device is incorporated in one selected from the group consisting of a mobile telephone, a video camera, a mobile computer, a head mount display, a television set, a portable electronic book, a personal computer, and a digital camera.

15. A display device comprising:

a plurality of pixels, each of the plurality of pixels comprising:

a source signal line;

a first memory circuit and a second memory circuit;

a first gate signal line and a second gate signal line;

a first thin film transistor and a second thin film transistor; and a D/A converter connected to the first memory circuit and the second memory circuit, wherein the first thin film transistor is connected to the source signal line and the first memory circuit, wherein the second thin film transistor is connected to the source signal line and the second memory circuit, and wherein a gate electrode of the first thin film transistor is connected to the first gate signal line and a gate electrode of the second thin film transistor is connected to the second gate signal line.

16. The display device according to claim 15, wherein the first memory circuit, the second memory circuit and the D/A converter are arranged so as to overlap the source signal line.

17. The display device according to claim 15, wherein the first memory circuit and the second memory circuit are formed over one selected from the group consisting of a glass substrate, a plastic substrate, a stainless steel substrate, and a single crystal wafer.

18. The display device according to claim 15, wherein the display device is incorporated in one selected from the group consisting of a mobile telephone, a video camera, a mobile computer, a head mount display, a television set, a portable electronic book, a personal computer, and a digital camera.

19. The display device according to claim 15, wherein a first digital signal is written to the first memory circuit in a first period by turning the first thin film transistor conductive, and a second digital signal is written to the second memory circuit in a second period by turning the second thin film transistor conductive.

* * * * *

UNITED STATES PATENT AND TRADEMARK OFFICE

CERTIFICATE OF CORRECTION

PATENT NO. : 7,224,339 B2
APPLICATION NO. : 09/923433
DATED : May 29, 2007
INVENTOR(S) : Shunpei Yamazaki et al.

It is certified that error appears in the above-identified patent and that said Letters Patent is hereby corrected as shown below:

On page 2, "U.S. PATENT DOCUMENTS", please add the following list of references that were omitted from the patent:

| | | |
|---|---|---|
| 5,959,598 | 9/28/1999 | McKnight |
| 2002/0018029 Al | 2/14/2002 | Koyama |
| 2002/0021295 Al | 2/21/2002 | Koyama et al. |
| 2002/0024054 A1 | 2/28/2002 | Koyama et al. |
| 2002/0024485 A1 | 2/28/2002 | Koyama |
| 2002/0036604 A1 | 3/28/2002 | Yamazuki et al. |

On page 2, "FOREIGN PATENT DOCUMENTS", please corrected the following references as indicated below:

| | | |
|---|---|---|
| EP | **1** 139 327 | 10/2001 |
| JP | ~~410253941~~ **10-253941** A1 | 9/1998 |

Signed and Sealed this

Sixth Day of November, 2007

JON W. DUDAS
*Director of the United States Patent and Trademark Office*